US008939449B2

(12) United States Patent
Takada

(10) Patent No.: US 8,939,449 B2
(45) Date of Patent: Jan. 27, 2015

(54) SHEET TRANSPORT APPARATUS FACILITATING ESTABLISHING A CONTINUOUS SHEET TRANSPORT PATH

(71) Applicant: Oki Electric Industry Co., Ltd., Tokyo (JP)

(72) Inventor: Atsushi Takada, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/866,563

(22) Filed: Apr. 19, 2013

(65) Prior Publication Data

US 2013/0307210 A1 Nov. 21, 2013

(30) Foreign Application Priority Data

May 17, 2012 (JP) ..... 2012-113610

(51) Int. Cl.

| | |
|---|---|
| ***B65H 39/10*** | (2006.01) |
| ***B65H 5/26*** | (2006.01) |
| ***B65H 5/36*** | (2006.01) |
| ***G07D 11/00*** | (2006.01) |

(52) U.S. Cl.

CPC .. *B65H 5/26* (2013.01); *B65H 5/36* (2013.01); *G07D 11/0081* (2013.01); *B65H 2402/10* (2013.01); *B65H 2402/441* (2013.01); *B65H 2402/62* (2013.01); *B65H 2404/6112* (2013.01); *B65H 2701/1912* (2013.01)

USPC ..... 271/299; 271/264

(58) Field of Classification Search

USPC ..... 271/264, 299; 902/9; 109/45

See application file for complete search history.

(56) References Cited

U.S. PATENT DOCUMENTS 7,900,916 B2 3/2011 Sugahara et al.

*Primary Examiner* — Michael McCullough

(74) *Attorney, Agent, or Firm* — Rabin & Berdo, P.C.

(57) ABSTRACT

In a sheet transport apparatus, first transport guides are provided in pair in parallel to, and spaced from, each other to form a first transport path to convey sheets. The transport guides have one ends engageable with the ends of second transport guides, which are provided in pair to be parallel to, and spaced from, each other to form a second transport path. A supporting member rotatably supports the second transport guides in response to the position of the first transport guides. When the ends of the first and second transport guides are brought into engagement with each other with the one ends of the second transport guides inclined against the first transport guides to displace the ends from each other, both transport paths can be connected to each other without changing the transverse cross-sectional depth thereof, thereby preventing a step or hollow from being formed in the connecting section.

10 Claims, 23 Drawing Sheets

SHEET TRANSPORT APPARATUS FACILITATING ESTABLISHING A CONTINUOUS SHEET TRANSPORT PATH

BACKGROUND OF THE INVENTION

1. Field of the Invention

The present invention relates to a bill transport apparatus, which is applicable in particular to an automatic teller machine (ATM) for depositing and withdrawing bills and more specifically to its bill transport unit.

2. Description of the Background Art

In a conventional automatic teller machine, a cashbox is disposed in the lower portion of the machine, and an upper bill mechanism is disposed above the cashbox to be movable forward and backward so as to be pulled out and installed in the machine. The upper bill mechanism is provided with a bill transport unit, or in-mechanism transport unit, forming a transport path for transporting a bill, or in-mechanism bill transport path. In the cashbox also, there is provided a bill transport unit, or in-cashbox transport unit, forming a transport path for transporting a bill, in-cashbox transport path.

The cashbox has a hole formed at a predetermined position in its top. Within the hole of the cashbox, there is disposed a bill transport unit, or delivery transport unit, forming a transport path, or bill delivery transport path, which connects, when the upper bill mechanism is installed in the automatic teller machine, the in-cashbox transport unit to the in-mechanism transport unit to transport a bill in order to deliver the bill to the in-cashbox transport path and the in-mechanism bill transport path.

In the automatic teller machine, for example, when the upper bill mechanism is installed and fixed, the in-mechanism transport unit may be displaced from immediately above the delivery transport unit toward either the pull-out side of the upper bill mechanism, i.e. mechanism pull-out side, or the installation side, i.e. mechanism installation side. The delivery transport unit is thus provided in the automatic teller machine in order to allow the bill delivery transport path to be connected to the in-mechanism bill transport path when the in-mechanism transport unit is displaced with respect to the delivery transport unit toward the mechanism pull-out side or the mechanism installation side.

Now with reference to FIG. 21, in an in-mechanism transport unit 200, parallel transport guides 210 and 211 are installed in pair at its section connected to the transport path to a delivery transport unit 201 at a predetermined spacing in the pull-out direction of the upper bill mechanism, or mechanism pull-out direction, as represented by an arrow a10, and a roller or the like, not shown, is also disposed. Thus, the in-mechanism transport unit 200 forms an in-mechanism bill transport path between one transport guide located on the mechanism pull-out side, or pull-out side fixing guide, 210 and the other transport guide located on the mechanism installation side, or installation side fixing guide, 211. The in-mechanism bill transport path has its transverse cross-sectional depth corresponding to a distance between the guides. The pull-out side fixing guide 210 and the installation side fixing guide 211 have their respective comb-like front end pointing downward. The pull-out side fixing guide 210 has its planer presser 212 formed at a predetermined position, which protrudes toward the delivery transport unit 201, that is, downward.

In the delivery transport unit 201, transport guides 220 and 221 are located in pair at its section connected to the transport path to the in-mechanism transport unit 200 at a predetermined spacing in the mechanism pull-out direction, and are rotatable about respective rotational shafts 222 and 223 attached to the bottom ends of the guides. Rollers 224, 225 and a transport belt 226 are provided.

Thus, the delivery transport unit 201 forms a bill delivery transport path between one transport guide located on the mechanism pull-out side, or pull-out side movable guide, 220 and the other transport guide located on the mechanism installation side, or installation side movable guide, 221. The bill delivery transport path has its cross-sectional depth corresponding to a distance between the guides. In this case, the pull-out side movable guide 220 and the installation side movable guide 221 have their respective front ends located higher than their respective bottom ends, and the front ends are comb-shaped. The pull-out side movable guide 220 is provided with a generally L-like protrusion 220A at its front end, which protrudes toward the mechanism installation side.

The delivery transport unit 201 has a spring, or pull-out side spring, 227 that is closer to the mechanism pull-out side than the pull-out side movable guide 220, and the pull-out side spring 227 biases the pull-out side movable guide 220 to rotate clockwise, i.e. toward the mechanism installation side. The delivery transport unit 201 has a spring having a larger elastic force than the pull-out side spring 227, installation side spring, 228 that is closer to the mechanism installation side than the installation side movable guide 221, and the installation side spring 228 biases the installation side movable guide 221 to rotate counterclockwise, i.e. toward the mechanism pull-out side. Thus, in the delivery transport unit 201, the pull-out side spring 227 and the installation side spring 228 cause the protrusion 220A of the pull-out side movable guide 220 to be pressed against the front end of the installation side movable guide 221.

In the delivery transport unit 201, the length of the protrusion 220A is selected such that, when the pull-out side movable guide 220 is made perpendicular to the mechanism pull-out direction and the protrusion 220A is pressed to a predetermined position, i.e. reference position, of the front end of the installation side movable guide 221, the pull-out side movable guide 220 and the installation side movable guide 221 are substantially parallel to each other separated from each other at a spacing substantially equal to the spacing between the pull-out side fixing guide 210 and the installation side fixing guide 211, that is, both guides are rendered vertically located.

In the automatic teller machine thus structured, when the upper bill mechanism is pulled out for maintenance, the in-mechanism transport unit 200 is separated from the delivery transport unit 201. At that time, in the automatic teller machine, the installation side movable guide 221 and the pull-out side movable guide 220 are rotated counterclockwise by a predetermined angle at which elastic forces of the pull-out side spring 227 and the installation side spring 228 are well-balanced to incline the guides.

In this state, when the upper bill mechanism is installed in the automatic teller machine, the presser 212 of the in-mechanism transport unit 200 is pressed against the protrusion 220A of the pull-out side movable guide 220, thereby rotating the pull-out side movable guide 220 clockwise by an angle corresponding to the position of the presser 212 of the in-mechanism transport unit 200. The automatic teller machine is adapted to press the protrusion 220A of the pull-out side movable guide 220 against the front end of the installation side movable guide 221, thereby rotating the installation side movable guide 221 clockwise in cooperation with the rotation of the pull-out side movable guide 220.

Thus, as shown in FIG. 22, in the automatic teller machine, when the in-mechanism transport unit 200 is displaced from immediately above the delivery transport unit 201 toward the mechanism pull-out side, the pull-out side movable guide 220 and the installation side movable guide 221 are rendered inclined from the vertical position toward the mechanism pull-out side, and their front ends are made engaged with the front ends of the pull-out side fixing guide 210 and the installation side fixing guide 211 so as to connect the bill delivery transport path to the in-mechanism bill transport path.

As shown in FIG. 23, in the automatic teller machine, when the in-mechanism transport unit 200 is located immediately above the delivery transport unit 201, the pull-out side movable guide 220 and the installation side movable guide 221 are put into the vertical position, and their front ends are made engaged with the front ends of the pull-out side fixing guide 210 and the installation side fixing guide 211 so as to connect the bill delivery transport path to the in-mechanism bill transport path.

Further, as shown in FIG. 24, in the automatic teller machine, when the in-mechanism transport unit 200 is displaced from immediately above the delivery transport unit 201 toward the mechanism installation side, the pull-out side movable guide 220 and the installation side movable guide 221 are made inclined from the vertical position toward the mechanism installation side, and their front ends are engaged with the front ends of the pull-out side fixing guide 210 and the installation side fixing guide 211 so as to connect the bill delivery transport path to the in-mechanism bill transport path.

The automatic teller machine is thus adapted such that, when the upper bill mechanism is installed and fixed, the bill delivery transport path can be connected to the in-mechanism bill transport path irrespective of how the in-mechanism transport unit 200 is displaced from the delivery transport unit 201. In this connection, refer to U.S. Pat. No. 7,900,916 to Sugahara, et al., column 3, line 37—column column 9, line 64, and FIGS. 3 and 5-13.

In the automatic teller machine thus structured, when the pull-out side movable guide 220 is rotated clockwise upon installing the upper bill mechanism, the installation side movable guide 221 is also rotated clockwise by pressing of the protrusion 220A fixed to the pull-out side movable guide 220.

More specifically, when the in-mechanismtransport unit 200 is displaced from immediately above the delivery transport unit 201 toward the mechanism pull-out side of the automatic teller machine, the protrusion 220A of the pull-out side movable guide 220 is pressed to a position closer to the front end than the reference position of the installation side movable guide 221, thereby inclining the pull-out side movable guide 220 and the installation side movable guide 221 from the vertical position toward the mechanism pull-out side. When the in-mechanism transport unit 200 is displaced from immediately above the delivery transport unit 201 toward mechanism installation side of the automatic teller machine, the protrusion 220A of the pull-out side movable guide 220 is pressed to a position closer to the bottom end than the reference position of the installation side movable guide 221, thereby inclining the pull-out side movable guide 220 and the installation side movable guide 221 from the vertical position toward the mechanism installation side.

However, in the automatic teller machine, when the protrusion 220A of the pull-out side movable guide 220 is pressed to the position other than the reference position of the installation side movable guide 221 as described above, the pull-out side movable guide 220 and the installation side movable guide 221 are inclined at a different inclination angle so that they are not in parallel to each other. More specifically, in the automatic teller machine, when the pull-out side movable guide 220 and the installation side movable guide 221 are inclined, they become different in the cross-sectional depth of the transport path between the front ends and the bottom ends thereof.

Owing to the difference in cross-sectional depth, in the automatic teller machine, the pull-out side movable guide 220 and the installation side movable guide 221 are inclined to be engaged with the pull-out side fixing guide 210 and the installation side fixing guide 211, as apparent from FIGS. 22 and 24, the front end/ends of the bill delivery transport path or/and the in-mechanism bill transport path enters may be caught by the connecting section of the bill delivery transport path with the in-mechanism bill transport path, causing a step or a hollow to be formed.

When the front end of the path enters into the connecting section between the bill delivery transport path and the in-mechanism bill transport path to form the step or hollow, a bill, when transported therethrough, may be caught by the step or hollow of the connecting section, thus causing the bill to be jammed or broken.

Thus, the conventional automatic teller machine has the problem that the bill delivery transport path would not be sufficient in being adequately connected to the in-mechanism bill transport path irrespective of displacement of the in-mechanism transport unit 200 from the delivery transport unit 201.

SUMMARY OF THE INVENTION

In consideration of those matters, it is an object of the present invention to provide a bill transport apparatus that has a transport path adequately connected to a transport path to be connected irrespective of how both transport paths are displaced from each other.

According to the present invention, a sheet transport apparatus comprises: a first pair of transport guides substantially parallel to each other and spaced with a predetermined spacing to form a first transport path in between to transport a sheet; a second pair of transport guides substantially parallel to each other and spaced with the spacing to form a second transport path in between to transport the sheet, the second transport guides having one end shaped to be engageable with an end of said first pair of transport guides; and a supporting member rotatably supporting the second pair of transport guides in response to a position of said first pair of transport guides.

According to the present invention, the second pair of transport guides may be rotated in response to the position of the first pair of transport guides. Thus, when the ends of the second pair of transport guides are brought into engagement with the ends of the first pair of transport guides with the one ends of the second pair of transport guides inclined with respect to the first pair of transport guides so as to displace the ends of the first pair of transport guides from the ends of the second transport guides, the first transport path can successfully be connected to the second transport path without changing the transport path transverse cross-sectional depth, thereby reliably preventing a step or hollow from being formed in the connecting section.

The sheet transport apparatus according to the present invention is configured as described above, so that the second pair of transport guides may be rotated in response to the position of the first pair of transport guides. Hence, when the ends of the first and second transport guides are brought into engagement with each other, if the second transport path is displaced from the first transport path with the one ends of the second pair of transport guides inclined with respect to the first pair of transport guides to be engaged with the ends of the first pair of transport guides, the first transport path can be connected to the second transport path without changing the transport path transverse cross-sectional depth, thereby reliably preventing a step or hollow from being formed in the connecting section. It is thus possible to implement a sheet transport apparatus and a sheet handling apparatus, which can properly connect the first and second transport paths to each other, irrespective of how they are displaced.

The inventive concept disclosed in the application may also be defined in ways other than in the claims presented below. The inventive concept may consist of several separate inventions particularly if the invention is considered in light of explicit or implicit subtasks or from the point of view of advantages achieved. In such a case, some of the attributes included in the claims may be superfluous from the point of view of separate inventive concepts. Within the framework of the basic inventive concept, features of different embodiments are applicable in connection with other embodiments.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

With reference to the accompanying drawings, preferred embodiments implementing the present invention will be described in detail.

Figure 1:
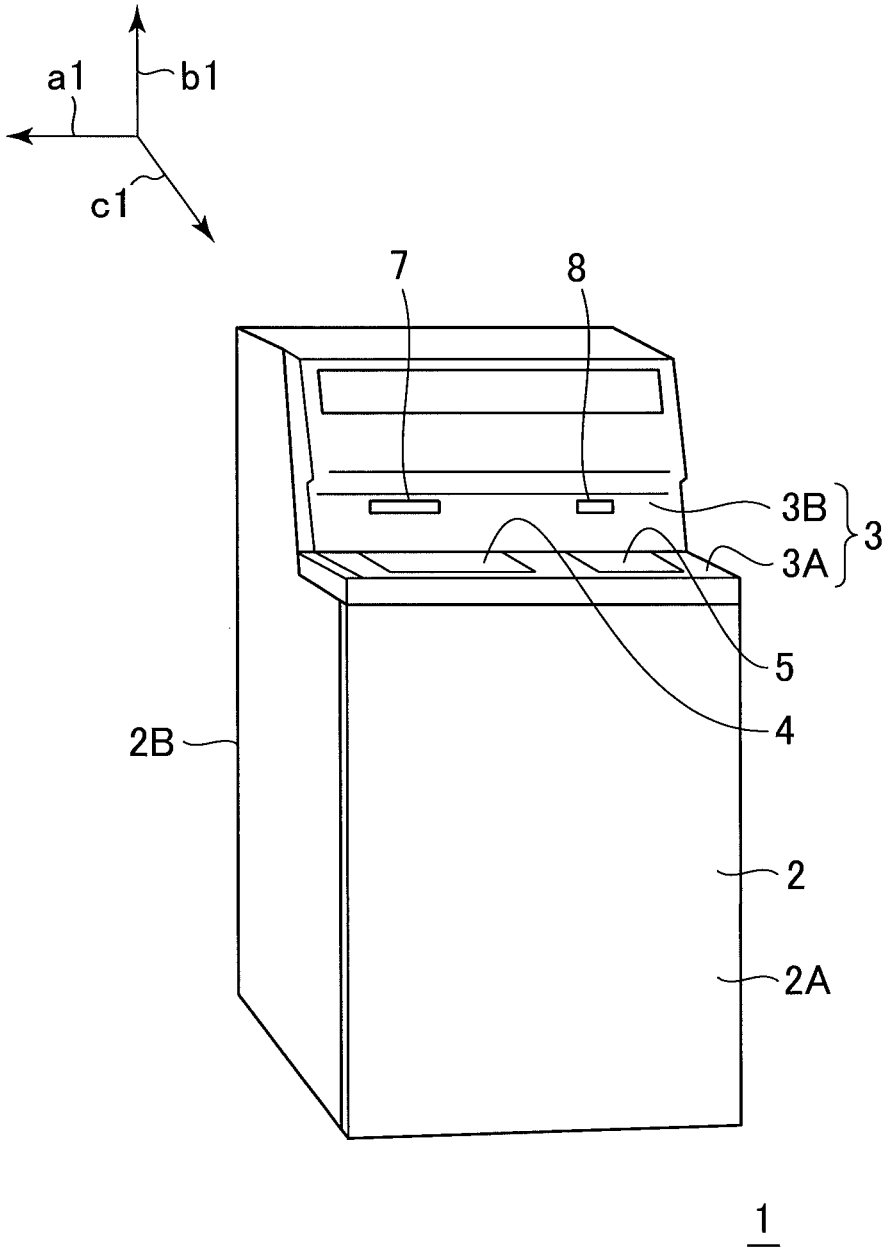
FIG. 1 is a schematic perspective view showing the appearance of an illustrative embodiment of an automatic teller machine according to the present invention.

At first, the appearance of an automatic teller machine of an illustrative embodiment will be outlined with reference to FIG. 1, which shows the appearance of an automatic teller machine 1 to which the present invention applies. The automatic teller machine 1 has a generally box-like housing 2, which may be referred to as a teller machine housing.

In the following description, when viewing the automatic teller machine 1 from the side of its front surface 2A, a leftward direction represented by an arrow a1 in the figure may be referred to as a teller machine leftward direction, and the direction opposite to the teller machine leftward direction may be referred to as a teller machine rightward direction. Further, when the teller machine leftward and rightward directions need not particularly be distinguished from each other, both directions may collectively referred to as a teller machine horizontal direction.

Similarly in the following description, when viewing the automatic teller machine 1 from the side of its front surface 2A, an upward direction represented by an arrow b1 in the figure may be referred to as a teller machine upward direction, and the direction opposite to the teller machine upward direction may be referred to as a teller machine downward direction. Further, when the teller machine upward and downward directions need not particularly be distinguished from each other, both directions may be collectively referred to as a teller machine vertical direction.

Also similarly, when viewing the automatic teller machine 1 from the side of its front surface 2A, a front, or near-end, direction represented by an arrow c1 in the figure may be referred to as a teller machine front direction, and the direction opposite to the teller machine front direction may be referred to as a teller machine rear direction. Further, when the teller machine front and rear directions need not particularly be distinguished from each other, both directions may be collectively referred to as a teller machine fore-and-aft direction.

Now, the teller machine housing 2 has a front panel 3 formed on its front top in a generally L-like vertical cross section, viewed from the leftward direction a1, which is dented from the front surface 2A toward a rear surface 2B.

The front panel 3 has its substantially horizontal up-facing panel portion 3A which is generally directed in the teller machine upward direction. The panel portion 3A has its left half provided with a touch screen 4, for example, adapted to display various operation images and receive touch inputs. The up-facing panel portion 3A of the front panel 3 is further provided on, e.g. its right half with a bill inlet/outlet port 5 for receiving and ejecting bills.

The front panel 3 has its substantially vertical front-facing panel portion 3B generally directed in the teller machine front direction. The panel portion 3B has its left half provided with a bankbook receiving and discharging slot 7, for example, adapted for receiving or discharging a bankbook and/or a transaction statement at transaction. The front-facing panel portion 3B of the front panel 3 is further provided on, e.g. its right half with a card receiving and discharging slot 8 adapted for receiving and discharging plastic cards such as cash cards and credit cards at transaction, for example.

The automatic teller machine 1 thus structured is adapted to display operation images on the touch screen 4, and appropriately switch the operation images in response to touch inputs on the surface of the touch screen 4 by the customer. Thus, the automatic teller machine 1 uses the operation images to guide the customer to proceed to desired transaction such as depositing and withdrawing bills. Then, the automatic teller machine 1 prompts the customer to insert, according to the guidance, his or her bankbook or plastic card into the bankbook receiving and discharging slot 7 or the card receiving and discharging slot 8, and/or to put bills for depositing into the bill receiving and ejecting port 5.

The automatic teller machine 1 also prompts the customer to receive, according to the guidance, his or her bankbook and/or card, and/or a transaction statement, which may be discharged from the bankbook receiving and discharging slot 7 or the card receiving and discharging slot 8, and/or ejects bills for withdrawal from the bill receiving and ejecting port 5. In this manner, the automatic teller machine 1 can perform transactions such as depositing and withdrawing bills as the customer desires.

Figure 2:
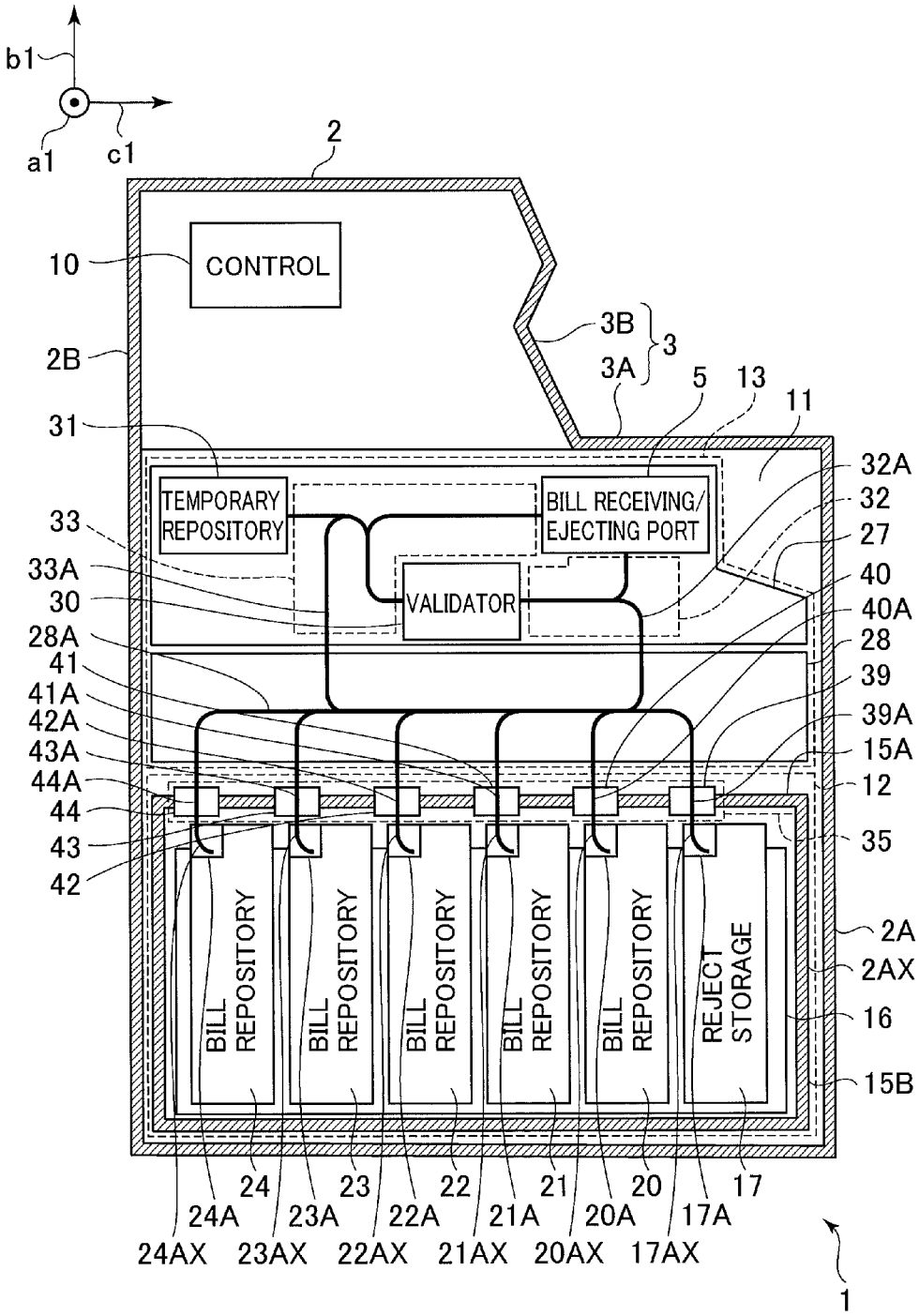
FIG. 2 is a schematic side cross-sectional view showing the internal structure of the automatic teller machine of the embodiment shown in FIG. 1.

Next, the internal structure of the automatic teller machine 1 will be described. As shown in FIG. 2, the teller machine housing 2 of the automatic teller machine 1 encloses a control unit 10 for generally controlling the automatic teller machine 1, and a bill processing unit 11 for processing the deposition and withdrawal of bills under the control of the control unit 10.

The bill processing unit 11 includes a lower and an upper unit 12 and 13, the latter being placed on the lower unit 12. The lower unit 12 encloses a cashbox housing 15 formed in a generally box-like shape by a plurality of relatively thick metal plates layered with each other. The cashbox housing 15 is thus fixed in the teller machine housing 2.

The cashbox housing 15 contains repository load casing 16 of a generally box-like shape having its top opened. The repository load casing 16 is provided, for example, on its bottom surface with a plurality of partition plates, not shown, fixed at predetermined intervals from the front to the rear. The bottom surface is thus sectioned by the plurality of partition plates into the corresponding plurality of repository loading positions from the front to the rear.

In the repository load casing 16, one bill repository 17 may detachably be loaded at the forefront repository loading position for storing abnormal bills such as broken or folded bills. Further in the repository load casing 16, at the repository loading positions other than the forefront repository loading position, there may detachably be loaded plural, e.g. five, bill repositories 20 to 24, each of which is adapted for storing bills for deposit and withdrawal when sorted according to denominations so as to exclusively store appropriate bills.

In the context, abnormal bills such as broken, damaged or folded bills may be referred to as reject bills when distinguishing them from ones for deposit and withdrawal. The bill repository 17 exclusively for use in storing reject bills may be referred to as a reject storage 17 when distinguishing the same from the bill repositories 20 to 24 for use in storing bills for deposit and withdrawal according to denominations.

The reject storage 17 has its top portion incorporating therein a bill transport unit, i.e. reject storage transport unit, 17A which has various transport path components including a transport guide and a roller. The transport path components of the reject storage transport unit 17A constitute a reject bill transport path or channel 17AX for transporting or conveying reject bills into the reject storage 17.

The bill repositories 20 to 24 may be the same in structure as each other. Each of the bill repositories 20 to 24 has its top portion incorporating therein a bill transport unit, i.e. repository transport unit, 20A to 24A which has various transport path components including a transport guide, a roller and a roller driving motor. The repository transport units 20A to 24A have respective stored-bill transport paths 20AX to 24AX constituted by various transport path components for conducting and ejecting bills to and from the bill repositories 20 to 24.

Now, the upper unit 13 has an upper housing 27 and a bill transport unit 28, which is attached to the bottom surface of the upper housing 27. The upper housing 27 includes the bill receiving and ejecting port 5 so as to oppose the up-facing panel portion 3A, obliquely downward and backward from which a bill validator 30 is disposed. The upper housing 27 also includes a temporary repository 31 disposed behind the bill receiving and ejecting port 5 and the bill validator 30.

In the upper housing 27, a bill transport unit, or front transport unit, 32 is disposed between the front bill receiving and ejecting port 5 and the bill validator 30. The front transport unit 32 is constituted by various transport path components including a transport guide, a roller and a roller driving motor. The front transport unit 32 constitutes a front bill transport path or channel 32A by the transport path components for appropriately switching in accordance with the destinations of bills to transport or transfer them. The front bill transport path 32A is connected to the bill receiving and ejecting port 5 and the bill validator 30 as depicted.

The upper housing 27 further includes another bill transport unit, i.e. rear transport unit, 33 which is disposed between the rear bill receiving and ejecting port 5, the bill validator 30 and the temporary repository 31. The rear transport unit 33 is constituted by various transport path components including a transport guide, a roller and a roller driving motor. The rear transport unit 33 constitutes a transport path or channel by the transport path components to form a plurality of branches, i.e. rear bill transport paths, 33A, over which the destinations of bills are appropriately switched to transfer them. The rear bill transport paths 33A are connected to the bill receiving and ejecting port 5, the bill validator 30 and the temporary repository 31.

The bill transport unit 28 attached to the lower surface of the upper housing 27 has a variety of transport path components including a transport guide, a roller and a roller driving motor. The bill transport unit 28 constitutes a transport path, i.e. bill sorting and transport path, 28A by those transport path components for appropriately switching the destinations of reject and/or normal bills so as to appropriately sort and transfer the bills into the reject storage 17 and/or the bill repositories 20 to 24. The bill sorting and transport path 28A has its two upper ends connected to the lower ends of the front and rear bill transport paths 32A and 33A, respectively. In the context, the bill transport unit 28 that is provided on the lower surface of the upper housing 27 and constitutes the bill sorting and transport path 28A may be referred to as a sorting and transport unit 28.

Additionally, in the lower unit 12, the cashbox housing 15 has its top plate, i.e. cashbox top plate, 15A provided with a linkage unit 35 for coupling the sorting and transport unit 28 with the reject storage transport unit 17A and the repository transport units 20A to 24A.

Figure 3:
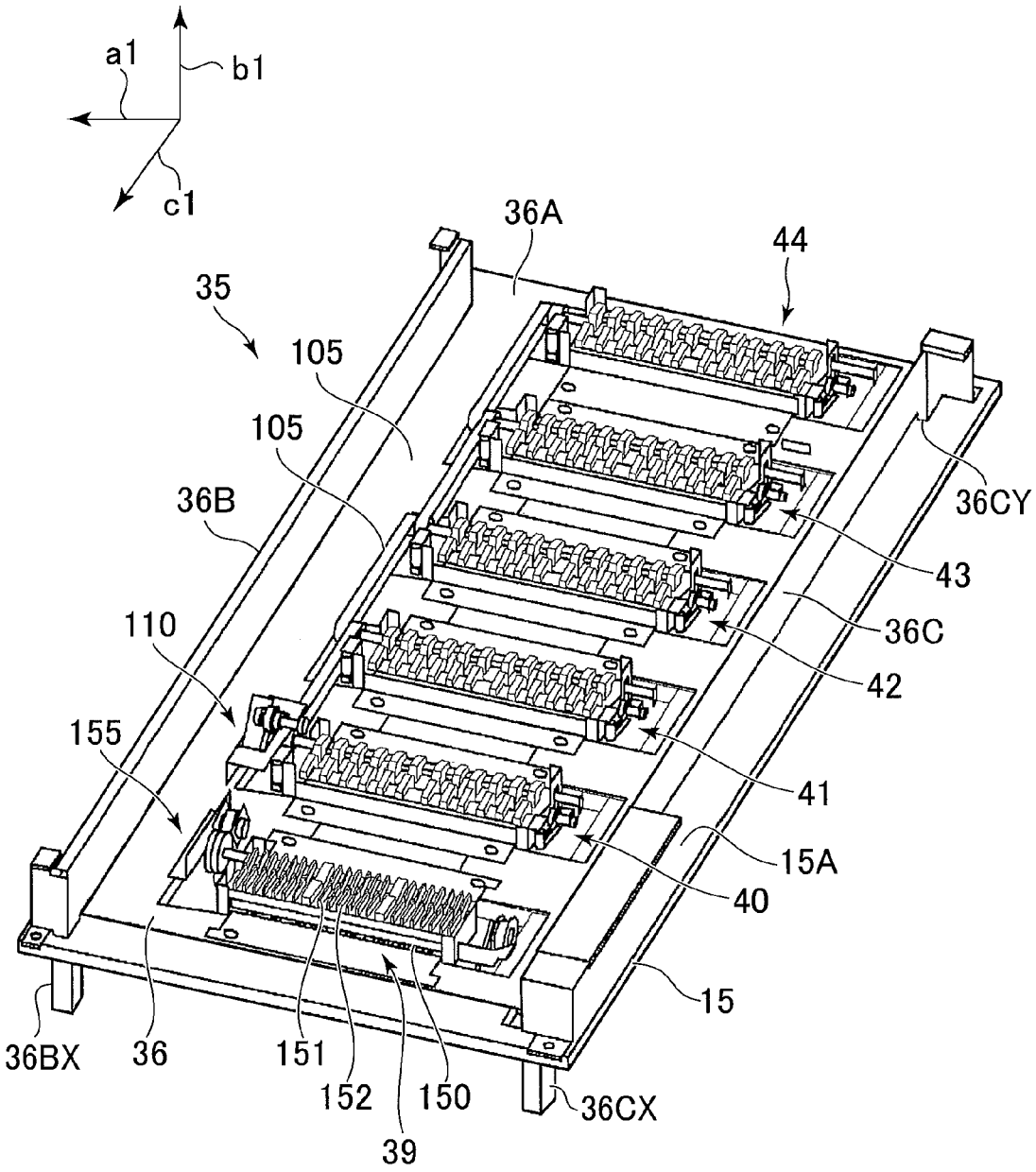
FIG. 3 is a schematic perspective view showing the structure of the linkage unit of the illustrative embodiment.

As shown in FIG. 3, the linkage unit 35 has a linkage frame 36, which may be manufactured from, for example, one generally rectangular metal sheet processed so as to be of substantially the same dimension as the cashbox top plate 15A. The linkage frame 36 has, at its central region, a generally rectangular, planer attaching member 36A that is elongated in the fore-and-aft direction c1. In the linkage frame 36, the attaching member 36A has its left and right ends provided with left and right unit support members 36B and 36C provided, which are generally of an elongated C-shape in the fore-and-aft direction and protrude upward from the attaching member 36A. In this case, the left unit support member 36B of the linkage frame 36 has its central portion oriented substantially in parallel to the teller machine fore-and-aft direction with its front and rear ends bent toward the teller machine leftward direction so as to be substantially in perpendicular to its central portion.

On the lower surface of the linkage frame 36, an angled left front casing support member 36BX and an angled left rear casing support member, not seen from the figure, are provided at the front and rear bent portions of the left unit support member 36B, respectively. The support members are of a predetermined length to protrude downward from the respective bent portions.

The right unit support member 36C of the linkage frame 36 has its central portion oriented substantially in parallel to the teller machine fore-and-aft direction with its front and rear ends bent toward the teller machine right direction so as to be substantially perpendicularly to its central portion.

Correspondingly, on the lower surface of the linkage frame 36, an angled right front casing support member 36CX and an angled right rear casing support member 36CY are provided at the front and rear bent portions of the right unit support member 36C, respectively. The support members are of the predetermined length to protrude downward from the respective bent portions.

Well, the cashbox top plate 15A of the cashbox housing 15A has an attachment hole, i.e. reject storage attachment hole, formed correspondingly to the reject storage transport unit 17A of the reject storage 17, FIG. 2. The hole may generally be rectangular and elongate in horizontal direction. The cashbox top plate 15A of the cashbox housing 15 has a plurality of attachment holes, i.e. repository attachment holes, formed correspondingly to the repository transport units 20A to 24A of the plurality of bill repositories 20 to 24. The holes may also be generally rectangular and elongate in horizontal direction.

The cashbox top plate 15A of the cashbox housing 15 has a left front insertion hole and a left rear insertion hole formed at its left front end and left rear end, respectively, as well as a right front insertion hole and a right rear insertion hole formed at its right front end right rear end, respectively.

In the linkage frame 36, the attaching member 36A has an attachment hole, i.e. reject storage attachment hole, formed correspondingly to the reject storage attachment hole of the cashbox top plate 15A. The reject storage attachment hole may be generally rectangular and horizontally elongate. The attaching member 36A of the linkage frame 36 also has a plurality of attachment holes, i.e. repository attachment holes, formed correspondingly to the repository attachment holes other than one rearmost repository attachment hole in the cashbox top plate 15A. Those repository attachment holes may also be of generally rectangular and horizontally elongate. Further, the attaching member 36A has one mounting depression, i.e. repository mounting depression, cut correspondingly to the rearmost repository attachment hole in the cashbox top plate 15A.

Thus, the linkage frame 36 is attached to the cashbox top plate 15A of the cashbox housing 15 so that, when the left front casing support member 36BX and left rear casing support member as well as the right front casing support member 36CX and right rear casing support member 36CY are inserted into the left front insertion hole and left rear insertion hole as well as the right front insertion hole and right rear insertion hole, respectively, the lower surface of the attaching member 36A may be brought into contact with the cashbox top plate 15A.

In this manner, the linkage unit 35 allows the reject storage attachment hole and repository attachment holes and the repository mounting depression of the linkage frame 36 to be opposed to the reject storage attachment hole and the repository attachment holes of the cashbox top plate 15A.

The linkage unit 35 inserts the front ends of the left front casing support member 36BX and left rear casing support member of the linkage frame 36, and the right front casing support member 36CX and right rear casing support member 36CY into the cashbox housing 15.

The linkage unit 35 thus has the plurality of bill transport units 39 to 44 each having a variety of transport path components such as a transport guide and a roller.

The linkage unit 35 has the bill transport units 39 to 44 attached to the linkage frame 36 such that each of them is inserted into corresponding one of the reject storage attachment hole and repository attachment holes of the cashbox top plate 15A by means of corresponding one of the reject storage attachment hole and repository attachment holes and the repository mounting depression.

The bill transport unit 39, when thus inserted into the reject storage attachment hole of the cashbox top plate 15A, constitutes a transport path, or one-way bill transport path, 39A, FIG. 2, by means of various transport path components for transporting a reject bill from the bill sorting and transport path 28A to the reject bill transport path 17AX in one direction.

The one-way bill transport path 39A has its upper end connected to the forefront one of a plurality of lower ends of the bill sorting and transport path 28A. The one-way bill transport path 39A has its lower end connected to the upper end of the reject bill transport path 17AX. In the context, the bill transport unit 39 that is provided in the linkage unit 35 and constitutes the one-way bill transport path 39A may be referred to as a one-way delivery transport unit.

The bill transport units 40 to 44 inserted into the repository attachment holes of the cashbox top plate 15A form transport paths, referred to as two-way bill transport paths, 40A to 44A, FIG. 2, by means of various transport path components for bidirectional transport such as to deliver bills from the bill sorting and transport path 28A to the associated stored-bill transport paths 20AX to 24AX, and deliver bills from the respective stored-bill transport paths 20AX to 24AX to the bill sorting and transport path 28A.

The two-way bill transport paths 40A to 44A have the upper ends thereof connected to the respective lower ends of the bill sorting and transport path 28A. The two-way bill transport paths 40A to 44A have the lower ends thereof connected to the respective upper ends of the stored-bill transport paths 20AX to 24AX. In the context, the bill transport units 40 to 44 that are provided in the linkage unit 35 and constitute the two-way bill transport paths 40A to 44A may also be referred to as two-way delivery transport units.

In the bill processing unit 11, rectangular bills may be transported over the front bill transport path 32A, the rear bill transport path 33A and the bill sorting and transport path 28A in a transport position such that the one short side thereof, for example, is on the left side of the paths and the other short side thereof is on the right side of the paths, namely, with the longitudinal direction of the bills substantially parallel to the teller machine horizontal direction, and the one long side thereof is oriented in the transport direction.

In the following description, the longitudinal direction of bills may be referred to as bill longitudinal direction, and the lateral direction of bills may be referred to as bill lateral direction.

Similarly, in the bill processing unit 11, rectangular bill are transported over the one-way bill transport path 39A, the two-way bill transport paths 40A to 44A, the reject bill transport path 17AX and the stored-bill transport paths 20AX to 24AX also in the transport position where the one long side thereof is oriented in the transport direction.

Thus, in the bill processing unit 11, the bill receiving and ejecting port 5, the bill validator 30, the temporary repository 31, the reject storage 17, and the plurality of bill repositories 20 to 24 handle bills in the transport position thereof such that the one short side thereof is on the left side of the paths and the other short side is on the right side of the paths, that is, with the bill longitudinal direction substantially parallel to the teller machine horizontal direction.

In operation of processing bills deposited, when the customer puts one or more bills for depositing into the bill receiving and ejecting port 5, the control unit 10 controls the bill receiving and ejecting port 5 to deliver the bills one by one over the front bill transport path 32A to the bill validator 30, which in turn determines the denominations and condition of the bills.

Then, under the control of the control unit 10, a bill that is determined to be normal by the bill validator 30 is transported from the bill validator 30 to the temporary repository 31 on the rear bill transport path 33A to temporarily held in the temporary repository 31 to reserve the depositing of the bill.

The control unit 10 causes the bill validator 30, when having determined a bill abnormal on the ground of breakage, damage or fold, to send it out as a reject bill to the bill receiving and ejecting port 5 on the rear bill transport path 33A, thereby allowing the bill receiving and ejecting port 5 to eject it for return so that the customer may take out it.

When the bill validator 30 has determined in that manner all bills for depositing that were put into the bill receiving and ejecting port 5, the control unit 10 presents the total sum of the bills determined to be normal, i.e. deposited amount of money, on the touch screen 4 to the customer.

When, in response, the customer confirms the deposited amount and manipulates the touch screen 4 to instruct the entry of the bills, the control unit 10 allows the bills temporarily held in the temporary repository 31 to be sent out one by one to the bill validator 30 over the rear bill transport path 33A, which in turn verifies again the denominations and condition of the bills.

Under the control of the control unit 10, bills that the bill validator 30 has determined normal and sent out therefrom are transferred to the bill repositories 20 to 24 according to the denominations of the bills sequentially over the front bill transport path 32A, the bill sorting and transport path 28A, and the two-waybill transport paths 40Ato 44A. Thus, the control unit 10 causes the bills to be transferred over the stored-bill transport paths 20AX to 24AX to ultimately be stored in appropriate ones of the bill repositories 20 to 24, respectively.

However, the control unit 10 causes a bill that the bill validator 30 has determined to be abnormal and sent out as a reject bill to be transported sequentially on the front bill transport path 32A, the bill sorting and transport path 28A and the one-way bill transport path 39A to the reject storage 17. Thus, the control unit 10 causes the reject bills to be transferred on the reject bill transport path 17AX to ultimately be stored in the reject storage 17.

In the bill processing unit 11, the control unit 10 can process the bill deposition in that fashion to conduct the customer to deposit bills as his or her desired transaction.

In the bill withdrawal processing, when the customer manipulates the touch screen 4 to designate a withdrawn amount of money, the control unit 10 controls the stored-bill transport paths 20AX to 24AX to take out bills for the amount designated by the customer one by one from the bill repositories 20 to 24.

The control unit 10 allows the bills sent out from the bill repositories 20 to 24 one by one to be transported sequentially on the two-way bill transport paths 40A to 44A, the bill sorting and transport path 28A and the front bill transport path 32A to the bill validator 30, which in turn verifies the denominations and condition of the bills.

The control unit 10 causes bills that the bill validator 30 has determined to be normal and sent out therefrom to be transferred to the bill receiving and ejecting port 5 on the rear bill transport path 33A.

However, at this time, the control unit 10 allows a bill that the bill validator 30 has determined to be abnormal and sent out therefrom as a reject bill to be delivered to the reject storage 17 sequentially over the rear bill transport path 33A, the bill sorting and transport path 28A and the one-way bill transport path 39A. The control unit 10 thus causes the reject bill to be transferred on the reject bill transport path 17AX to be stored in the reject storage 17 so as to prevent the reject bill from being used in the subsequent withdrawal processing.

When completing the transport of the bills for the amount designated for withdrawal to the bill receiving and ejecting port 5, the control unit 10 controls the bill receiving and ejecting port 5 to eject the bills for the amount designated for withdrawal for delivery to the customer.

In the bill processing unit 11, the control unit 10 can process the bill withdrawal in that manner to perform bill withdrawal as the customer desires in his or her transaction.

Well, the teller machine housing 2 has its front lower end, that is, below the front panel 3, provided with a generally rectangular door, or teller machine door, 2AX, FIG. 2, which is openable, or closable, in this case to the left, for example, by means of a hinge, not shown, provided at the left front end of the housing 2.

The cashbox housing 15 has its front end provided with a cashbox door formed of a relatively thick, rectangular metal plate 15B, which is openable, in this case to the left, for example, with a hinge, not shown, provided at the left front end of the housing 15. That is, in the cashbox housing 15, the metal plate that is the foremost one of the metal plates forming the cashbox housing 15 functions as the openable cashbox door 15B.

Figure 4:
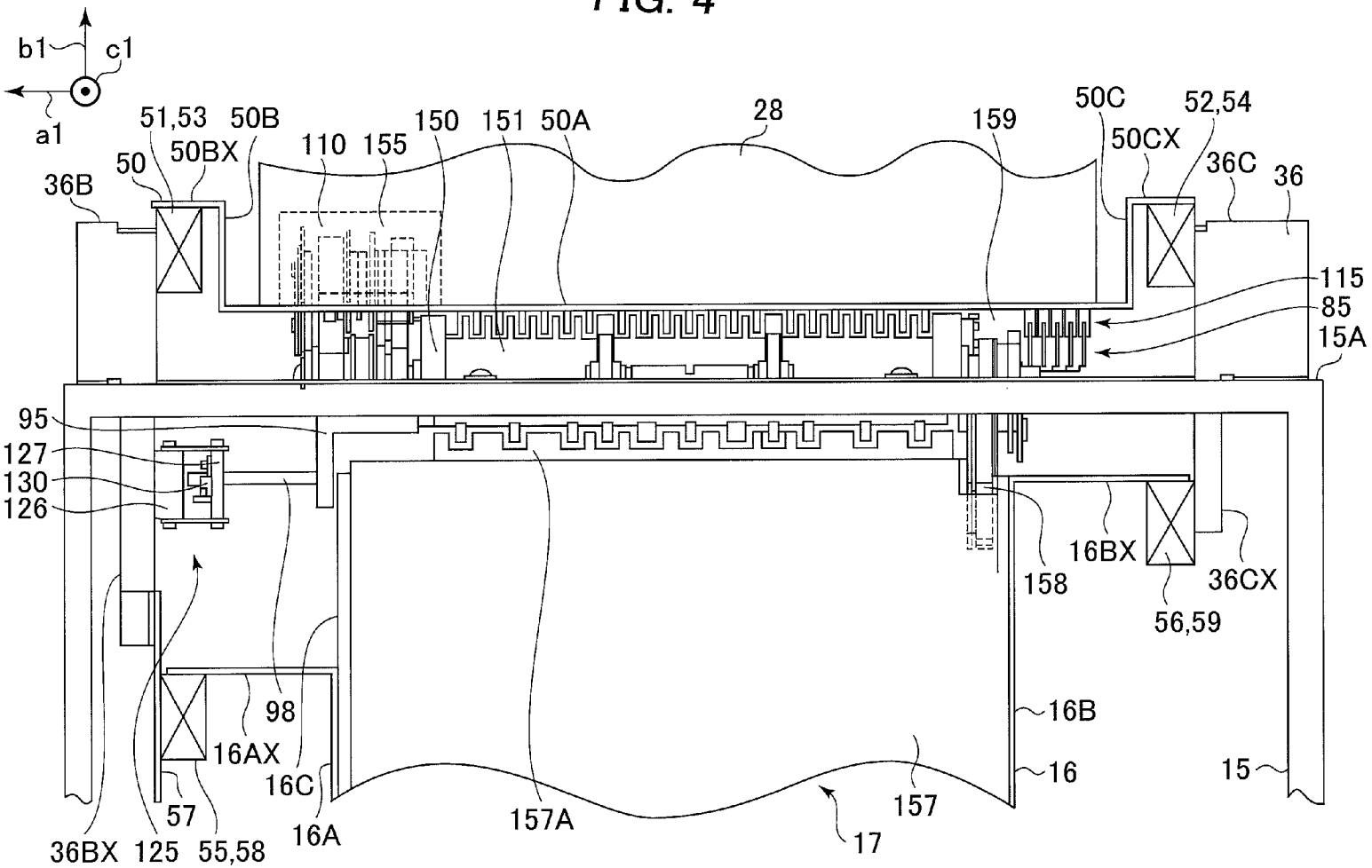
FIG. 4 is a partially cut-out, schematic front view of the linkage unit useful for understanding how to support the upper unit and the repository load casing of the illustrative embodiment.

As shown in FIG. 4, the upper unit 13 has a unit mounting member 50. The unit mounting member 50 is formedby a rectangular bottom section 50A longitudinally elongated, and a left side and a right side section 50B and 50C at the left and right ends of the bottom section 50A. The left and right side sections 50B and 50C are strip-like sections that extend vertically and are longitudinally elongate.

The unit mounting member 50 is provided at the upper end of the left side plate section 50B with a left rail mounting section 50BX which is a longitudinally elongate, strip-like section extending in the teller machine leftward direction, and at the upper end of the right side plate section 50C with a right rail mounting section 50CX which is a longitudinally elongate, strip-like section extending in the teller machine rightward direction.

In the upper unit 13, the sorting and transport unit 28 is mounted on the bottom plate section 50A of the unit mounting member 50, and the upper housing 27 is mounted on the sorting and transport unit 28.

In the unit mounting member 50, a left upper slide rail 51 is disposed on the lower surface of the left rail mounting section 50BX such that its longitudinal direction is substantially parallel to the teller machine fore-and-aft direction, and a right upper slide rail 52 is disposed on the lower surface of the right rail mounting section 50CX such that its longitudinal direction is substantially parallel to the teller machine fore-and-aft direction.

In the linkage frame 36 of the linkage unit 35, a left upper rail guide 53 is disposed near the upper end of the central portion of the left unit support member 36B such that its longitudinal direction is substantially parallel to the teller machine fore-and-aft direction, and a right upper rail guide 54 is disposed near the upper end of the central portion of the right unit support member 36C such that its longitudinal direction is substantially parallel to the teller machine fore-and-aft direction.

In the unit mounting member 50, the left upper slide rail 51 and the right upper slide rail 52 are engaged with the left upper rail guide 53 and the right upper rail guide 54 of the linkage frame 36, respectively. The linkage unit 35 thus supports the upper unit 13 slidably in the fore-and-aft direction via the left upper rail guide 53 and right upper rail guide 54 and the left upper slide rail 51 and right upper slide rail 52.

The repository load casing 16 has a left side plate 16A formed to be, for example, lower than its right side plate 16B, rear plate 16C and front plate, not shown. The right side plate 16B, the rear plate 16C and the front plate of the repository load casing 16 have the same height as each other, but are formed slightly lower than the reject storage 17 and the bill repositories 20 to 24.

In the repository load casing 16, the left side plate 16A has its upper end provided with a left rail mounting section 16AX which is longitudinally elongate, strip-like section projecting in the teller machine leftward direction, and the right side plate 16B has its upper end provided with a right rail mounting section 16BX which is also a longitudinally elongate, strip-like section projecting in the teller machine rightward direction.

In the repository load casing 16, a left lower slide rail 55 is disposed on the lower surface of the left rail mounting section 16AX with its longitudinal direction substantially parallel to the teller machine fore-and-aft direction, and a right lower slide rail 56 is disposed on the lower surface of the right rail mounting section 16BX with its longitudinal direction substantially parallel to the teller machine fore-and-aft direction.

In the linkage frame 36 of the linkage unit 35, a longitudinally elongate guide supporting plate 57 is attached to the right surfaces of the left front casing support member 36BX and the left rear casing support member. Further on the right surface of the guide supporting plate 57, a left lower rail guide 58 is disposed at a predetermined position with its longitudinal direction substantially parallel to the teller machine fore-and-aft direction.

Similarly, a right lower rail guide 59 is disposed on the surfaces, which face to the left, of the right front casing support member 36CX and the right rear casing support member 36CY with its longitudinal direction substantially parallel to the teller machine fore-and-aft direction.

In the repository load casing 16, the left lower slide rail 55 and the right lower slide rail 56 are engaged with the left lower rail guide 58 and the right lower rail guide 59 of the linkage frame 36, respectively. The linkage unit 35 thus supports the repository load casing 16 slidably in the fore-and-aft direction via the left lower rail guide 58 and the right lower rail guide 59 and the left lower slide rail 55 and right lower slide rail 56.

Figure 5:
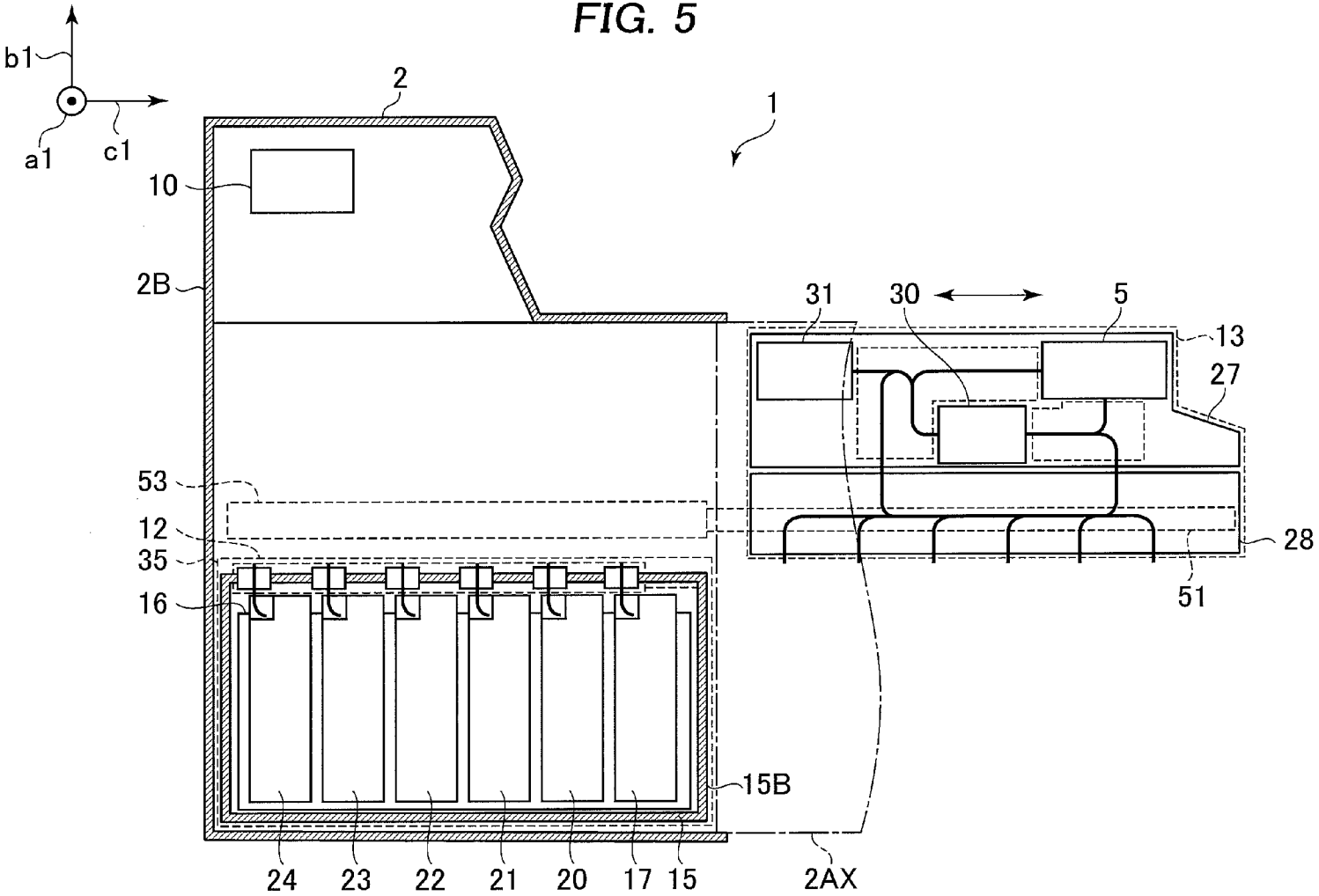
FIG. 5 is a schematic, cross-sectional side view useful for understanding how the upper unit is pulled out from and installed into the teller machine housing of the illustrative embodiment.

The structure of the teller machine housing 2 stated above thus allows, as shown in FIG. 5, the operator to open the teller machine door 2AX and pull out the upper unit 13 forward from the teller machine housing 2, and press and install the upper unit 13 into the teller machine housing 2. Thus, the teller machine housing 2 is so structured that the upper unit 13, and hence the devices and units in the upper housing 27 and the sorting and transport unit 28, may be serviced outside, i.e. in front of, the teller machine housing 2.

Figure 6:
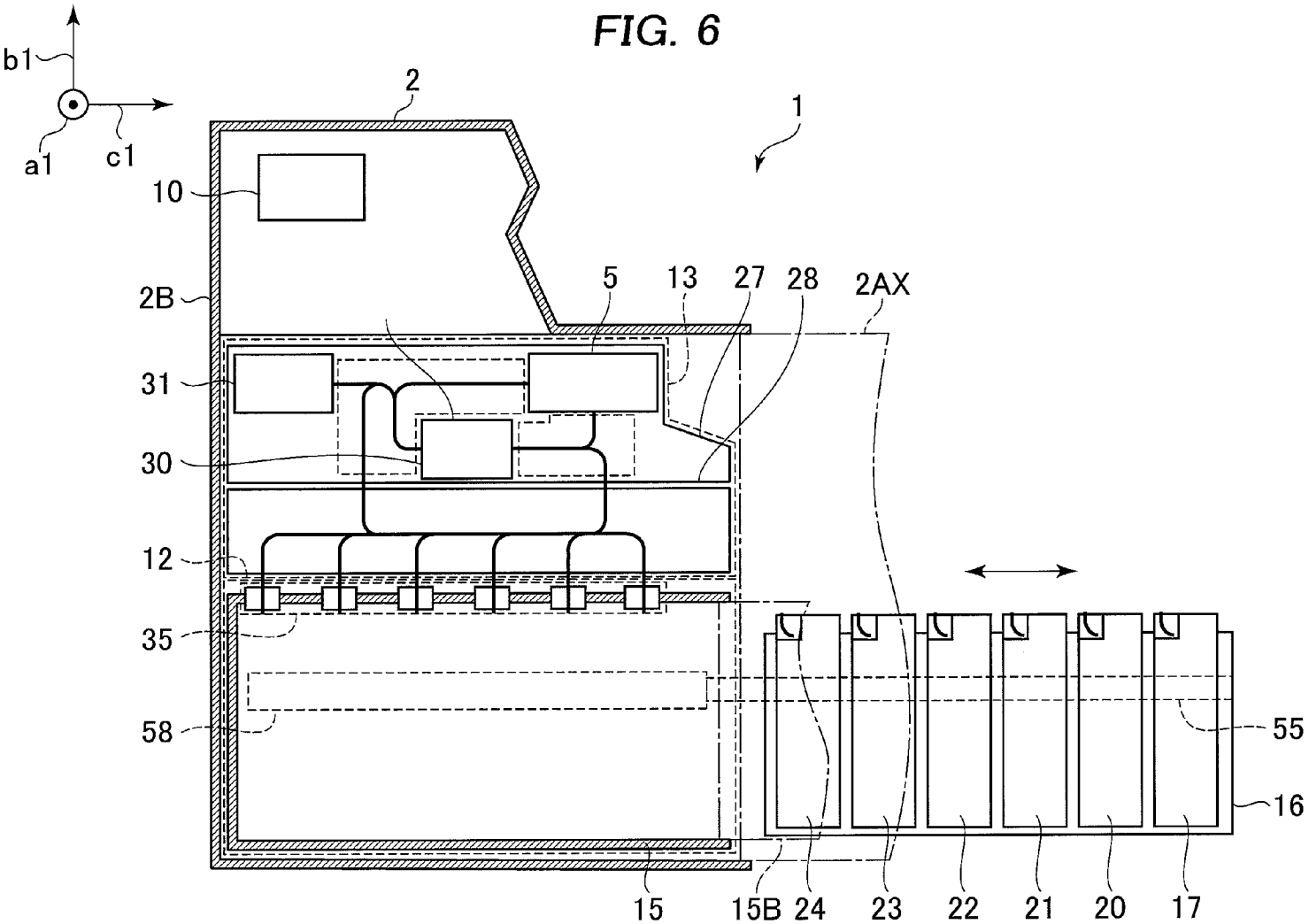
FIG. 6 is a schematic, cross-sectional front view useful for understanding how the repository load casing is pulled out from and installed into the cashbox housing of the illustrative embodiment.

With reference to FIG. 6, the teller machine housing 2 is structured such that the operator can open the teller machine door 2AX and further the cashbox door 15B, and then pull out the repository load casing 16 forward from the cashbox housing 15, and press and install the repository load casing 16 into the cashbox housing 15. Namely, the teller machine housing 2 is so structured that the reject storage 17 can be pulled out from the repository load casing 16 outside the cashbox housing 15, i.e. in front of the teller machine housing 2, to collect the reject bills stored therein, and load a vacant reject storage 17 into the repository load casing 16.

Similarly, the teller machine housing 2 structured as above allows the bill repositories 20 to 24, containing bills fewer than a predetermined number or empty, to be pulled out from the repository load casing 16 outside the cashbox housing 15, i.e. in front of the teller machine housing 2, and load the bill repositories 20 to 24 again, when refilled with sufficient bills, into the repository load casing 16.

In the linkage unit 35, the one-way delivery transport unit 39 and the two-way delivery transport units 40 to 44 have the respective transport path connecting sections thereof to the sorting and transport unit 28 protruding higher than the cashbox top plate 15A.

The bottom plate 50A of the unit mounting member 50 has holes correspondingly to a plurality of transport path connecting sections of the sorting and transport unit 28 to the one-way delivery transport unit 39 and the two-way delivery transport units 40 to 44. From those holes, the transport path connecting sections of the sorting and transport unit 28 protrude downward.

Thus, in the linkage unit 35, when the upper unit 13 is installed in the teller machine housing 2, the respective transport path connecting sections of the sorting and transport unit 28 are allowed to be positioned on the one-way delivery transport unit 39 and the two-way delivery transport units 40 to 44. Thus in the linkage unit 35, the upper end of the one-way bill transport path 39A and the upper ends of the two-way bill transport paths 40A to 44A can be connected to the respective lower ends of the bill sorting and transport path 28A.

When the upper unit 13 is pulled out of the teller machine housing 2, the sorting and transport unit 28 moves forward from above of the one-way delivery transport unit 39 and the two-way delivery transport units 40 to 44, respectively, thereby rendering disconnection of all the lower ends of the bill sorting and transport path 28A from the upper end of the one-way bill transport path 39A and the upper ends of the two-way bill transport paths 40A to 44A, respectively.

When the upper unit 13 is installed in the teller machine housing 2, the transport path connecting sections of the sorting and transport unit 28 are positioned again above the one-way delivery transport unit 39 and the two-way delivery transport units 40 to 44. That makes the upper end of the one-way bill transport path 39A and the upper ends of the two-way bill transport paths 40A to 44A reconnected to the respective lower ends of the bill sorting and transport path 28A.

Similarly, in the linkage unit 35, the one-way delivery transport unit 39 and the two-way delivery transport units 40 to 44 have the transport path connecting sections to the reject storage transport unit 17A and the repository transport units 20A to 24A protruding downward from the cashbox top plate 15A, that is, into the cashbox housing 15.

The repository load casing 16 is so adapted that the transport path connecting section to the one-way delivery transport unit 39 in the reject storage transport unit 17A protrudes upward from the upper ends of the right side plate 16B, the rear plate 16C and the front plate, together with the upper end of the loaded reject storage 17. Likewise, the transport path connecting sections to the two-way delivery transport units 40 to 44 in the repository transport units 20A to 24A protrude upward from the upper ends of the right side plate 16B, the rear plate 16C and the front plate, together with the upper ends of the loaded plurality of bill repositories 20 to 24.

Thus on the linkage unit 35, when the repository load casing 16 is installed in the cashbox housing 15, the transport path connecting section of the reject storage transport unit 17A and the transport path connecting sections of the repository transport units 20A to 24A are positioned below the one-way delivery transport unit 39 and the two-way delivery transport units 40 to 44, respectively. Thus in the linkage unit 35, the lower end of the one-way bill transport path 39A and the lower ends of the two-way bill transport paths 40A to 44A can be connected to the upper end of the reject bill transport path 17AX and the upper ends of the stored-bill transport paths 20AX to 24AX, respectively.

The repository load casing 16 is arranged such that, as described above, the right sideplate 16B and the rear plate 16C are set lower in height than the reject storage 17 and the bill repositories 20 to 24. Due to that structure, the repository load casing 16 can be pulled out of the cashbox housing 15 without catching the right side plate 16B and the rear plate 16C by the linkage unit 35.

When the repository load casing 16 is pulled out of the cashbox housing 15, the reject storage 17 and the bill repositories 20 to 24 move forward from under the one-way delivery transport unit 39 and the two-way delivery transport units 40 to 44, respectively, resulting in all the upper end of the reject bill transport path 17AX and the upper ends of the stored-bill transport paths 20AX to 24AX being separated from the lower end of the one-way bill transport path 39A and the lower ends of the two-way bill transport paths 40A to 44A, respectively.

When the repository load casing 16 is installed into the cashbox housing 15, the transport path connecting section of the reject storage transport unit 17A and the transport path connecting sections of the repository transport units 20A to 24A are positioned again under the one-way delivery transport unit 39 and the two-way delivery transport units 40 to 44, respectively. That makes the lower end of the one-way bill transport path 39A and the lower ends of the two-way bill transport paths 40A to 44A reconnected to the upper end of the reject bill transport path 17AX and the upper ends of the stored-bill transport paths 20AX to 24AX, respectively.

Well, the automatic teller machines 1 may be assembled in a factory such that the upper unit 13, the two-way delivery transport units 40 to 44, the one-way delivery transport unit 39 and the repository load casing 16 are positioned and assembled to connect the lower ends of the bill sorting and transport path 28A to the upper end of the reject bill transport path 17AX and the upper ends of the stored-bill transport paths 20AX to 24AX through the one-way bill transport path 39A and the two-way bill transport paths 40A to 44A, respectively, so as to be linear in the teller machine downward direction. Automatic teller machines 1 thus assembled in the factory will be installed and operated in domestic and foreign bank facilities and so on.

If the automatic teller machine 1 malfunctions, e.g. in the upper unit 13 or the repository load casing 16 during operation in an installation site, the local operator may replace the malfunctioning upper unit 13 or repository load casing 16 with new one at the installation site. The automatic teller machine 1, when having the malfunctioning upper unit 13 or repository load casing 16 replaced with new one, the renewed upper unit 13 or repository load casing 16 is adj usted in position afresh.

The automatic teller machine 1 is so arranged that, as described above, both the upper unit 13 and the repository load casing 16 are supported by the linkage frame 36 fixed to the cashbox top plate 15A of the cashbox housing 15. In the automatic teller machine 1, rail guides and slide rails arranged between the upper unit 13 and repository load casing 16, and the linkage frame 36, such as the left upper rail guide 53 and the left upper slide rail 51, are arranged with high accuracy.

Owing to that configuration, the automatic teller machine 1 may be tuned by the local operator so that, when the upper unit 13 or the repository load casing 16 is replaced at the installation site, the position of the upper unit 13, or the repository load casing 16 in the teller machine horizontal direction and the teller machine vertical direction can be adjusted with high accuracy.

However, the automatic teller machine 1 may somehow be difficult in adjusting the position of the upper unit 13 or the repository load casing 16 in the teller machine fore-and-aft direction because each of the one-way delivery transport unit 39 and the two-way delivery transport units 40 to 44 has to be satisfactorily adjusted in position, thus complicating the adjusting operation. For that reason, when the upper unit 13 or the repository load casing 16 is replaced at the installation site, there would be a possibility that the local operator cannot adjust the position of the upper unit 13 or the repository load casing 16 in the teller machine fore-and-aft direction with accuracy as sufficient as assembled in the factory, so that the automatic teller machine 1 may not sufficiently be tuned.

More specifically, the automatic teller machine 1 may encounter the situation that, when the local operator adjusts the position of the replaced upper unit 13 or repository load casing 16 in the teller machine fore-and-aft direction at the installation site, the adjusted position may be slightly displaced from the position at assembling in the teller machine fore-and-aft direction. For example, when the automatic teller machine 1 is installed on a slightly inclined floor in a bank branch, the position of the upper unit 13 or the repository load casing 16 may be displaced from the position at assembling in the teller machine fore-and-aft direction.

In that case, the local operator can adjust again the position of the upper unit 13 or the repository load casing 16 in the teller machine fore-and-aft direction in the automatic teller machine 1 at the installation site. However, the automatic teller machine 1 may be subject to the situation that, as in the above-mentioned servicing, the adjusted position of the upper unit 13 or repository load casing 16 may be slightly displaced in the teller machine fore-and-aft direction from the position at assembling.

Against such a situation, the automatic teller machine 1 is configured such that, even when the position of the upper unit 13 or the repository load casing 16 is slightly displaced from the position at assembling in the teller machine fore-and-aft direction, the one-way delivery transport unit 39 and the two-way delivery transport units 40 to 44 of the linkage unit 35 are able to bring the one-way bill transport path 39A and the two-way bill transport paths 40A to 44A into respective connections with the lower ends of the bill sorting and transport path 28A, the upper end of the reject bill transport path 17AX, and the upper ends of the stored-bill transport paths 20AX to 24AX.

Next, the structure of the linkage unit 35 will be described. As described above with reference to FIGS. 3 and 4, in the linkage unit 35, the one-way delivery transport unit 39 and the two-way delivery transport units 40 to 44 are mounted on the linkage frame 36 in this order in the teller machine rear direction. In the illustrative embodiment, the two-way delivery transport units 40 to 44 may be configured basically the same as each other. However, the forefront two-way delivery transport unit 40 and the rearmost two-way delivery transport unit 44 among the two-way delivery transport units 40 to 44 may differently be configured in some components void of the remaining two-way delivery transport units 41 to 43. Therefore, in terms of the structure of the two-way delivery transport units 40 to 44, for example, the second two-way delivery transport unit 41 from the front will be specifically described. The remaining two-way delivery transport units 40 and 42 to 44 will be described only on the differences in structure from the second two-way delivery transport unit 41 from the front.

Figure 7:
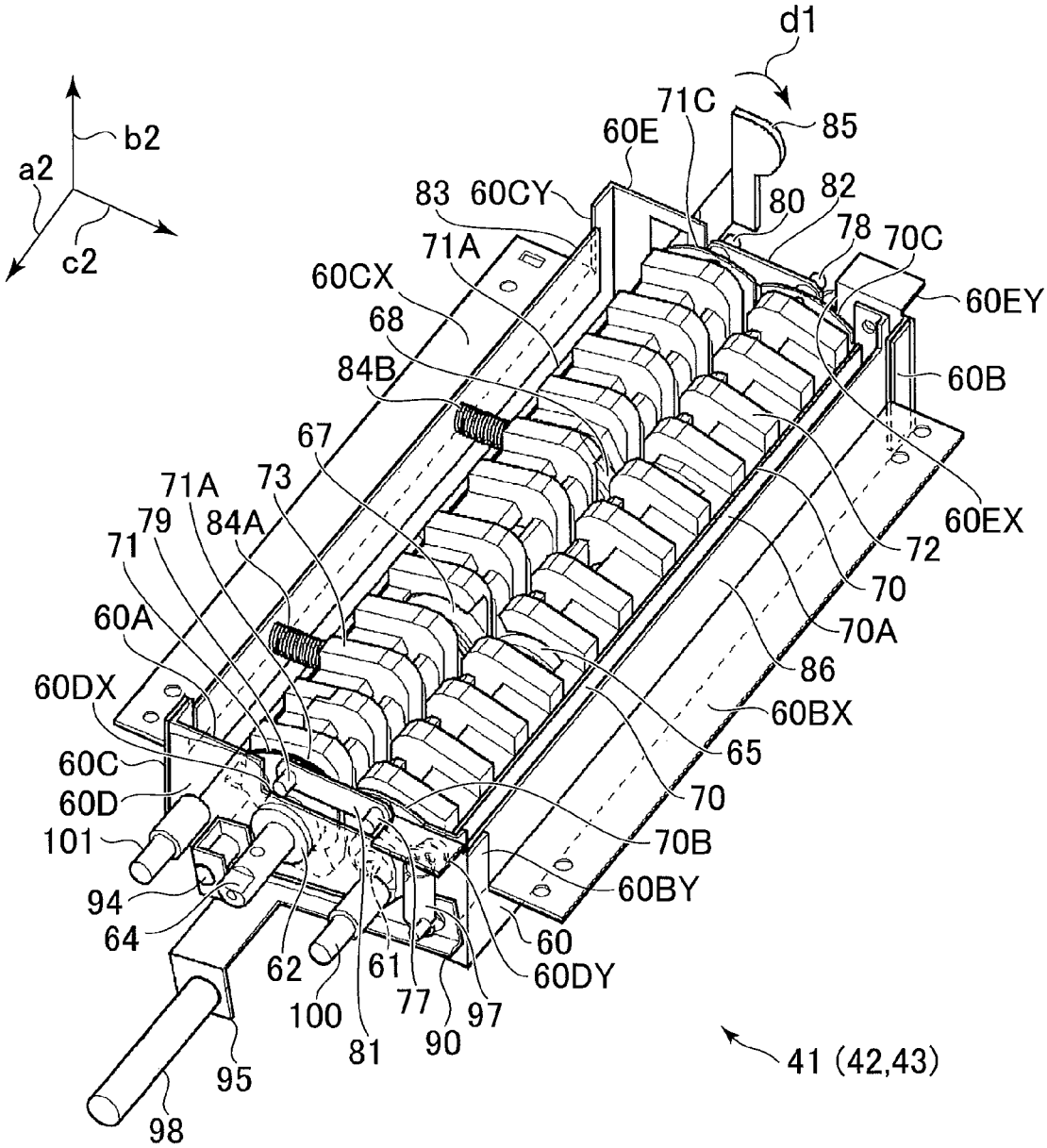
FIGS. 7 and 8 are schematic perspective views showing the structures of the two-way delivery transport unit of the illustrative embodiment.
Figure 8:
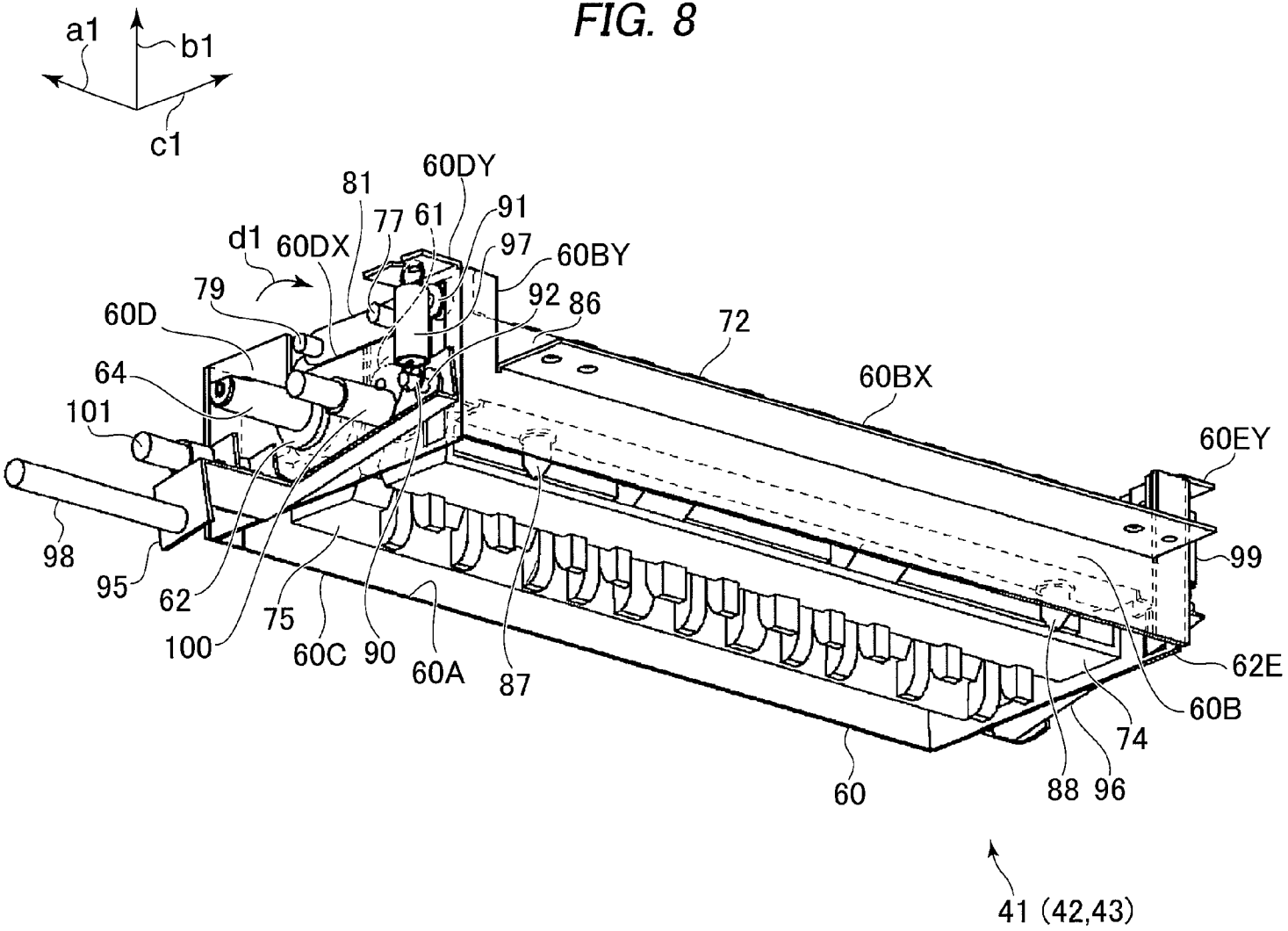
Figure 9:
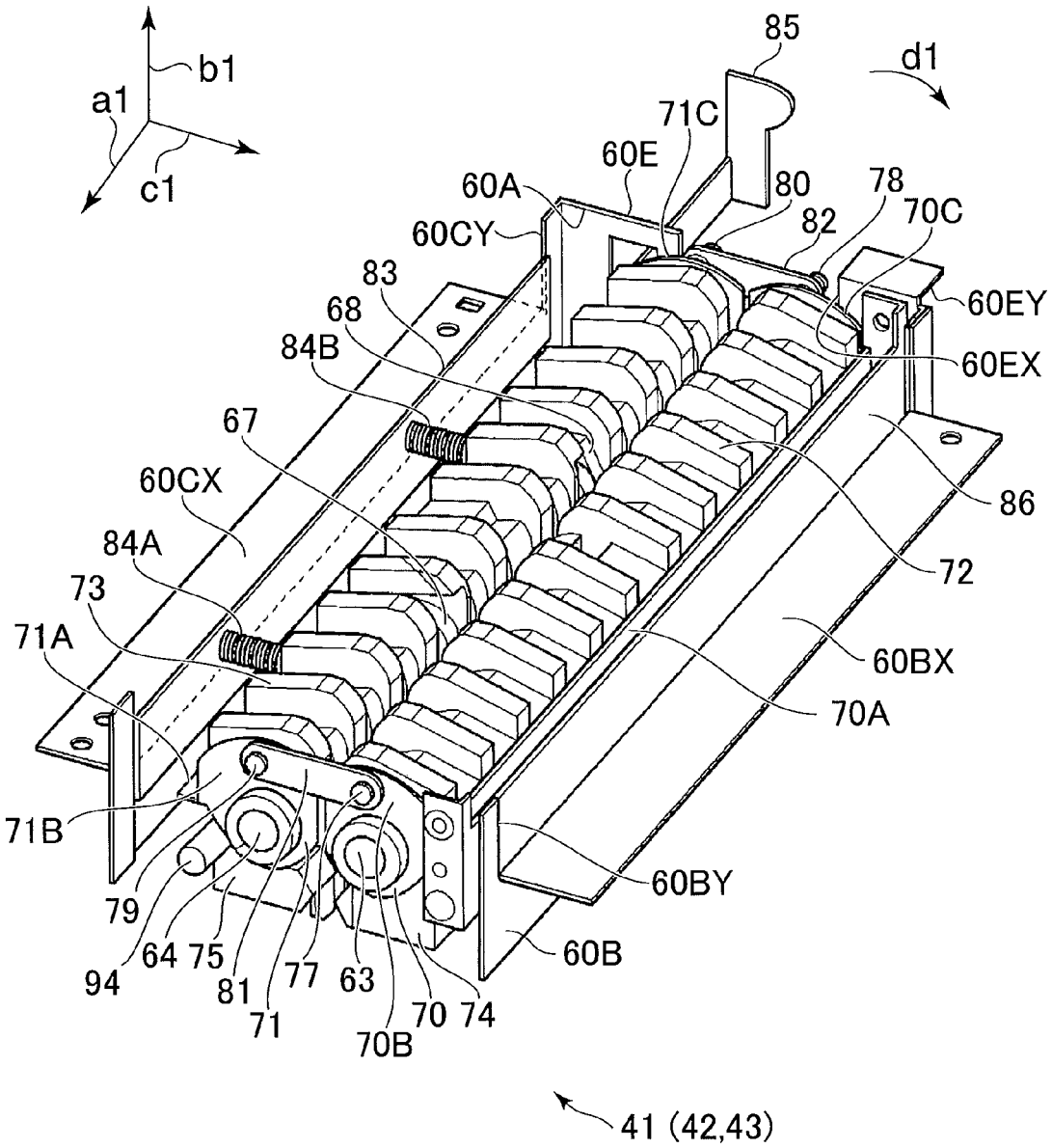
FIG. 9 is a schematic perspective view showing the structure of transport guides of the two-way delivery transport unit.

With reference to FIGS. 7, 8 and 9, the second two-way delivery transport unit 41 from the front is provided with a transport unit frame 60 comprising a pair of metal sheets combined with each other, which has a generally L-shaped lateral cross section and is almost the same in shape to form a horizontally elongate rectangular frame 60A.

The transport unit frame 60 has its front plate 60B and rear plate 60C each extending over a predetermined length that is substantially longer than the long side of bills, and its left side plate 60D and right side plate 60E each extending over a predetermined length that is substantially shorter than the lengths of the front plate 60B and rear plate 60C.

The front plate 60B of the transport unit frame 60 has a front mounting section 60BX formed, which protrudes forward from the front plate 60B. The front mounting section 60BX may be formed by cutting notches at the front and rear portions of the plate 60B and bending the central upper end portion, i.e. the central upper half, portion of the front plate 60B at right angle toward the teller machine front direction. The front plate 60B also has a front concave section 60BY formed at that central, upper portion.

Similarly, the rear plate 60C of the transport unit frame 60 has a rear mounting section 60CX formed, which protrudes rearward from the rear plate 60C. The rear mounting section 60CX may be formed by cutting notches at the front and rear portions of the plate 60C and bending the central, upper end portion, i.e. the central, upper half, portion of the rear plate 60C at right angle toward the teller machine rear direction. The rear plate 60C also has a rear concave section 60CY formed at the central, upper portion.

In the transport unit frame 60, the front concave section 60BY of the front plate 60B and the rear concave section 60CY of the rear plate 600 each have a predetermined length, that is, length in the teller machine horizontal direction, that is substantially equal to or longer than the long side of bills.

The left side plate 60D and the right side plate 60E of the transport unit frame 60 have a left front bearing 61 and a right front bearing, not shown, respectively, provided in pair at mutually opposing positions forward than the center of the inner surfaces, i.e. opposing surfaces, of the plates.

Correspondingly, the left side plate 60D and the right side plate 60E of the transport unit frame 60 have bearing holes formed at opposing positions backward than the center of the inner surfaces of the plates, and a left rear bearing 62 and a right rear bearing, not shown, are inserted in pair into the respective bearing holes.

Thus, the transport unit frame 60 is configured such that the central holes of the left front bearing 61 and right front bearing receive and support in pair the one and other ends of a front roller shaft 63, respectively, and the front roller shaft 63 is rendered substantially parallel to the teller machine horizontal direction. The transport unit frame 60 supports the front roller shaft 63 by means of the left front bearing 61 and right front bearing rotatably in combination in one rotational direction represented by an arrow d1 and in the other rotational direction reverse thereto.

Similarly, the central holes of the left rear bearing 62 and right rear bearing receive and support in pair the one end and other ends of a rear roller shaft 64, respectively, and the rear roller shaft 64 is rendered substantially parallel to the teller machine horizontal direction. The transport unit frame 60 supports the rear roller shaft 64 by means of the left rear bearing 62 and right rear bearing rotatably in combination in the one and opposite rotational directions.

The front roller shaft 63 has a pair of front rollers, of which one 65 is shown and the other not shown, and which are attached on the left and right sides at positions away at equidistance from the center between the left side plate 60D and the right side plate 60E of the transport unit frame 60.

Correspondingly, the rear roller shaft 64 has a pair of rear rollers 67 and 68 attached at positions opposing the pair of front rollers 65 attached to the front roller shaft 63, so that the pair of rear rollers 67 and 68 are pressed at part of the circumferential side surfaces thereof against part of the circumferential side surfaces of the pair of front rollers 65.

The transport unit frame 60 includes a front guide holding member 70 and a rear guide holding member 71 in pair, which are of generally C shape plan view and horizontally elongate.

The front guide holding member 70 has a generally strip-like back plate section 70A on its front side, and a left plate section 70B and a right plate section 70C that protrude from the left and right ends of the back plate section 70A, respectively. By means of the left and right sections 70B and 70C, the holding member 70 is attached to the left front bearing 61 and right front bearing in pair rotatably in the one and other rotational directions freely of the rotation of the front roller shaft 63.

More specifically, the transport unit frame 60 supports the front guide holding member 70 by the left front bearing 61 and right front bearing in pair such that the front guide holding member 70 can rotate about the front roller shaft 63 in the one and other rotational directions independently of the rotation of the front roller shaft 63.

Similarly, the rear guide holding member 71 has a generally angled back plate section 71A, and a planer left plate section 71B and a right plate section 71C that protrude from the left and right ends of the back plate section 71A, respectively. By means of the left and right sections 71A and 71B, the holding member 71 is attached to the left rear bearing 62 and right rear bearing in pair rotatably in the one and other rotational directions freely of the rotation of the rear roller shaft 64.

More specifically, the transport unit frame 60 supports the rear guide holding member 71 by the left rear bearing 62 and right rear bearing in pair so as to be rotatable about the rear roller shaft 64 in the one and other rotational directions independently of the rotation of the rear roller shaft 64.

The front guide holding member 70 includes transport guides 72 attached thereto, which have a predetermined length longer than the long side of bills and a generally J-like cross section. Each of the transport guides 72 has its bottom end located backward than the front roller shaft 63 and substantially parallel to the back plate section 70A of the front guide holding member 70. Each transport guide 71 has its front end located diagonally upward in front of the bottom end and above the bottom edge of the front concave section 60BY.

Thus, the transport unit frame 60 supports, in cooperative with the front guide holding member 70, the transport guide 72 held by, i.e. attached to, the front guide holding member 70 such that the transport guide 72 is rotatable in the one and reverse rotational directions. In the context, the transport guide 72 that is held by the front guide holding member 70 and rotates integrally with the front guide holding member 70 may be referred to as front movable guide.

The front movable guide 72 has its bottom end whose one surface has its lower edge formed in the shape of arc gradually inclined diagonally downward in front. The front end and the one surface of the bottom end of the front movable guide 72 are generally formed in the shape of comb in the teller machine leftward direction.

The rear guide holding member 71 has transport guides 73 attached to, which have the length thereof substantially equal to that of the front movable guide 72 and a generally J-like cross section. Each of the transport guides 73 has its bottom end located forward the rear roller shaft 64 and substantially parallel to the back plate section 71A of the rear guide holding member 71. Each transport guide 73 has its front end located diagonally upward behind the bottom end and above the bottom edge of the rear concave section 60CY.

The transport unit frame 60 thus supports, in cooperative with the rear guide holding member 71, the transport guide 73 held by, or attached to, the rear guide holding member 71 such that the rear guide holding member 71 can rotate in the one and opposite rotational direction. In the context, the transport guide 73 that is held by the rear guide holding member 71 and rotates integrally with the rear guide holding member 71 may be referred to as rear movable guide.

The rear movable guide 73 has its bottom end whose one surface has its lower edge formed in the shape of arc gradually inclined diagonally downward in the rear. The front end and the one surface of the bottom end of the rear movable guide 73 are generally formed in the shape of comb in the teller machine leftward direction.

To the left front bearing 61 and right front bearing of the transport unit frame 60 in pair, a transport guide 74, FIG. 9, is fixed, which has a predetermined length that is longer than the long side of bills and a generally T-like cross section. The transport guide 74 has its arm whose one flat surface is vertically oriented diagonally downward toward the rear of the front roller shaft, and its body located in front of the arm. In the context, the transport guide 74 fixed to the left front bearing 61 and right front bearing of the transport unit frame 60 in pair may referred to as front fixed guide.

In the front fixed guide 74, the arm has its one surface whose upper edge is formed in the shape of arc gradually inclining diagonally upward in front, and whose lower edge is formed in the shape of arc gradually inclining diagonally downward in front.

The one surface of the arm of the front fixed guide 74 is formed in the shape of comb in the teller machine leftward direction. The arm has its upper end engaged with the bottom end of the front movable guide 72, and its lower end protruding from the frame 60A of the transport unit frame 60.

To the left rear bearing 62 and right rear bearing of the transport unit frame 60 in pair, fixed is a transport guide 75, which has its length substantially equal to the front fixed guide 74 and a generally T-like cross section. The transport guide 75 has its one flat surface, which is vertically oriented as opposed to one surface of the arm of the front fixed guide 74 and diagonally downward in front of the rear roller shaft 64, that is, oriented to the front. the transport guide 75 has its body located behind the body. In the context, the transport guide 75 fixed to the left rear bearing 62 and right rear bearing of the transport unit frame 60 in pair may be referred to as rear fixed guide.

The transport unit frame 60 has the front fixed guide 74 and the rear fixed guide 75 fixed thereto with the one surface of the arms being in parallel to each other with a predetermined spacing, e.g. about 5 [mm].

In the rear fixed guide 75, the arm has its one surface whose upper edge is formed in the shape of arc gradually inclined diagonally upward and backward, and whose lower edge is formed in the shape of arc gradually inclined diagonally downward and backward.

In the rear fixed guide 75, the entire one surface of the arm is formed in the shape of a comb in the teller machine leftward direction. The arm has its upper end engaged with the bottom end of the rear movable guide 73, and its lower end protruding downward from the frame 60A of the transport unit frame 60.

In this manner, the front fixed guide 74 is fixed to the transport unit frame 60 such that, when the front movable guide 72 is oriented with the flat portion of the one surface of the bottom end vertical, that flat portion of the one surface of the bottom end of the front movable guide 72 is flush with the flat portion of the one surface of the arm of the front fixed guide 74. The rear fixed guide 75 is fixed to the transport unit frame 60 such that, when the rear movable guide 73 is oriented with the flat portion of the one surface of the bottom end vertical, that flat portion of the one surface of the bottom end of the rear movable guide 73 is flush with the flat portion of the one surface of the arm of the rear fixed guide 75.

In the front movable guide 72, the front end and the entire one surface of the bottom end have holes cut correspondingly in position to the pair of front rollers 65. In the front fixed guide 74, the arm and the body have notches cut correspondingly in position to the pair of front rollers 65.

The front movable guide 72 and the front fixed guide 74 thus structured allow rear portions of the circumferential side surfaces of the pair of front rollers 65 to protrude rearward beyond the one surfaces of the bottom end of the front movable guide 72 and the arm of the front fixed guide 74 through the respective holes and notches.

In the rear movable guide 73, the front end and the entire one surface of the front end have holes formed correspondingly in position to the pair of rear rollers 67 and 68. In the rear fixed guide 75, the arm and the body have notches formed correspondingly in position to the pair of rear rollers 67 and 68.

The rear movable guide 73 and the rear fixed guide 75 thus allow the rear portions of the circumferential side surfaces of the pair of rear rollers 67 and 68 to protrude forward from the one surfaces of the bottom end of the rear movable guide 73 and the arm of the rear fixed guide 75 through the respective holes and notches.

Further in the transport unit frame 60, the left side plate 60D and the right side plate 60E have a left depression 60DX and a right depression 60EX formed into a predetermined depth at the central portion of the upper ends of the frame 60, respectively.

In the front guide holding member 70, the left plate section 70B has its outer surface in which a cylindrical left front coupling pin 77 is fitted at a position of the edge that is located immediately above the front roller shaft 63 when the flat portion of the one surface of the bottom end of the front movable guide 72 is vertically oriented, that is, substantially in parallel to the teller machine vertical direction.

The right plate section 70C of the front guide holding member 70 has its outer surface in which a right front coupling pin 78 is fitted at a position of the edge that is located immediately above the front roller shaft 63 when the flat portion of the one surface of the bottom end of the front movable guide 72 is vertically oriented, that is, substantially in parallel to the teller machine vertical direction.

In the rear guide holding member 71, the left plate section 71B has its outer surface in which a cylindrical left rear coupling pin 79 is fitted at a position of the edge that is located immediately above the rear roller shaft 64 when the flat portion of the one surface of the bottom end of the rear movable guide 73 is vertically oriented, that is, substantially in parallel to the teller machine vertical direction.

The right plate section 71C of the rear guide holding member 71 has its outer surface in which a cylindrical right rear coupling pin 80 is fitted at a position of the edge that is located immediately above the rear roller shaft 64 when the flat portion of the one surface of the bottom end of the rear movable guide 73 is vertically oriented, that is, substantially in parallel to the teller machine vertical direction.

The left front coupling pin 77 of the front guide holding member 70 and the left rear coupling pin 79 of the rear guide holding member 71 are inserted into holes formed in the one and other ends of a generally strip-like left coupling plate 81. Correspondingly, the right front coupling pin 78 of the front guide holding member 70 and the right rear coupling pin 80 of the rear guide holding member 71 are inserted into holes formed in the one and other ends of a generally strip-like right coupling plate 82. The front guide holding member 70 and the rear guide holding member 71 are thus coupled to each other via the left and right coupling plates 81 and 82.

It is to be noted that the left coupling plate 81 and the right coupling plate 82 each have a predetermined length that is slightly longer than a distance between the centers of the front roller shaft 63 and the rear roller shaft 64, and that a distance between the centers of the holes at the one and other ends is substantially equal to the distance between the centers of the front and rear roller shafts 63 and 64.

Accordingly, the left coupling plate 81 and the right coupling plate 82 are coupled to each other by the front guide holding member 70 and the rear guide holding member 71 with the bottom ends of the front movable guide 72 and the rear movable guide 73 substantially in parallel to each other. That is to say, the left coupling plate 81 and the right coupling plate 82 couple the front movable guide 72 and the rear movable guide 73 to each other such that their bottom ends are substantially parallel to each other with the spacing substantially equal to the spacing between the arms of the front and rear fixed guides 74 and 75.

Figure 10A:
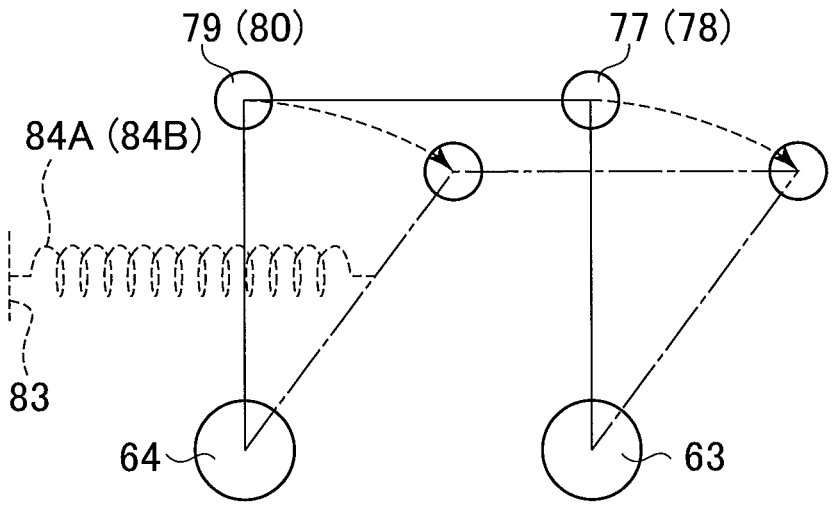
FIGS. 10A and 10B are conceptual side views of part of the transport unit useful for understanding rotation of the front and rear movable guides of the illustrative embodiment.
Figure 10B:
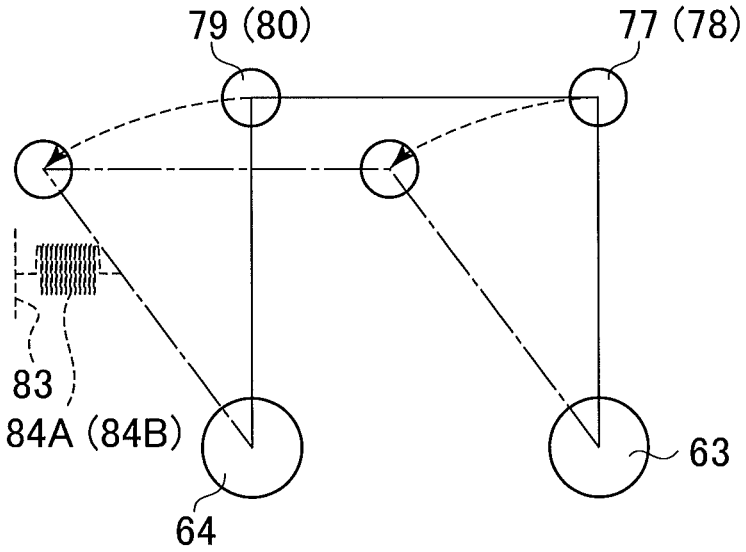

Thus, as seen from FIGS. 10A and 10B, the front movable guide 72 and the rear movable guide 73 function as, in cooperative with the left coupling plate 81 and the right coupling plate 82, a parallel link rotating about the front roller shaft 63 and the rear roller shaft 64, respectively.

Thus, due to the coupling by the left and right coupling plates 81 and 82, the front movable guide 72 and the rear movable guide 73 can rotate about the front roller shaft 63 and the rear roller shaft 64 in the one and opposite rotational directions with their bottom ends substantially in parallel to each other with the spacing substantially equal to the spacing between the arms of the front fixed guide 74 and the rear fixed guide 75.

In the two-way delivery transport unit 41, the front movable guide 72 and rear movable guide 73 and the front fixed guide 74 and rear fixed guide 75, and the pair of front rollers 65 and the pair of rear rollers 67 and 68 form the two-way bill transport path 41A for transporting bills via the pair of front rollers 65 and the pair of rear rollers 67 and 68 between the front movable guide 72 and the rear movable guide 73 and between the front fixed guide 74 and the rear fixed guide 75.

In other words, the two-way delivery transport unit 41 forms the two-way bill transport path 41A between the front movable guide 72 and the rear movable guide 73 and between the front fixed guide 74 and the rear fixed guide 75. Further, the bill transport path 41A has its transverse cross-sectional width substantially equal to the length of the front movable guide 72 and the rear movable guide 73, or the front fixed guide 74 and the rear fixed guide 75, in the teller machine horizontal direction, and its transverse cross-sectional depth substantially equal to the spacing between the guides 72 and 73, or 74 and 75.

Additionally in the two-way delivery transport unit 41, the lower edges of the one surfaces of the bottom ends of the front movable guide 72 and the rear movable guide 73 are formed in the shape of arc such as to gradually space away from each other, as described above. Also, the upper ends of the arms of the front fixed guide 74 and the rear fixed guide 75 are formed in the shape of arc such as to gradually space away from each other.

Under the circumstances of arcuate structure in the two-way delivery transport unit 41, the bottom ends of the front movable guide 72 and the rear movable guide 73 may be engaged with the comb-like portions of the arms of the front fixed guide 74 and the rear fixed guide 75.

Further in the two-way delivery transport unit 41, the front movable guide 72 and the rear movable guide 73 are rotatable with the guides rendered substantially in parallel to each other with the spacing substantially equal to the spacing between the front fixed guide 74 and the rear fixed guide 75.

Thus, when the front movable guide 72 and the rear movable guide 73 are inclined forward or rearward from the vertical position, the two-way delivery transport unit 41 can prevent their bottom sections and arms from protruding into the two-way bill transport path 41A at the engaged portions of the front and rear movable guides 72 and 73 and the front and rear fixed guides 74 and 75.

Now, the transport unit frame 60 has a horizontally elongate strip-like, spring-fitting plate 83 attached to, for example, the inner surface of the rear plate 60C. The plate 83 has its upper end slightly protruding from the edge of the rear concave section 60CY, specifically, such that the upper end is located above the edge of the rear concave section 60CY and below the front ends of the front and rear movable guides 72 and 73.

The transport unit frame 60 includes a spring-fitting plate 84 having its front surface on which, for example, one ends of a pair of springs 84A and 84B such as compression coil springs or torsion springs are fitted at predetermined positions above the rear roller shaft 64, and the other ends of the springs 84A and 84B are fitted at predetermined positions of the back plate section 71A of the rear guide holding member 71, that is, above the rear roller shaft 64. The transport unit frame 60 is thereby so structured that the springs 84A and 84B press the rear guide holding member 71 at the predetermined positions forward above the rear roller shaft 64.

The rear guide holding member 71 is thus biased by the springs 84A and 84B to be rotatable about the rear roller shaft 64 in the one rotational direction, and in turn to rotate the front guide holding member 70, linked to the rear guide holding member 71, about the front roller shaft 63 also in the one rotational direction.

When the upper unit 13 is pulled out of the teller machine housing 2 as described later, the front guide holding member 70 rotates together with the rear guide holding member 71 in the one rotational direction by the effect of biasing forces of the springs 84A and 84B to incline the front movable guide 72 and the rear movable guide 73 forward from its vertical position.

The transport unit frame 60 has a right side plate 60E whose rear end, for example, has a lever receiving hole. The back plate section 71A of the rear guide holding member 71 has a rotation control lever 85 attached thereto, which is adapted for rotating the rear guide holding member 71 according to the position, corresponding to the two-way delivery transport unit 41, of the transport path connecting section of the sorting and transport unit 28.

In this case, the rotation control lever 85 has has a strip-like arm having a predetermined length, of which the bottom end is bonded to the back plate section 71A of the rear guide holding member 71 and the front end is inserted into the lever receiving hole of the right side plate 60E of the transport unit frame 60 to protrude to the right.

The rotation control lever 85 is provided with a generally L-shape receiving section rising from the front end of the arm, and the receiving protrusion is oriented to the front. The shape and size of the receiving section of the rotation control lever 85 may appropriately be selected.

The rotation control lever 85 is thus attached to the rear guide holding member 71 such that, for example, the front end of the receiving protrusion is substantially flush with a virtual plane that is perpendicular to the direction of, and is located at the center of, the transverse cross-sectional depth of the transport path formed by the front and rear movable guides 72 and 73 the transport path cross-sectional depth of the front and rear movable guides 72 and 73.

The transport unit frame 60 has a horizontally elongate pin holder 86. The pin holder 86 has a generally C-shaped body section and a strip-like pin attachment section protruding rearward from the lower end of the body section.

The pin holder 86 has cylindrical left and right positioning pins 87 and 88 mounted at predetermined left and right positions, respectively, on the lower surface of the pin attachment section and protruding downward. In this case, the left positioning pin 87 and the right positioning pin 88 each have the front ends thereof tapered so as to be smaller in diameter toward the front end.

At the left and right ends of the pin attachment section of the pin holder 86, there are provided strip-like left and right shaft attachment plates that protrude rearward, respectively.

The pin holder 86 has its left shaft mounting section provided with two, left upper guide shaft, not shown, and left lower guide shaft 90 of the same diameter on the outer surface thereof with a predetermined spacing in the teller machine downward direction. Likewise, the pin holder 86 has its right shaft mounting section provided with also two, right and right lower guide shafts, both not shown, of the same diameter on the outer surface thereof with a predetermined spacing in the teller machine downward direction.

Further, the left side plate 60D and the right side plate 60E of the transport unit frame 60 have the respective front ends thereof provided with a vertically elongate left and right elevating guide holes opposing each other.

Thus, the pin holder 86 is configured such that, when the pin attachment section is interposed between the front guide holding member 70 and the front plate 60B of the transport unit frame 60, the left upper guide shaft and the left lower guide shaft 90 are inserted into the left elevating guide hole of the left sideplate 60D and protrude to the left while the right and right lower guide shafts are inserted into the right elevating guide hole of the right side plate 60E to protrude to the right.

Under that circumstances, to the left upper guide shaft and the left lower guide shaft 90 of the pin holder 86, attached are guide rollers 91 and 92 of the same diameter, respectively, rotatably about the left and left lower guide shafts 90 to be engaged with the left elevating guide hole of the left side plate 60D of the transport unit frame 60.

In the pin holder 86, to the right upper and lower guide shafts, guide rollers, not shown, are attached rotatably about the right upper and lower guide shafts to be engaged with the right elevating guide hole of the right side plate 60E of the transport unit frame 60.

Due to that structure, the transport unit frame 60 can hold the pin holder 86 to be vertically movable, and move the pin holder 86 downward to cause the left positioning pin 87 and the right positioning pin 88 to protrude below the frame 60A, or upward to cause the left positioning pin 87 and the right positioning pin 88 to be stored in the frame 60A.

It is to be noted that the height of the body of the pin holder 86 is appropriately selected such that, when the pin holder has moved upward to store the left positioning pin 87 and the right positioning pin 88 in the frame 60A of the transport unit frame 60, the body does not protrude over the bottom edge of the front concave section 60BY of the transport unit frame 60.

On the outer surfaces of the left side plate 60D and the right side plate 60E of the transport unit frame 60, left and right shaft-receiving holes are formed diagonally downward behind the left rear bearing 62 and right rear bearing in pair, respectively, so as to oppose each other. Into the left shaft-receiving hole of the left side plate 60D and the right shaft-receiving hole of the right side plate 60E, a lever rotational shaft 94 is inserted thereacross.

The transport unit frame 60 is thus structured so that the lever rotational shaft 94 has its one end protruding from the left shaft-receiving hole to the left and its opposite end protruding from the right shaft-receiving hole to the right, and the lever rotational shaft 94 is supported by the left and right shaft-receiving holes such that the lever rotational shaft 94 is rotatable in the one and other rotational directions.

The transport unit frame 60 has an angled left lifting control lever 95 and an angled right lifting control lever 96 in pair for controlling the upward and downward movement of the left positioning pin 87 and the right positioning pin 88 in cooperative with the pin holder 86. In this case, the left lifting control lever 95 is provided with a generally C-shaped and planer housing-mounting section, and a generally L-shaped and planer linkage section protruding from the lower end of the housing-mounting section to the left. The left lifting control lever 95 is provided with a generally C-shape shaft support at the rear end of the housing-mounting section, which is folded toward the left and the front.

The left and right plates of the shaft support of the left lifting control lever 95 have respective shaft locking holes formed in pair to oppose each other. Into the pair of shaft locking holes, the one end of the lever rotational shaft 94 may be inserted in order from the right. The transport unit frame 60 thereby supports the left lifting control lever 95 such that the left lifting control lever 95 is rotatable about the lever rotational shaft 94 in the one and other rotational directions.

The left lifting control lever 95 is engaged by the left lower guide shaft 90 of the pin holder 86 inserted into a shaft engagement hole formed in the front end of the housing-mounting section. The transport unit frame 60 has a left spring-fitting section 60DY protruding leftward from the upper front end of the left side plate 60D, that is, immediately above the left elevating guide hole.

The left lifting control lever 95 includes a coil spring 97 whose one end is fixed at a portion of the left lower guide shaft 90 protruding leftward from the housing-mounting section, and whose other end is fixed at the left spring-fitting section 60DY of the transport unit frame 60.

The left lifting control lever 95 is thus biased by the coil spring 97 so as to rotate in the other rotational direction, thereby raising the housing-mounting section upward together with the left lower guide shaft 90.

In the left lifting control lever 95, the left protruding portion of the linkage unit has a pin-mounting section formed at its front end so as to protrude downward therefrom. The pin-mounting section has its outer surface facing to the left on which a cylindrical coupling pin 98 is fixed so as to protrude to the left.

Correspondingly, the right lifting control lever 96 is configured in horizontally symmetrical with the left lifting control lever 95.

More specifically, the right lifting control lever 96 includes a generally L-shape, planer linkage section provided at the lower end of a generally C-shaped, planer housing-mounting section and protruding rightward therefrom. The right lifting control lever 96 is provided with a generally C-shape shaft support, which is formed at the rear end of the housing-mounting section so as to fold toward the right and the front in order.

In the left and right plates of the shaft support of the right lifting control lever 96, there are formed a pair of shaft locking holes opposing each other, which receive the other ends of the lever rotational shaft 94 in order from the left while being aligned with the left lifting control lever 95. The transport unit frame 60 thereby supports the left lifting control lever 95 as well as the right lifting control lever 96, while being aligned with each other, such that the levers are rotatable about the lever rotational shaft 94 in the one and other rotational directions.

The right lifting control lever 96 is engaged by the right lower guide shaft of the pin holder 86 inserted into the shaft engagement hole formed in the front end of the housing-mounting section. The transport unit frame 60 has a right spring-fitting section 60EY protruding rightward from the upper front end of the right side plate 60E, that is, immediately above the right elevating guide hole.

The right lifting control lever 96 includes acoil spring 99 which has its elastic force substantially equivalent to that of the coil spring 97. The coil spring 99 has its one end fixed at a portion of the right lower guide shaft, the portion protruding rightward from the housing-mounting section, and its other end fixed at the right spring-fitting section 60EY of the transport unit frame 60.

The right lifting control lever 96 is thus biased by the coil spring 99 so as to rotate in the other rotational direction, thereby raising the housing-mounting section upward together with the right lower guide shaft.

It is to be noted that the right lifting control lever 96 is different from the left lifting control lever 95 in that the length of the right protruding portion of the linkage unit is shorter, and the pin-mounting section and the coupling pin are not provided.

In the transport unit frame 60 having the structure described so far, the left lifting control lever 95 and the right lifting control lever 96 may rotate in the one and other rotational directions with the levers being aligned with each other.

Thus, the transport unit frame 60 is configured such that the pin holder 86 maymove upward and downward in cooperation with the rotation of the left lifting control lever 95 and the right lifting control lever 96 while keeping the longitudinal direction of the pin holder 86 substantially in parallel with the teller machine horizontal direction, that is, keeping the longitudinal direction of the left positioning pin 87 and the right positioning pin 88 substantially in parallel with the teller machine vertical direction.

Figure 11:
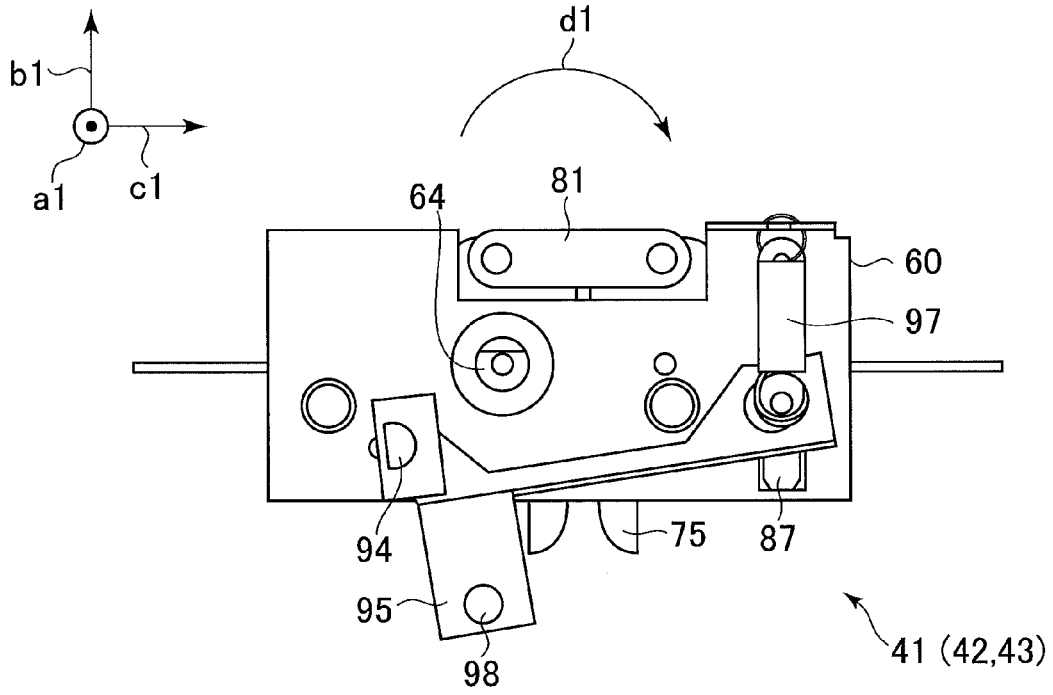
FIG. 11 is a schematic side view of the transport unit useful for understanding how to store a left and a right positioning pin in cooperation with rotation of a left and a right lifting control lever of the embodiment.

Thus, with reference to FIG. 11, the transport unit frame 60 is so adapted that, when the left lifting control lever 95 and the right lifting control lever 96 rotate together in the other rotational direction, the pin holder 86 can be pressed up in response to move upward, thereby storing the left positioning pin 87 and the right positioning pin 88 into the frame 60A.

Figure 12:
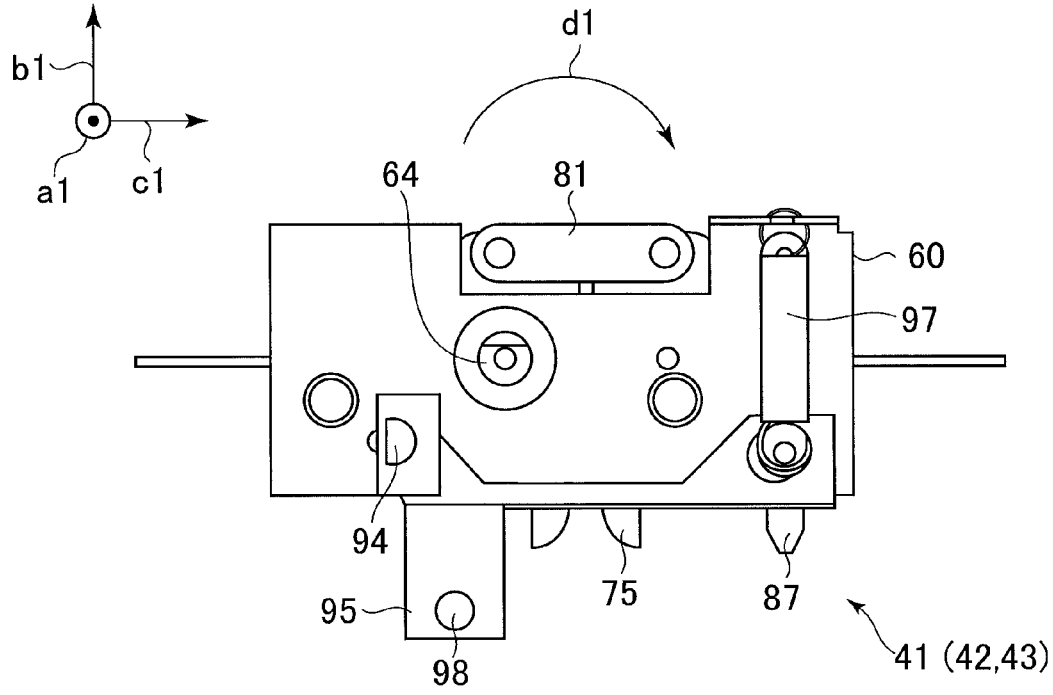
FIG. 12 is a schematic side of the transport unit view useful for understanding how the left and right positioning pins project in cooperation with rotation of the left and right lifting control levers.

With reference to FIG. 12, the transport unit frame 60 is also adapted so that, when the left lifting control lever 95 and the right lifting control lever 96 rotate together in the one rotational direction, the pin holder 86 can in turn be pulled down to move downward, thereby causing the left positioning pin 87 and the right positioning pin 88 to protrude from the frame 60A.

The transport unit frame 60 is also configured such that, for example, on the outer surface of the left side plate 60D, a front pulley supporting shaft 100 and a rear pulley supporting shaft 101 are formed below the rear roller shaft 64 in front of, and behind, the rear roller shaft 64, respectively, away from the rear roller shaft 64 by the same distance.

As described earlier with reference to FIG. 3, the transport unit frame 60 of the two-way delivery transport unit 41 is attached to the linkage frame 36 via the front mounting section 60BX and the rear mounting section 60CX, while the front movable guide 72 and the front end of the rear movable guide 73 protrude upward from the cashbox top plate 15A and the lower ends of the arms of the front fixed guide 74 and the rear fixed guide 75 protrude downward from the cashbox top plate 15A.

Well, it may be recalled that the third and fourth two-way delivery transport units 42 and 43 from the front among the plurality of two-way delivery transport units 40 to 44 may be the same in configuration as the second two-way delivery transport unit 41 from the front. The forefront one two-way delivery transport unit 40 has the same configuration as the second two-way delivery transport unit 41 from the front except that its transport unit frame is not provided with the front pulley supporting shaft 100. Further, the rearmost two-way delivery transport unit 44 has the same configuration as the second two-way delivery transport unit 41 from the front except that its transport unit frame is not provided with the rear pulley supporting shaft 101.

Figure 13:
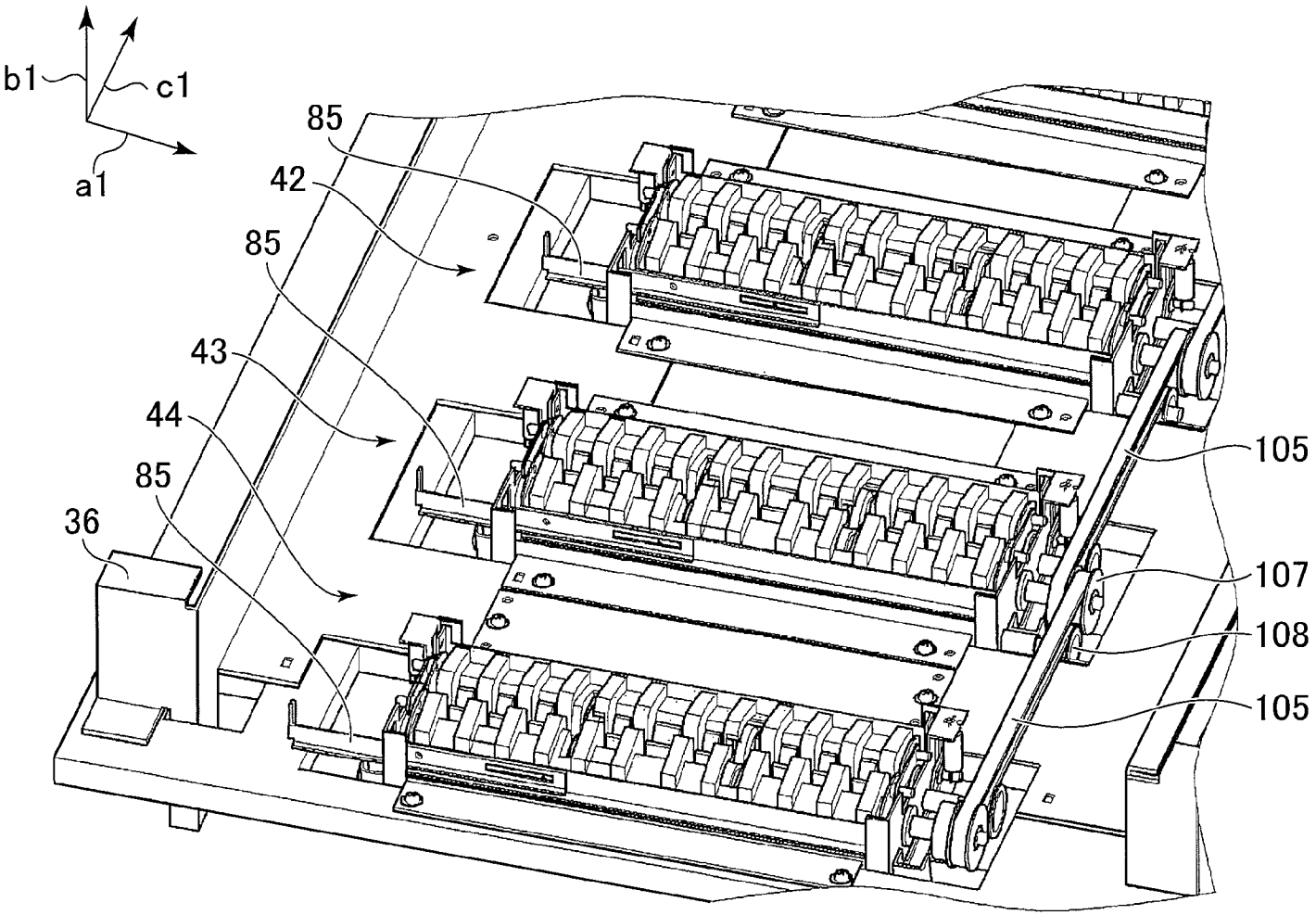
FIG. 13 is a schematic perspective view showing another alternative structure of the two-way delivery transport units of the embodiment.

As can be seen from FIGS. 3 and 13, each of the two-way delivery transport units 40 to 44 includes a driving pulley 107 which is provided at a portion of the rear roller shaft 64 protruding leftward from the left side plate 60D of the transport unit frame 60 and has a couple of tracks on which respective ones of two driving belts 105 are carried.

Also each of the two-way delivery transport units 40 to 44 has a couple of tension pulleys 108 attached to the respective front and rear pulley supporting shafts 100 and 101 rotatably in the one and other rotational directions so as to apply tension to the associated driving belts 105. The drive belts may be carried on the driving pulleys 108 in such a fashion that, for example, when one, e.g. 43, of the two-way delivery transport units 40 to 44 has a driving belt 105 for the preceding one unit 42 loaded on the one, e.g. right track of its driving pulley 107, it has another driving belt 105 for the following transport unit, i.e. 44, loaded on the other, i.e. left track of the same driving pulley 107.

In the two-way delivery transport units 40 to 44, a predetermined tension may be applied to the driving belts 105 in such a manner that the tension pulley 108 can raise the lower portion of the driving belts 105 hung on the driving pulley 107.

Among the two-way delivery transport units 40 to 44, for example, the forefront transport unit 40 has a drive transmitting unit 110 arranged, which has a gear, a driving pulley, a driving belt and so on disposed on the left side of the transport unit frame 60. Thus, the forefront two-way delivery transport unit 40 is configured such that, when the upper unit 13 is installed in the teller machine housing 2, a drive transmitting gear provided in the sorting and transport unit 28 is rendered coupled to the gear of the drive transmitting unit 110.

Thus, in the forefront two-way delivery transport unit 40, during the bill deposit and withdrawal processing, the motor driving force transmitted from the sorting and transport unit 28 is received via the drive transmitting gear by the gear of the drive transmitting unit 110, of which the rotation will be transmitted via the driving pulley and the driving belt from the driving pulley 107 of its transport unit frame 60 to the driving pulley 107 of other transport unit frames 60.

Although the two-way delivery transport units 40 to 44 each do not have a specific roller driving motor, they can drive, during the bill deposit and withdrawal processing, those two-way bill transport paths 40A to 44A in this manner to thereby transport bills.

Here, as shown in FIGS. 4 and 13, in the two-way delivery transport units 40 to 44, the rotation control lever 85 is attached to the rear guide holding member 71 of the transport unit frame 60 as described above. Between those two-way delivery transport units 40 to 44, the rotation control levers 85 attached to the rear guide holding members 71 of the respective transport unit frames 60 have the receiving section thereof displaced to the right in the teller machine rear direction at a predetermined pitch.

In the sorting and transport unit 28, each of the transport path connecting sections corresponding to the two-way delivery transport units 40 to 44 has a pair of parallel transport guides disposed with the one surfaces thereof vertically oriented and arranged one after another, a roller and a transport belt being disposed also.

In the following description, in the pair of transport guides disposed in each of the transport path connecting sections of the sorting and transport unit 28, the front transport guide may be referred to as front connecting section guide, and the rear transport guide may be referred to as rear connecting section guide.

In each of the transport path connecting sections of the sorting and transport unit 28, the lower end of the bill sorting and transport path 28A is formed between the front and rear connecting section guides to have the same transverse cross-sectional width and depth of the transport paths as in the two-way delivery transport units 40 to 44, so that bills can be transported upward and downward in the transport direction substantially parallel to the teller machine vertical direction.

Each of the front and rear connecting section guides of those transport path connecting sections in pair has a comb-like lower end formed in the teller machine leftward direction. The lower ends have the one surfaces thereof formed in the shape of arc gradually spacing away from each other.

In each of the transport path connecting sections of the sorting and transport unit 28, the front connecting section guide, for example, of the front and rear connecting section guides in pair is provided with a pressing arm 115 corresponding to the rotation control lever 85. In this case, the pressing arm 115 has a strip-like arm of a predetermined length, of which the bottom end is bonded to the front connecting section guide at a predetermined position, and the front end is located on the right side of the front connecting section guide.

At the front end of the arm of the pressing arm 115, a generally block-like presser is mounted, which is vertically elongate and protrudes downward from the front end of the arm such that its pressing surface is directed to the rear side. The presser of the pressing arm 115 is appropriately shaped and dimensioned.

The pressing arm 115 is thus attached to the front connecting section guide such that the pressing surface of the presser, for example, is substantially flush with a virtual plane that is perpendicular to the direction of, and is located at the center of, the transverse cross-sectional depth of the transport path of the front and rear connecting section guides in pair.

However, in the sorting and transport unit 28, the pressing arm 115 is attached to the front connecting section guide of each of the transport path connecting sections such that the presser of the pressing arm 115 is displaced to the right in the teller machine rear direction by a predetermined spacing and is opposed to the receiving protrusion of the rotation control lever 85.

In the two-way delivery transport units 40 to 44 structured as described above, when the upper unit 13 is pulled out of the teller machine housing 2 as described earlier, the rear guide holding member 71 and the front guide holding member 70 rotate in the one rotational direction in the transport unit frame 60, thereby inclining the front movable guide 72 and the rear movable guide 73 forward from the vertical position.

In this state, when the upper unit 13 is installed in the teller machine housing 2, the sorting and transport unit 28 moves in turn as part of the upper unit 13 from a predetermined unit pull-out position in front of the teller machine housing 2 in the teller machine rear direction to a predetermined unit installation position in the teller machine housing 2.

At this time, the sorting and transport unit 28, when coming in front of the unit installation position, starts to rotate the rear movable guide 73 and the front movable guide 72 in the other rotational direction while the presser of the pressing arm 115 of each of the transport path connecting sections is pressed against the corresponding receiver protrusion of the receiving section of the rotation control lever 85 of each of the two-way delivery transport units 40 to 44.

More specifically, when the sorting and transport unit 28 moves to the position in front of the unit installation position, it starts to rotate the rear movable guide 73 and the front movable guide 72 in the other rotational direction such that the presser of the pressing arm 115 of each transport path connecting section is pressed onto the corresponding receiving protrusion of the receiving section of the rotation control lever 85 of each of the two-way delivery transport units 40 to 44 at a specific timing according to the adjustment position of that transport path connecting section with respect to corresponding one of the two-way delivery transport units 40 to 44.

The sorting and transport unit 28 continues to move toward the unit installation position, thereby rotating the front movable guide 72 and the rear movable guide 73 of each of the two-way delivery transport units 40 to 44 in the other rotational direction to engage the front ends of the front movable guide 72 and the rear movable guide 73 with the respective lower ends of the front and rear connecting section guides while.

When the sorting and transport unit 28 reaches the unit installation position and stops there, it rotates the front movable guide 72 and the rear movable guide 73 of each of the two-way delivery transport units 40 to 44 by a predetermined angle according to the adjustment position with respect to the transport path connecting section with the movable guides kept engaged with the front and rear connecting section guides, and then stops the rotation.

Figure 14:
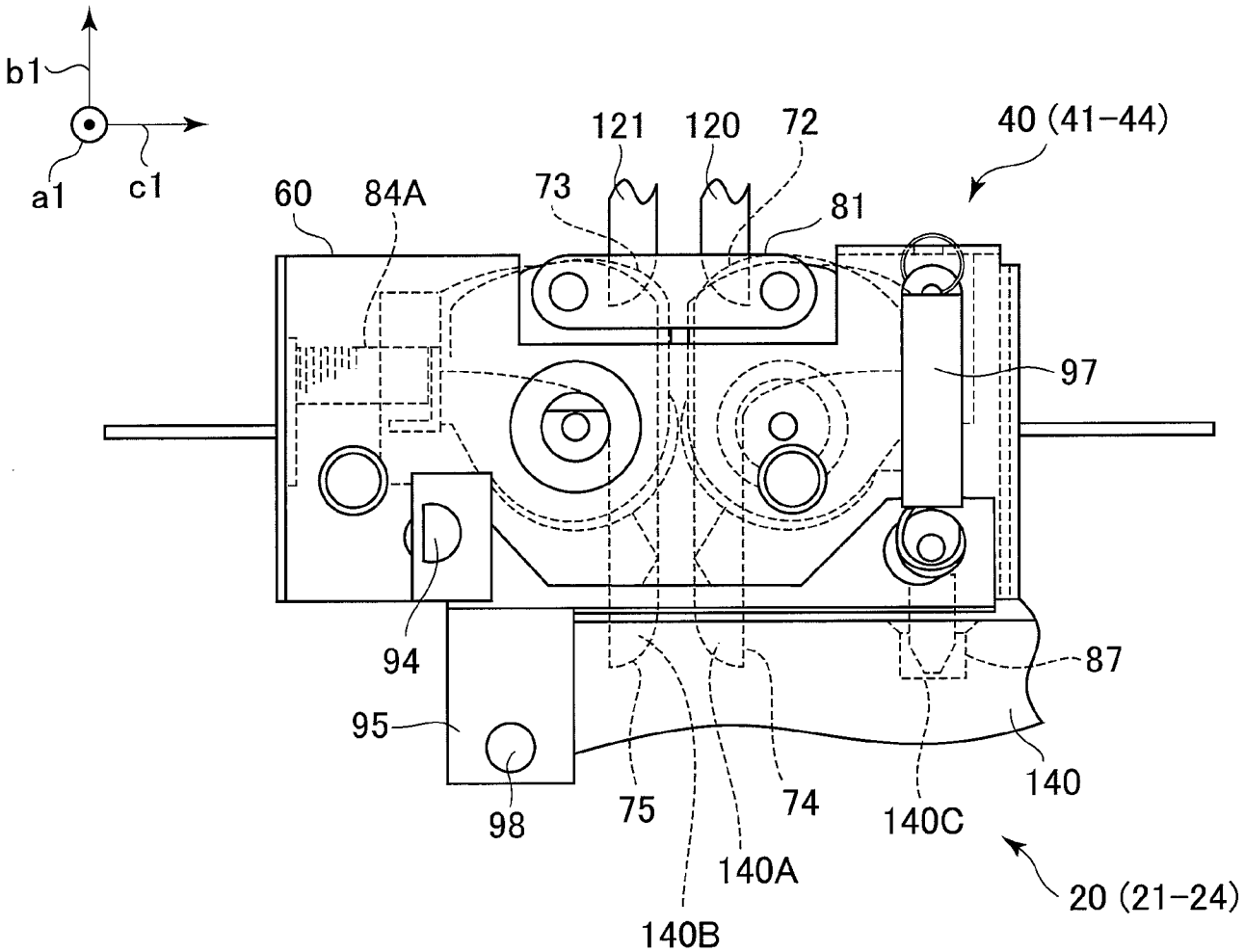
FIGS. 14, 15 and 16 are schematic side views of the transport units shown in FIG. 13 useful for understanding three connection states of the two-way bill transport path with the bill sorting transport path and stored-bill transport path.

Thus, with reference to FIG. 14, the sorting and transport unit 28 is so adapted that, when the upper unit 13 is install in the teller machine housing 2, and the transport path connecting section is located immediately above corresponding one of the two-way delivery transport units 40 to 44, the front movable guide 72 and the rear movable guide 73 are brought into the vertical position thereof, and the front ends of the movable guides are engaged with the front ends of the front connecting section guide 120 and the rear connecting section guide 121.

More specifically in this case, the front movable guide 72 and the rear movable guide 73 are brought into the vertical position thereof to render the one surface of the bottom end of the front movable guide 72 substantially flush with the one surface of the front connecting section guide 120 as well as the one surface of the bottom end of the rear movable guide 73 substantially flush with the rear connecting section guide 121 to connect the upper ends of the two-way bill transport paths 40A to 44A to the lower ends of the bill sorting and transport path 28A.

Figure 15:
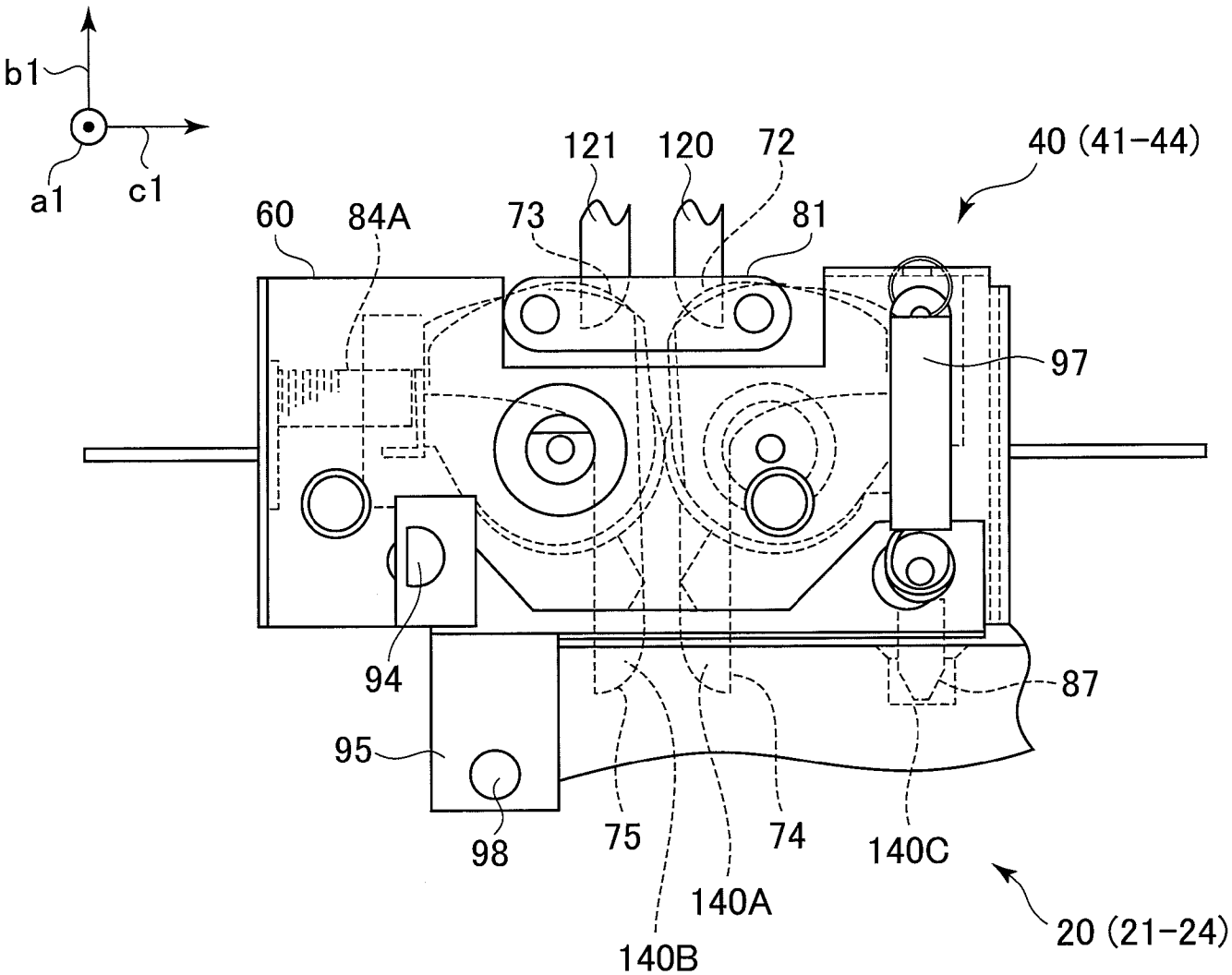

As shown in FIG. 15, the sorting and transport unit 28 is also adapted such that, when the upper unit 13 is installed in the teller machine housing 2, and the transport path connecting section is located behind the position immediately above corresponding one of the two-way delivery transport units 40 to 44, the front movable guide 72 and the rear movable guide 73 are inclined rearward to engage the front ends of the movable guides with the front ends of the front connecting section guide 120 and the rear connecting section guide 121.

More specifically in this case, the front movable guide 72 and the rear movable guide 73 are inclined rearward to cause the one surface of the bottom end of the front movable guide 72 and the one surface front connecting section guide 120 to cross each other into a dogleg shape, as well as the one surface of the bottom end of the rear movable guide 73 and the one surface of the rear connecting section guide 121 to cross each other also into a dogleg shape to thereby connect the upper ends of the two-way bill transport paths 40A to 44A to the lower ends of the bill sorting and transport path 28A.

Figure 16:
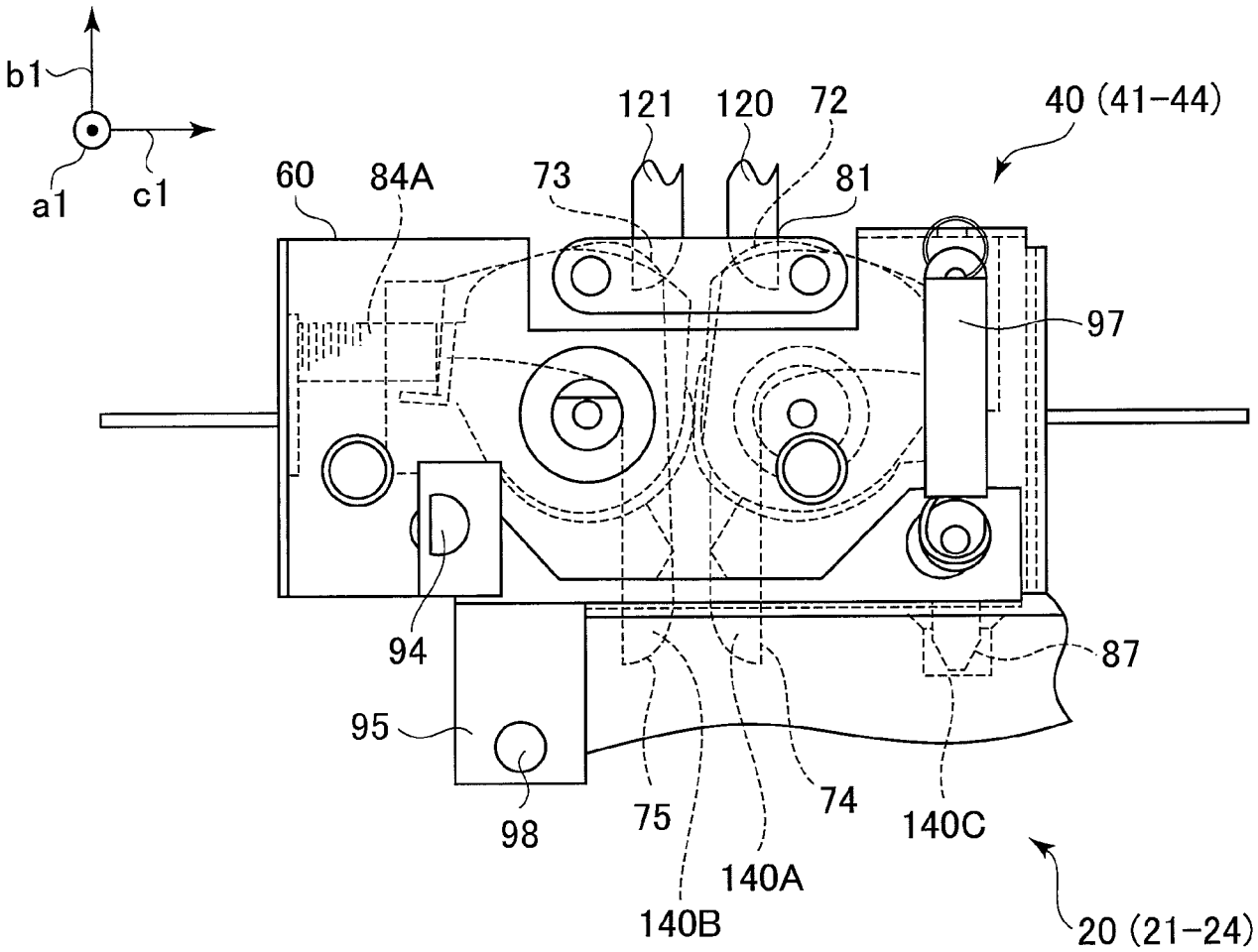

As shown in FIG. 16, the sorting and transport unit 28 is structured such that, when the upper unit 13 is installed in the teller machine housing 2, and the transport path connecting section is located in front of the position immediately above corresponding one of the two-way delivery transport units 40 to 44, the front movable guide 72 and the rear movable guide 73 are inclined forward, and the front ends of the movable guides are engaged with the front ends of the front connecting section guide 120 and the rear connecting section guide 121.

More specifically in this case, the front movable guide 72 and the rear movable guide 73 are inclined forward to cause the one surface of the bottom end of the front movable guide 72 and the one surface of the front connecting section guide 120 to cross each other into an inverted dogleg shape, as well as the one surface of the bottom end of the rear movable guide 73 and the one surface of the rear connecting section guide 121 to cross each other into an inverted dogleg shape to connect the upper ends of the two-way bill transport paths 40A to 44A to the lower ends of the bill sorting and transport path 28A.

In this manner, the sorting and transport unit 28 is configured such that, when the upper unit 13 is insufficiently adjusted in position in the teller machine fore-and-aft direction, the operator simply pushes the upper unit 13 into the teller machine housing 2 during installation of the upper unit 13 to cause the upper unit 13 to move in the teller machine rear direction, whereby the movement in the teller machine rear direction caused by the pressing will cause the upper ends of the two-way bill transport paths 40A to 44A to accurately be positioned with respect to, and thus connected to, the lower ends of the bill sorting and transport path 28A.

At this time, in the two-way delivery transport units 40 to 44, the front movable guides 72 and the rear movable guides rotate, as described above, while keeping the guides substantially in parallel with each other.

Thus, when the front movable guide 72 and the rear movable guide 73 that are inclined forward or rearward are engaged with the front connecting section guide 120 and the rear connecting section guide 121, respectively, to connect the upper ends of the two-way bill transport paths 40A to 44A to the lower ends of the bill sorting and transport path 28A, the two-way delivery transport units 40 to 44 can reliably prevent the front ends and the lower ends from entering into the connecting sections to form a step or hollow.

Figure 17:
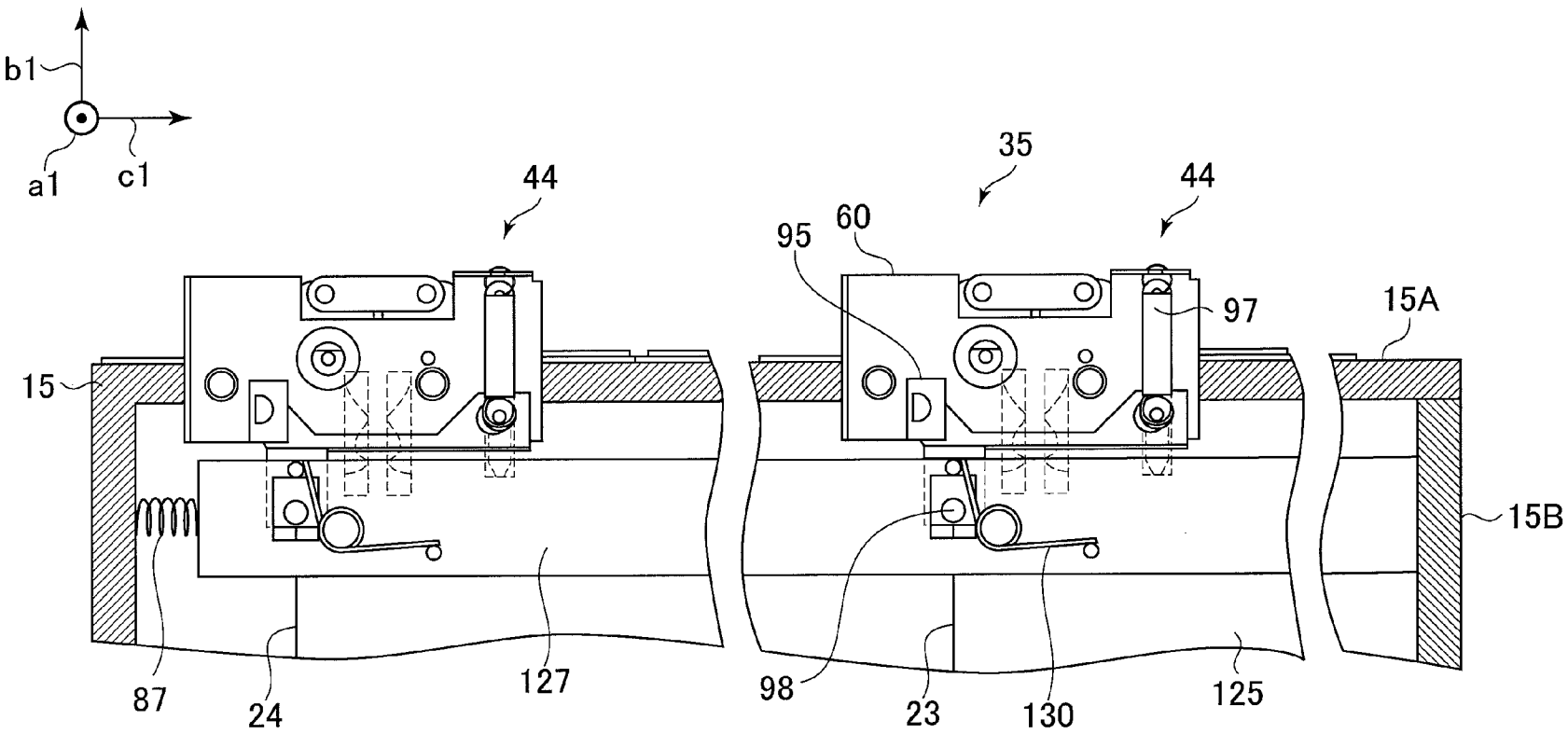
FIG. 17 is a schematic, partially cut-off side view of the two-way delivery transport units useful for understanding how to position a bill repository with respect to the transport unit.
Figure 18:
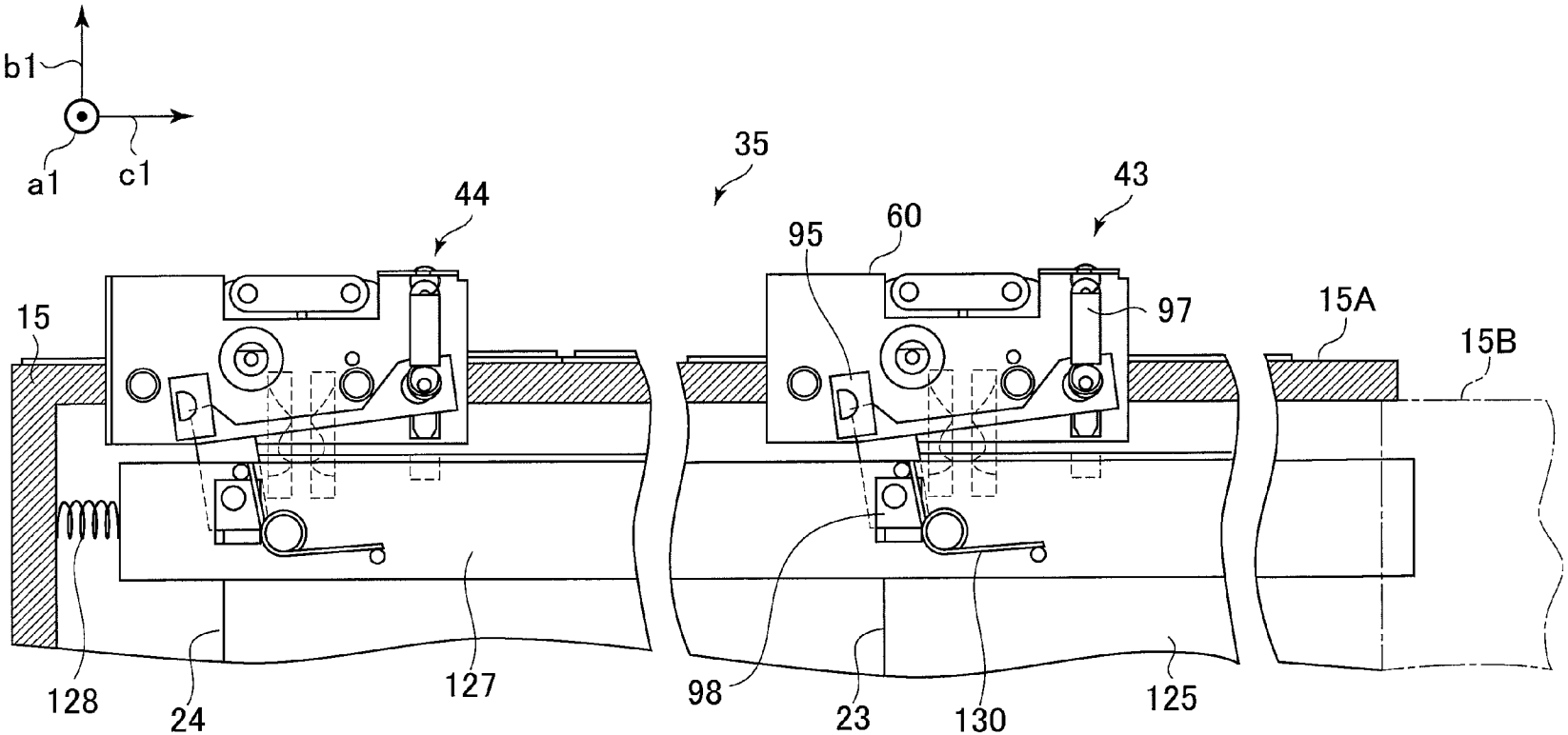
FIG. 18 is a schematic, partially cut-off side view of the transport units useful for understanding how to release the positioning of the bill repository with respect to the transport unit.

Well, with reference to FIGS. 4, 17 and 18, in the linkage unit 35, the right surfaces of the left front casing support member 36BX and the left rear casing support member in the linkage frame 36 have an inserting and extracting member 125 for inserting and extracting the left positioning pin 87 and the right positioning pin 88 of each of the two-way delivery transport units 40 to 44 into and from a positioning hole of each of the bill repositories 20 to 24. The inserting and extracting member 125 has a prismatic arm supporter 126, not shown in FIGS. 17 and 18, of a predetermined length, and a prismatic movable arm 127 that is slightly longer than the depth of the cashbox housing 15.

In this case, the arm supporter 126 is fixed at the predetermined position on the right surfaces of the left front casing support member 36BX and the left rear casing support member substantially in parallel with the teller machine fore-and-aft direction. The movable arm 127 is coupled to the arm supporter 126 by means of a plurality of coupling pins and a plurality of coupling plates, not shown in FIGS. 17 and 18, substantially in parallel with the arm, supporter 126.

Thus, in the inserting and extracting member 125, the movable arm 127 constitutes, together with the coupling pins and plates, a parallel link, and can be moved forward and rearward while being kept substantially in parallel to the arm supporter 126 and being displaced to right and left.

In the inserting and extracting member 125, between the rear end of the movable arm 127 and the inner surface of a rear plate of the cashbox housing 15, a compression coil spring 128 is disposed, which biases the movable arm 127 in the teller machine front direction.

When the cashbox door 15B of the cashbox housing 15 is closed, the compression coil spring 128 biases the movable arm 127 to move forward to press the front end of the movable arm 127 against the left end of the inner surface of the cashbox door 15B, that is, toward the hinge openably supporting the cashbox door 15B. When the cashbox door 15B of the cashbox housing 15 is opened, the compression coil spring 128 moves the movable arm 127 forward to cause the front end of the movable arm 127 to protrude forward from the cashbox housing 15.

The front surface of the cashbox door 15B has a handle, not shown, attached thereto, which may be held and rotated with a hand in opening and closing the cashbox door 15B. The handle may have a locking bar, not shown, which can be displaced in cooperation with the rotation of the handle. Thus, when the cashbox door 15B is closed and the handle is rotated, the locking bar will be engaged with the cashbox housing 15 at a predetermined position to keep the cashbox door 15B closed.

The front surface of the cashbox door 15B, for example, may have a lock attached for temporarily fixing the locking bar engaged at the engagement position so as not to be displaced but keep the cashbox door 15B of the cashbox housing 15 closed. The cashbox housing 15 is thus configured to maintain, while the cashbox door 15B is closed and the locking bar is engaged at the engagement position, the movable arm 127 there inside, irrespective of whether or not the cashbox door 15B is locked.

While the cashbox door 15B is closed with the lock being released, namely, the locking bar being engaged at the predetermined engagement position in the cashbox housing 15, a rotation of the handle can cause the locking bar to be retracted from its engagement position to allow the cashbox door 15B to open. Thus, while the cashbox door 15B is opened, the movable arm 127 is moved by means of the compression coil spring 128 to protrude the front end of the movable arm 127 forward from the cashbox housing 15.

The movable arm 127 has its right surface on which a rectangular pin-receiving hole is formed at a position opposed to the coupling pin 98 provided in the left lifting control lever 95 of each of the two-way delivery transport units 40 to 44. The hole has its width and depth longer than the diameter of the coupling pin 98.

In the movable arm 127, the coupling pins 98 have the front ends thereof, which correspond to the respective pin-receiving holes and are inserted from the right surface to protrude from the left surface.

The left surface of the movable arm 127 has a spring presser and a spring-fitting section are provided to protrude above and in front of each of the pin-receiving holes. On the left surface of the movable arm 127, torsion springs 130 are provided in front of the pin-receiving holes in the state of being contracted to a certain extent. The torsion springs 130 have the one ends thereof located at the spring-fitting sections, and the other end pressed onto the spring presser from the front.

Figure 19:
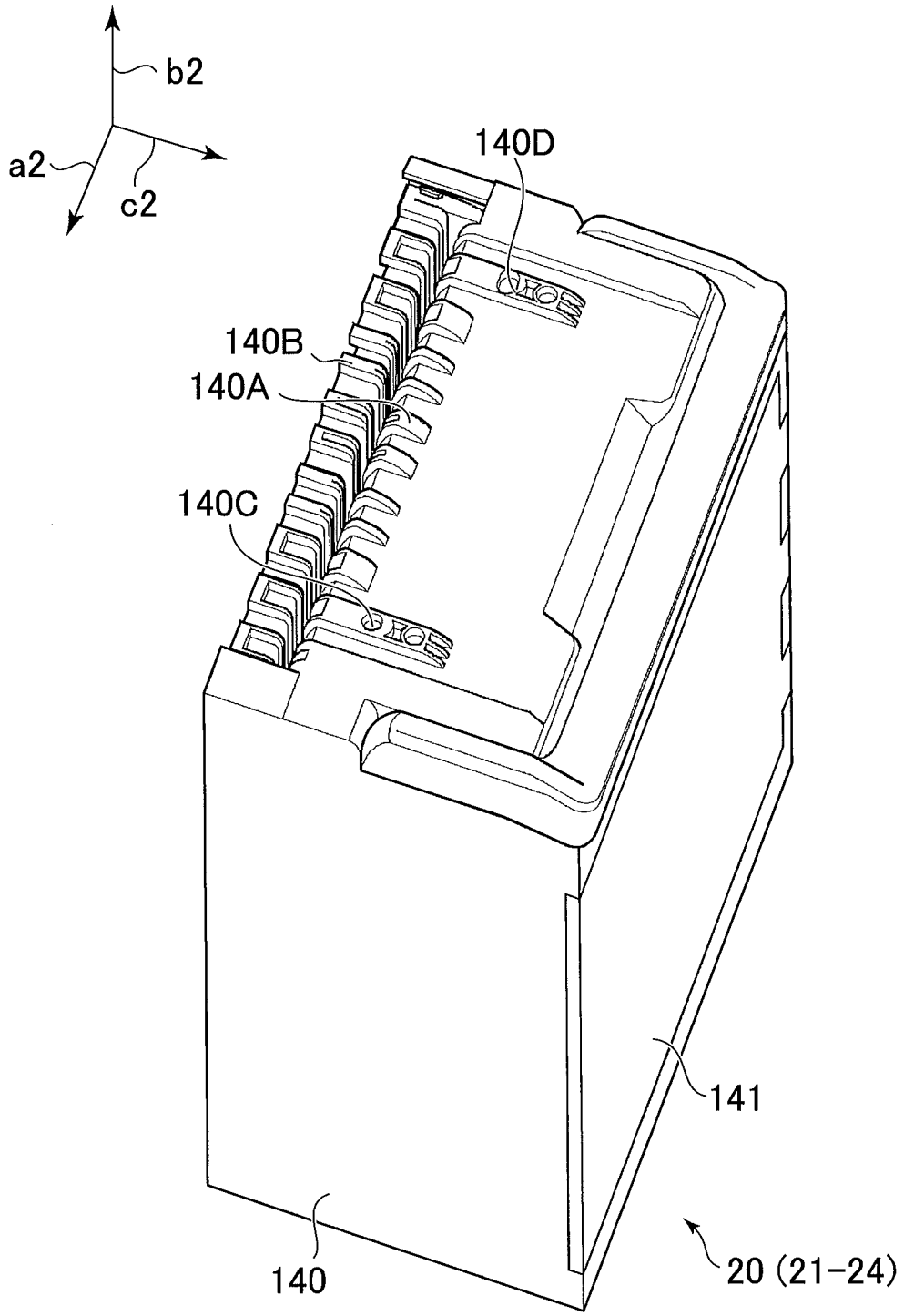
FIG. 19 is a schematic perspective view showing the structure of the bill repository of the embodiment.

Now, with reference to FIG. 19, the structure of the bill repositories 20 to 24 will be described. The bill repositories 20 to 24 may be the same in structure. Therefore, one bill repository 20 will be described whereas the remaining bill repositories 21 to 24 will be refrained from describing.

The bill repository 20 comprises, for example, a generally rectangular and vertically elongate, parallelepiped exterior casing 140, which has a repository door 141 openably provided on its front side.

In the following description, the leftward direction represented by an arrow a2, FIG. 19, when viewing the bill repository 20 from the front side of the exterior casing 140, may be referred to as a repository left direction, and the direction opposite to the repository left direction may be referred to as a repository right direction. When the repository left and right directions need not particularly be distinguished from each other, both may collectively be referred to as a repository horizontal direction.

Also in the context, an upward direction represented by an arrow b2, when viewing the bill repository 20 from the front side of the exterior casing 140, may be referred to as a repository upward direction, and the direction opposite to the repository upward direction may be referred to as a repository downward direction. Also, when the repository upward and downward directions need not particularly be distinguished from each other, both may collectively be referred to as a repository vertical direction.

Further, a forward, or near-end, direction represented by an arrow c2, when viewing the bill repository 20 from the front side of the exterior casing 140, may be referred to as a repository front direction, and the direction opposite to the repository front direction may be referred to as a repository rear direction. When the repository front and rear directions need not particularly be distinguished from each other, both may correctively referred to as a repository fore-and-aft direction.

The upper surface of the exterior casing 140 has parallel transport guides 140A and 140B integrally formed in pair at its rear end such that each one surface is vertically oriented and located back and forth. Of the transport guides 140A and 140B integrally formed in pair on the upper surface of the exterior casing 140, the front one 140A may be referred to as repository front guide, and the rear one 140B may be as repository rear guide.

In the exterior casing 140, a plurality of rollers are disposed correspondingly to the repository front guide 140A and the repository rear guide 140B. Thus, the installation bill transport path 20AX of the bill repository 20 has its end formed between the repository front guide 140A and the repository rear guide 140B so as to establish the same transport path transverse cross-sectional width and depth as in the two-way delivery transport units 40 to 44 to allow bills to be transferred upward and downward in the transport direction substantially parallel to the repository vertical direction.

The repository front guide 140A and the repository rear guide 140B each have the upper ends thereof comb-shaped in the repository left direction, and each one surface of the upper ends is arcuate so as to gradually increase spacing therebetween from the bottom toward the top.

On the upper surface of the exterior casing 140, a left positioning hole 140C is formed at a predetermined depth ahead of the repository front guide 140A on the left. The positioning hole 140C may be, for example, circular and correspond to the left positioning pin 87 of the two-way delivery transport unit 40. The left positioning hole 140C has its bottom having substantially the same inner diameter as the left positioning pin 87. The left positioning hole 140C is funnel-shaped such that a pin receiving port extends over the circumference so that the inner diameter gradually increases from the bottom.

On the upper surface of the exterior casing 140, a right positioning hole 140D is formed at a predetermined depth ahead of the repository front guide 140A on the right. The positioning hole 140D may be of a racing track-like shape and correspond to the right positioning pin 88 of the two-way delivery transport unit 40 such that its longitudinal direction is substantially parallel to the repository horizontal direction.

The right positioning hole 140D has its bottom which has its longitudinal width substantially equal to the diameter of the right positioning pin 88 and its transverse width of a predetermined length longer than the diameter of the right positioning pin 88. The right positioning hole 140D is funnel-shaped such that a pin receiving port extends over the circumference so that the longitudinal and transverse widths gradually increase from the bottom.

The bill repository 20, and the remaining bill repositories 21 to 24 having the same structure as the bill repository 20 each are loaded, for example, in the state where the front side of the exterior casing 140 faces to the front with respect to the repository load casing 16.

The two-way delivery transport units 40 to 44, FIGS. 17 and 18, thus structured functions in such a manner that, when the cashbox door 15B of the cashbox housing 15 is opened, the left lifting control lever 95 and the right lifting control lever 96 are rotated in the other rotational direction, as described later, thereby storing the left positioning pin 87 and the right positioning pin 88 into the frame 60A of the transport unit frame 60.

In this state, when the repository load casing 16 having the bill repositories 20 to 24 loaded therein is installed into the cashbox housing 15 to the predetermined casing installation position, the lower ends of the front fixed guide 74 and the rear fixed guide 75 of each of the two-way delivery transport units 40 to 44 engage with the upper ends of the repository front guide 140A and the repository rear guide 140B of the bill repositories 20 to 24.

At this time, in each of the two-way delivery transport units 40 to 44, when the position of the repository load casing 16 in the teller machine fore-and-aft direction is accurately adjusted, as shown in FIG. 14, the one surface of each of the arms of the front fixed guides 74 is rendered substantially flush with the corresponding one surface of the repository front guides 140A of the bill repositories 20 to 24, and the one surface of each of the arms of the rear fixed guides 75 is rendered substantially flush with the corresponding one surface of the repository rear guides 140B of the bill repositories 20 to 24, so that the lower ends of the two-way bill transport paths 40A to 44A are connected to the upper ends of the stored-bill transport paths 20AX to 24AX without causing any steps in the connecting sections.

However, if the position of the repository load casing in the teller machine fore-and-aft direction is insufficiently adjusted, the repository front guides 140A and the repository rear guides 140B of the bill repositories 20 to 24 would be displaced from the front fixed guides 74 and the rear fixed guide 75 to the front or rear side. Thus, in the two-way delivery transport units 40 to 44, the lower ends of the two-way bill transport paths 40A to 44A would be connected to the upper ends of the stored-bill transport paths 20AX to 24AX with steps caused in the connecting sections.

Thus, the inserting and extracting member 125 is configured such that, when the repository load casing 16 having the bill repositories 20 to 24 carried therein is installed in the cashbox housing 15, the closure of the opened cashbox door 15B of the cashbox housing 15 causes the inner surface of the cashbox door 15B to press the front end of the movable arm 127, so that the movable arm 127 moves in the teller machine rear direction.

At this time, the inserting and extracting member 125, while moving the movable arm 127, causes the left surface of the movable arm 127 to press the other end of the torsion spring 130 onto the front end of the coupling pin 98 of each of the two-way delivery transport units 40 to 44.

Thus, in each of the two-way delivery transport units 40 to 44, the inserting and extracting member 125, while displacing the coupling pins 98, rotates the left lifting control levers 95 and the right lifting control levers 96 in the one rotational direction, thereby lowering the left positioning pins 87 and the right positioning pin 88.

The inserting and extracting member 125 thereby inserts the left positioning pins 87 and the right positioning pin 88 of the two-way delivery transport units 40 to 44 at a time into the left positioning holes 140C and the right positioning holes 140D of the respective bill repositories 20 to 24.

At this time, if the position of the repository load casing 16 in the teller machine fore-and-aft direction is accurately adjusted, then the centers of the left positioning holes 140C and the right positioning holes 140D of the bill repositories 20 to 24 are located immediately below the centers of the left positioning pins 87 and the right positioning pin 88 of the respective two-way delivery transport units 40 to 44. In that case, the inserting and extracting member 125 can insert the left positioning pins 87 and the right positioning pin 88 of the two-way delivery transport units 40 to 44 into the left positioning holes 140C and the right positioning hole 140D of the respective bill repositories 20 to 24, without particularly repositioning.

However, if the position of the repository load casing in the teller machine fore-and-aft direction is insufficiently adjusted, the centers of the left positioning holes 140C and the right positioning hole 140D of the bill repositories 20 to 24 would then be displaced to the front or rear side from positions immediately below the centers of the left positioning pins 87 and the right positioning pins 88 of the respective two-way delivery transport units 40 to 44.

In the illustrative embodiment, however, the front ends of the left positioning pin 87 and the right positioning pin 88 each are tapered, as described above. Further, the pin receiving port of each of the left positioning hole 140C and the right positioning hole 140D is funnel-shaped, also as described above.

Due to that specific structure of the inserting and extracting member 125, if the centers of the left positioning holes 140C of the bill repositories 20 to 24 are displaced to the front or rear side from positions immediately below the centers of the left positioning pins 87 of the respective two-way delivery transport units 40 to 44, the bill repositories 20 to 24 change the position and orientation thereof so as to draw the centers of the left positioning holes 1400 immediately below the centers of the left positioning pins 87, whereby the left positioning pins 87 will successfully be inserted into the right positioning hole 140C.

Also when the centers of the right positioning holes 140D of the bill repositories 20 to 24 are displaced to the front or rear side from positions immediately below the centers of the right positioning pins 88 of the respective two-way delivery transport units 40 to 44, the inserting and extracting member 125 can similarly insert the right positioning pins 88 into the right positioning hole 140D by changing the position and orientation of the bill repositories 20 to 24 so as to draw the centers of the right positioning holes 140D immediately below the centers of the right positioning pins 88.

The inserting and extracting member 125 can thus appropriately position the bill repositories 20 to 24 with respect to the two-way delivery transport units 40 to 44.

By the inserting and extracting member 125, when the bill repositories 20 to 24 have thus been positioned with respect to the two-way delivery transport units 40 to 44 while changing the position and orientation thereof, the displacement of the repository front guide 140A and the repository rear guide 140B from the front fixed guide 74 and the rear fixed guide 75 will be corrected.

More specifically, by the inserting and extracting member 125, the displacement in position is corrected in such a fashion that the one surface of each of the arms of the front fixed guides 74 is rendered substantially flush with the one surface of the corresponding repository front guides 140A, and the one surface of each of the arms of the rear fixed guide is substantially flush with the one surface of the corresponding repository rear guide 140B, so that the step is reduced in the connecting sections between the lower ends of the two-way bill transport paths 40A to 44A to the upper ends of the stored-bill transport paths 20AX to 24AX.

In short, according to the inserting and extracting member 125 thus structured, if the position of the repository load casing 16 in the teller machine fore-and-aft direction is insufficiently adjusted, the operator may simply close the cashbox door 15B of the cashbox housing 15 when installing the repository load casing 16, so that the upper ends of the stored-bill transport paths 20AX to 24AX of the bill repositories 20 to 24 can accurately be positioned with respect to, and hence correctly connected to, the lower ends of the two-way bill transport paths 40A to 44A of the respective two-way delivery transport units 40 to 44.

When the repository load casing 16 is pulled out, the open of the cashbox door 15B of the cashbox housing 15 causes the inserting and extracting member 125 to move the movable arm 127 in the teller machine front direction by the action of the compression coil spring 128. At this time, with the inserting and extracting member 125, while the movable arm 127 moves, it presses the rear surfaces of the pin-receiving holes in the movable arm 127 against the coupling pins 98 inserted in the pin-receiving holes.

Thus, in each of the two-way delivery transport units 40 to 44, the inserting and extracting member 125 displaces the coupling pins 98 forward to rotate the left lifting control lever 95 and the right lifting control lever 96 in the other rotational direction, thereby moving the left positioning pins 87 and the right positioning pins 88 upward.

The inserting and extracting member 125 thus pulls out the left positioning pins 87 and the right positioning pin 88 of the two-way delivery transport units 40 to 44 at a time from the left positioning holes 140C and the right positioning holes 140D of the respective bill repositories 20 to 24.

Upon pulling out the left positioning pins 87 and the right positioning pins 88 from the left positioning holes 140C and the right positioning holes 140D in this manner, the two-way delivery transport units 40 to 44 cause, from that instant, the inserting and extracting member 125 to subsequently rotate the left lifting control lever 95 and the right lifting control lever 96 in the other rotational direction by the action of the pair of coil springs 97 and 99, thereby moving the left positioning pins 87 and the right positioning pins 88 upward to install the load casing into the frame 60A of the transport unit frame 60.

In accordance with the inserting and extracting member 125 thus structured, during the pull-out of the repository load casing 16, it is not necessary for the operator to perform any special operations of pulling out the left positioning pins 87 and the right positioning pins 88 of the two-way delivery transport units 40 to 44 from the left positioning holes 140C and the right positioning holes 140D of the bill repositories 20 to 24, but to simply open the cashbox door 15B of the cashbox housing 15 in order to pull out the repository load casing 16, so that the left positioning pins 87 and the right positioning pins 88 of the two-way delivery transport units 40 to 44 can be pulled out at a time from the left positioning holes 140C and the right positioning holes 140D of the respective bill repositories 20 to 24.

Since the cashbox door 15B of the cashbox housing 15 is made of relatively thick metal plates and thus relatively heavy, a certain level of force would be required to open and close the door. With the illustrative embodiment, however, in order to bias the movable arm 127 forward, the inserting and extracting member 125 is provided with the compression coil spring 128 having a relatively large elastic force.

Thus, the inserting and extracting member 125 is configured such that, when the repository load casing 16 is pulled out, in order to open the cashbox door 15B of the cashbox housing 15, the rotation of the handle causes the locking bar is retracted from the engagement position in the cashbox housing 15, the movable arm 127 presses the cashbox door 15B forward by the action of the compression coil spring 128 to slightly open the cashbox door 15B, that is, to make the cashbox door 15B slightly free from the cashbox housing 15. According to the inserting and extracting member 125 thus structured, a load incurred on the operator, when opening the cashbox door 15B of the cashbox housing 15, can thus be reduced.

As described above, the inserting and extracting member 125 is provided with the movable arm 127 which can move back and forth by use of the parallel link mechanism. Owing to that configuration, if the movable arm 127 is pressed by the inner surface of the cashbox door 15B rotating about the hinge while closing the cashbox door 15B to the cashbox housing 15, the inserting and extracting member 125 can prevent the movable arm 127 from being deformed or damaged by the pressing force of the cashbox door 15B in the rotational direction.

It is to be noted that the two-way bill transport paths 40A to 44A, and the lower ends of the bill sorting and transport path 28A and the stored-bill transport paths 20AX to 24AX need to be accurately positioned and connected to each other since bills are bidirectionally transported in the teller machine downward and upward directions. The above-mentioned configuration of the two-way bill transport paths 40A to 44A, and the lower ends of the bill sorting and transport path 28A and the stored-bill transport paths 20AX to 24AX achieves highly accurate positioning during the connection.

By contrast, on the one-way bill transport path 39A, and the one lower end of the bill sorting and transport path 28A corresponding thereto and the reject bill transport path 17AX, reject bills are transported only in one direction such as the teller machine downward direction, and hence they may not so accurately be positioned and connected as bidirectional transportation of bills in order to transfer reject bills in one direction without causing any difficulties.

For this reason, although the sorting and transport unit 28 has the lower end of the bill sorting and transport path 28A at one transport path connecting section corresponding to the one-way delivery transport unit 39, like the transport path connecting sections corresponding to the two-way delivery transport units 40 to 44, the one-way delivery transport unit 39 is different from the two-way delivery transport units 40 to 44 in configuration, as will be described below.

With reference to FIGS. 3 and 4, the one-way delivery transport unit 39 has a pair of transport guides 151 and 152 fixed, for example, in a transport unit frame 150. The transport guides 151 and 152 each have a predetermined length longer than the long side of bills and a generally C-shape cross section. One of the guides is located on the front side and the other guide is located on the rear side such that the respective one surfaces thereof are opposed to each other. In the context, in respect of the one-way delivery transport unit 39, the front transport guide 151 may be referred to as one-direction front guide, and the rear transport guide 152 may be as one-direction rear guide.

In this case, the one-direction front guide 151 and the one-direction rear guide 152 each have the one surface thereof inclined, and are disposed such that the spacing therebetween becomes gradually smaller from the bottom toward the top. Each of the one-direction front guide 151 and the one-direction rear guide 152 has its upper and lower ends comb-shaped in the teller machine leftward direction.

In the one-way delivery transport unit 39, a pair of rollers are rotatably disposed in the one-direction front guide 151 on roller shafts substantially parallel to the teller machine horizontal direction. Each of the pair of rollers has its circumferential side surface partially protruding backward through the respective holes formed in the one-direction front guide 151. Similarly, another pair of rollers is rotatably disposed in the one-direction rear guide 152 on roller shafts substantially parallel to the teller machine horizontal direction. Each of the pair of rollers has its circumferential side surface partially protruding through the respective holes formed in the one-direction rear guide 152.

Thus, in the one-way delivery transport unit 39, the rear side of the circumferential side surfaces of the pair of rollers in the one-direction front guide 151 and the front side of the circumferential side surfaces of the pair of rollers in the one-direction rear guide 152 are pressed against each other between the one-direction front guide 151 and the one-direction rear guide 152.

In this manner, the one-way delivery transport unit 39 forms the one-way bill transport path 39A between the one-direction front guide 151 and the one-direction rear guide 152. The transport path 39A has its transport path transverse cross-sectional width substantially equal to that of the two-way delivery transport units 40 to 44, and its transport path transverse cross-sectional depth gradually becoming shallow from the top toward the bottom.

The one-way delivery transport unit 39 is provided with a left drive transmission mechanism 155 disposed on the left side of the transport unit frame 150. The transmission mechanism includes a gear, a driving pulley, a driving belt and so on. The one-way delivery transport unit 39 is configured such that, when the upper unit 13 is installed into the teller machine housing 2, a gear of the left drive transmission mechanism 155 is brought into engagement with the drive transmitting gear of the sorting and transport unit 28.

Thus, in the one-way delivery transport unit 39, during the bill deposit and withdrawal processing, the motor driving force transmitted from the sorting and transport unit 28 is received by the drive transmitting gear of the left drive transmission mechanism 155 to transmit the gear rotation via the driving pulley and driving belt to the driving pulley of the transport unit frame 150 to thereby rotate the roller shafts.

In this manner, although the one-way delivery transport unit 39 does not include a specific roller driving motor, the one-way bill transport path 39A can, during the bill depositing or withdrawal processing, be driven to transport the reject bill.

In the one-way delivery transport unit 39 thus structured, when the upper unit 13 is installed in the teller machine housing 2, the upper ends of the one-direction front guide 151 and the one-direction rear guide 152 are brought into engagement with the lower ends of the front and rear connecting section guides in the respective transport path connecting section of the sorting and transport unit 28 to thereby connect the upper end of the one-way bill transport path 39A to the lower end of the bill sorting and transport path 28A.

In the one-way delivery transport unit 39, the spacing between the upper ends of the one-direction front guide 151 and the one-direction rear guide 152, that is, the transport path transverse cross-sectional depth at the upper end of the one-way bill transport path 39A, is set larger than the spacing between the lower ends of the front and rear connecting section guides of the sorting and transport unit 28, that is, the transport path transverse cross-sectional depth of the bill sorting and transport path 28A.

Therefore, if the center of the transport path transverse cross-sectional depth of the upper end of the one-way bill transport path 39A is displaced in the fore-and-aft direction from the center of the transport path transverse cross-sectional depth of the lower end of the bill sorting and transport path 28A, the one-way delivery transport unit 39 can receive a reject bill sent from the lower end of the bill sorting and transport path 28A at the upper end of the one-way bill transport path 39A, and continue to transport the reject bill.

The reject storage 17 includes an exterior casing 157, like the bill repositories 20 to 24. The exterior casing 157 has its upper surface having a pair of transport guides 157A, of which only one is depicted and not the other, integrally formed at its rear end one after another with the one surfaces thereof opposing each other. Of the pair of transport guides 157A integrally formed on the upper surface of the exterior casing 157, the front transport guide 157A may be referred to as reject storage front guide, and the rear transport guide may be as reject storage rear guide.

In this case, the one surfaces of the reject storage front guide 157A and the reject storage rear guide are formed such that the spacing therebetween becomes gradually smaller from the top toward the bottom. Each of the reject storage front guide 157A and the reject storage rear guide has its upper end formed in a comb-shape in the teller machine leftward direction.

The exterior casing 157 includes a plurality of rollers and a gear 158, coupled to the rollers, disposed correspondingly to the reject storage front guide 157A and the reject storage rear guide.

In this manner, the reject storage 17 forms the reject bill transport path 17AX between the reject storage front guide 157A and the reject storage rear guide. The transport path 17AX has its transport path transverse cross-sectional width substantially equal to that of the two-way delivery transport units 40 to 44, and its transport path transverse cross-sectional depth gradually becoming shallow from the top toward the bottom.

The reject storage 17 does not have a specific roller driving motor. For this reason, the one-way delivery transport unit 39 has a right drive transmission mechanism 159 disposed on the right side of the transport unit frame 150. The right transmission mechanism 59 includes a gear, a driving pulley, a driving belt and so on, and is coupled to the left drive transmission mechanism 155 via a roller shaft.

The reject storage 17 has a cutaway formed for exposing the inner gear 158 at a right end of the upper surface of the exterior casing 157.

The one-way delivery transport unit 39 is configured so that, when pulling out and installing the repository load casing 16, the gear of the right drive transmission mechanism 159 may be raised in response to a predetermined operation so that the gear would not prevent the repository load casing 16 from being pulled out or installed.

The one-way delivery transport unit 39 is configured such that, when the repository load casing 16 is installed into the cashbox housing 15, the gear of the right drive transmission mechanism 159 is lowered in response to a predetermined operation to thereby be engaged with the gear 158 of the reject storage 17. Therefore, in the bill deposit and withdrawal processing, the one-way delivery transport unit 39 can transmit the rotation of the gear of the right drive transmission mechanism 159 to the reject storage 17, thereby rotating the roller for drawing the reject bill into the reject storage 17.

With the one-way delivery transport unit 39 thus configured, when the repository load casing 16 having the bill repositories 20 to 24 and the reject storage 17 carried therein is loaded into the cashbox housing 15, the lower ends of the one-direction front guide 151 and the one-direction rear guide 152 are engaged with the upper ends of the reject storage front guide 157A and the reject storage rear guide of the reject storage 17 to thereby connect the lower end of the one-way bill transport path 39A to the lower end of the reject bill transport path 17AX.

It is noted that, in the reject storage 17, the spacing between the upper ends of the reject storage front guide 157A and the reject storage rear guide, that is, the transport path transverse cross-sectional depth of the upper end of the reject bill transport path 17AX, is set to be larger than the spacing between the lower ends of the one-direction front guide 151 and the one-direction rear guide 152, that is, the transport path transverse cross-sectional depth of the lower end of the one-way bill transport path 39A. Therefore, if the center of the transport path transverse cross-sectional depth of the lower end of the one-way bill transport path 39A is displaced in the fore-and-aft direction from the center of the transport path transverse cross-sectional depth of the upper end of the reject bill transport path 17AX, the reject bill sent from the lower end of the one-way bill transport path 39A can appropriately be transported to the upper end of the reject bill transport path 17AX.

In this manner, the one-way delivery transport unit 39 is configured so that, when the position of the upper unit 13 and/or the repository load casing 16 in the teller machine fore-and-aft direction is insufficiently adjusted, an inaccurate positioning of the upper and lower ends of the one-way bill transport path 39A with respect to the lower ends of the bill sorting and transport path 28A and the upper end of the reject bill transport path 17AX, respectively, allows a reject bill sent over the bill sorting and transport path 28A to be transferred to the reject bill transport path 17AX.

In summary, in the automatic teller machine 1 configured as described above, each of the two-way delivery transport units 40 to 44 has the front movable guide 72 and the rear movable guide 73 rotatably provided such that the one surface of each of their bottom ends is opposed to each other, and the front movable guide 72 and the rear movable guide 73 are rotatably coupled to each other by means of the left and right coupling plates 81 and 82 so that the one surfaces are substantially in parallel to each other.

In operation, when the upper unit 13 is installed into the teller machine housing 2, in the automatic teller machine 1, the front movable guides 72 and the rear movable guides 73 of the two-way delivery transport units 40 to 44 are rotated in response to the position of the front connecting section guides 120 and the rear connecting section guides 121 of the respective transport path connecting sections of the sorting and transport unit 28 so as to engage the front movable guides 72 and the rear movable guides 73 with the front connecting section guides 120 and the rear connecting section guides 121 to thereby connect the upper ends of the two-way bill transport paths 40A to 44A to the lower ends of the bill sorting and transport path 28A.

Accordingly, when the front movable guides 72 and the rear movable guides 73, while being kept inclined forward or rearward, of the two-way delivery transport units 40 to 44 are engaged with the associated front connecting section guides 120 and rear connecting section guides 121 of the sorting and transport unit 28, the automatic teller machine 1 can connect the upper ends of the two-way bill transport paths 40A to 44A to the lower ends of the bill sorting and transport path 28A without changing the transport path transverse cross-sectional depth.

Thus, when the front movable guides 72 and the rear movable guides 73, while being kept inclined forward or rearward, of the two-way delivery transport units 40 to 44 are engaged with the associated front connecting section guides 120 and rear connecting section guides 121 of the sorting and transport unit 28, the automatic teller machine 1 can reliably prevent the front ends of the front movable guide 72 and rear movable guide 73 and the lower ends of the front connecting section guide 120 and rear connecting section guide 121 from entering into the connecting sections of the engaged upper ends of the two-way bill transport paths 40A to 44A and lower ends of the bill sorting and transport path 28A to form a step or hollow.

The upper ends of the two-way bill transport paths 40A to 44A are thus connected to the lower ends of the bill sorting and transport path 28A without forming any steps or hollows in the connecting sections as described above. Hence, in practice, when bills are transferred over the bill sorting and transport path 28A and the two-way bill transport paths 40A to 44A in order, the automatic teller machine 1 can substantially reliably prevent the bills from jamming in or damaging the connecting sections.

With the automatic teller machine 1 thus configured as described so far, the front and rear movable guides 72 and 73 are rotatably coupled in pair to each of the two-way delivery transport units 40 to 44 via the left and right coupling plates 81 and 82, respectively, such that the respective one surfaces are substantially parallel to each other, and the front and rear movable guides 72 and 73 are rotated in response to the position of the front and rear connecting section guides 120 and 121 to be engaged with the front and rear connecting section guides 120 and 121, thereby connecting the upper ends of the two-way bill transport paths 40A to 44A to the lower ends of the bill sorting and transport path 28A.

Thus, when the front and rear movable guides 72 and 73 are engaged with the front and rear connecting section guides 120 and 121, while being inclined forward or rearward due to displacement of the bill sorting and transport path 28A from the two-way bill transport paths 40A to 44A, the automatic teller machine 1 can connect the upper ends of the two-way bill transport paths 40A to 44A to the lower ends of the bill sorting and transport path 28A without changing the transport path transverse cross-sectional depth, thereby reliably preventing any steps or hollows in the connecting sections.

The automatic teller machine 1 can thus properly connect the upper ends of the two-way bill transport paths 40A to 44A to the lower ends of the bill sorting and transport path 28A, irrespective of how they displace.

The automatic teller machine 1 is adapted so that the rotation control lever 85 is attached to the rear guide holding member 71 in each of the two-way delivery transport units 40 to 44 so as to displace the receiving portion of the rotation control lever 85 toward the right with a predetermined spacing in the teller machine rear direction.

The automatic teller machine 1 is also adapted so that the pressing arm 115 is attached to the front connecting section guide 120 of each transport path connecting section of the sorting and transport unit 28 as opposed to the receiving protrusion of the rotation control lever 85 so as to displace the presser of the pressing arm 115 toward the right with a predetermined spacing in the teller machine rear direction.

Accordingly, in the automatic teller machine 1, when installing the upper unit 13 having the sorting and transport unit 28, the operator merely pushes the upper unit 13 into the teller machine housing 2, and in turn the sorting and transport unit 28 moves to force the pressers of the pressing arms 115 of the transport path connecting sections in the sorting and transport unit 28 to be pressed against the receiving sections of the rotation control levers 85 of the two-way delivery transport units 40 to 44, thereby rotating the front and rear movable guides 72 and 73 at a time by an angle corresponding to the position of the front and rear connecting section guides 120 and 121.

When installing the upper unit 13, the automatic teller machine 1 can thus position easily and accurately the upper ends of the two-way bill transport paths 40A' to 44A with respect to the lower ends of the respective bill sorting and transport paths 28A, and connect them to each other.

In the automatic teller machine 1, the pressing arm 115 is attached to each of the front connecting section guides 120 of the transport path connecting sections in the sorting and transport unit 28, and the rotation control lever 85 is attached to each of the rear guide holding sections 71 of the two-way delivery transport units 40 to 44. If the lower ends of the bill sorting and transport path 28A are displaced from the respective two-way bill transport paths 40A to 44A differently in amount and direction, the upper ends of the two-way bill transport paths 40A to 44A can be accurately positioned with respect to the upper ends of the bill sorting and transport path 28A, respectively, and connect them to each other.

In the automatic teller machine 1, the upper ends of the two-waybill transport paths 40A to 44A can thus be accurately positioned specifically with respect to the associated upper ends of the bill sorting and transport path 28A, as described above, and connect them to each other. Therefore, when assembling the automatic teller machine 1 in a factory or replacing the upper unit 13 at an installation site, the required accuracy of the positional adjustment of the upper unit 13 in the teller machine fore-and-aft direction may be decreased to the level that can be offset by positioning through the rotation of the front and rear movable guides 72 and 73 with the use of the pressing arm 115 and the rotation control lever 85.

The automatic teller machine 1 is adapted so that, when assembling the automatic teller machine 1 in a factory or replacing the upper unit 13 at an installation site, the required accuracy of the positional adjustment of the upper unit 13 in the teller machine fore-and-aft direction may be reduced, so that the operation of adjusting the position of the upper unit 13 in the teller machine fore-and-aft direction can accordingly be simplified.

The automatic teller machine 1 is configured so that the two-way delivery transport units 40 to 44 each are provided with the vertically movable left and right positioning pins 87 and 88 for positioning the bill repositories 20 to 24 for connection to the transport paths.

Also in the automatic teller machine 1, the inserting and extracting member 125 is provided in the cashbox housing 15 for moving the left and right positioning pins 87 and 88 of the two-way delivery transport units 40 to 44 upward in response to opening/closing of the cashbox door 15B to pull out the pins at a time from the left and right positioning holes 140C and 140D of the bill repositories 20 to 24, and to move the left and right positioning pins 87 and 88 to insert the pins altogether into the left and right positioning holes 140C and 140D of the bill repositories 20 to 24.

Accordingly, with the automatic teller machine 1, when installing the repository load casing 16 in the cashbox housing 15, a mere closure of the cashbox door 15B of the cashbox housing 15 allows the upper ends of the stored-bill transport paths 20AX to 24AX of the bill repositories 20 to 24 to accurately be positioned with respect to the lower ends of the respective two-way bill transport paths 40A to 44A of the two-way delivery transport units 40 to 44, and connect them to each other.

When pulling out the repository load casing 16 from the cashbox housing 15, with the automatic teller machine 1, a simple opening of the cashbox door 15B of the cashbox housing 15 allows the left and right positioning pins 87 and 88 of each of the two-way delivery transport units 40 to 44 to be pulled out at a time from the left and right positioning holes 140C and 140D of each of the bill repositories 20 to 24.

Thus, with the automatic teller machine 1, when pulling out the repository load casing 16 from the cashbox housing 15, an opening the cashbox door 15B of the cashbox housing 15 permits the repository load casing 16 to be pulled out from the cashbox housing 15 without performing any special operation for pulling out the left and right positioning pins 87 and 88 of the two-way delivery transport units 40 to 44 from the left and right positioning holes 140C and 140D from the respective bill repositories 20 to 24.

With the above-described illustrative embodiment, the front and rear movable guides 72 and 73 in pair are rotatably provided in each of the two-way delivery transport units 40 to 44, and the front and rear movable guides 72 and 73 may be rotated via the left and right coupling plates 81 and 82, with each of the one surfaces being substantially parallel to each other.

Figure 20A:
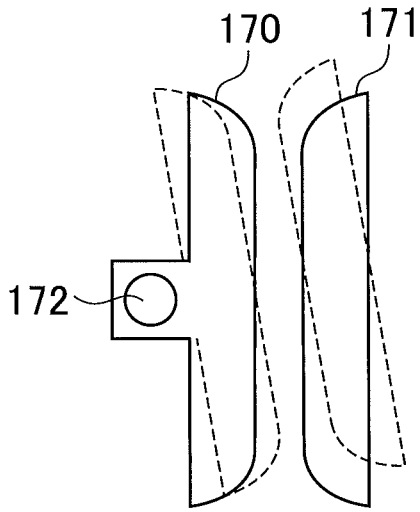
FIGS. 20A and 20B are schematic side views showing the structure of a pair of transport guides in accordance with an alternative embodiment.
Figure 20B:
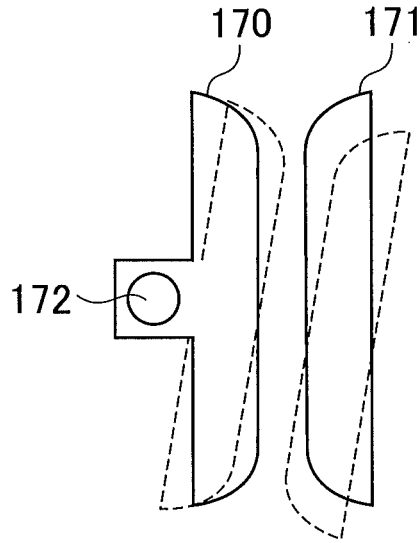
Figure 21:
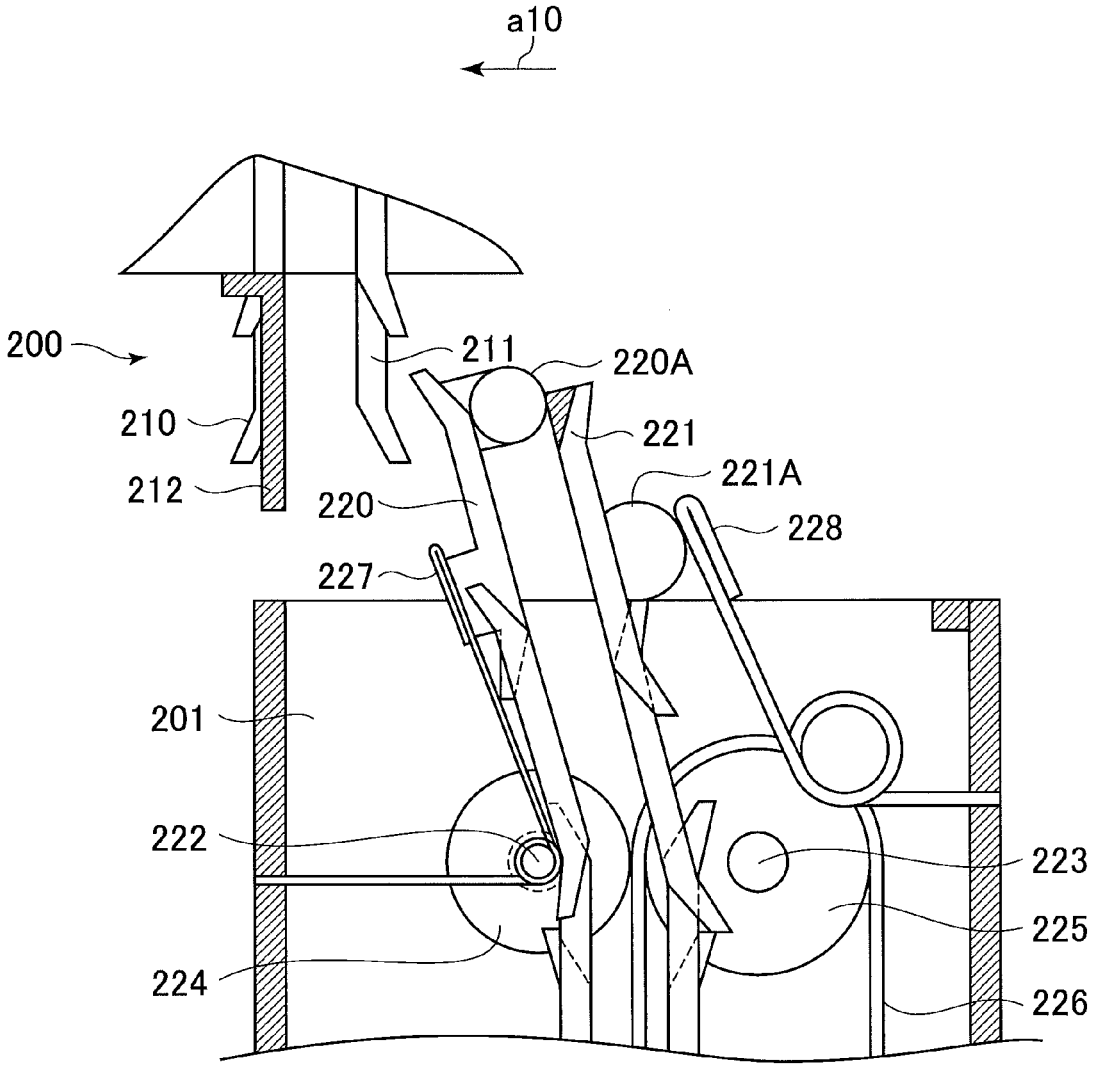
FIG. 21 PRIOR ART
FIG. 21 is a schematic sectional view showing part of a conventional structure of an in-mechanism transport unit and a delivery transport unit.
Figure 22:
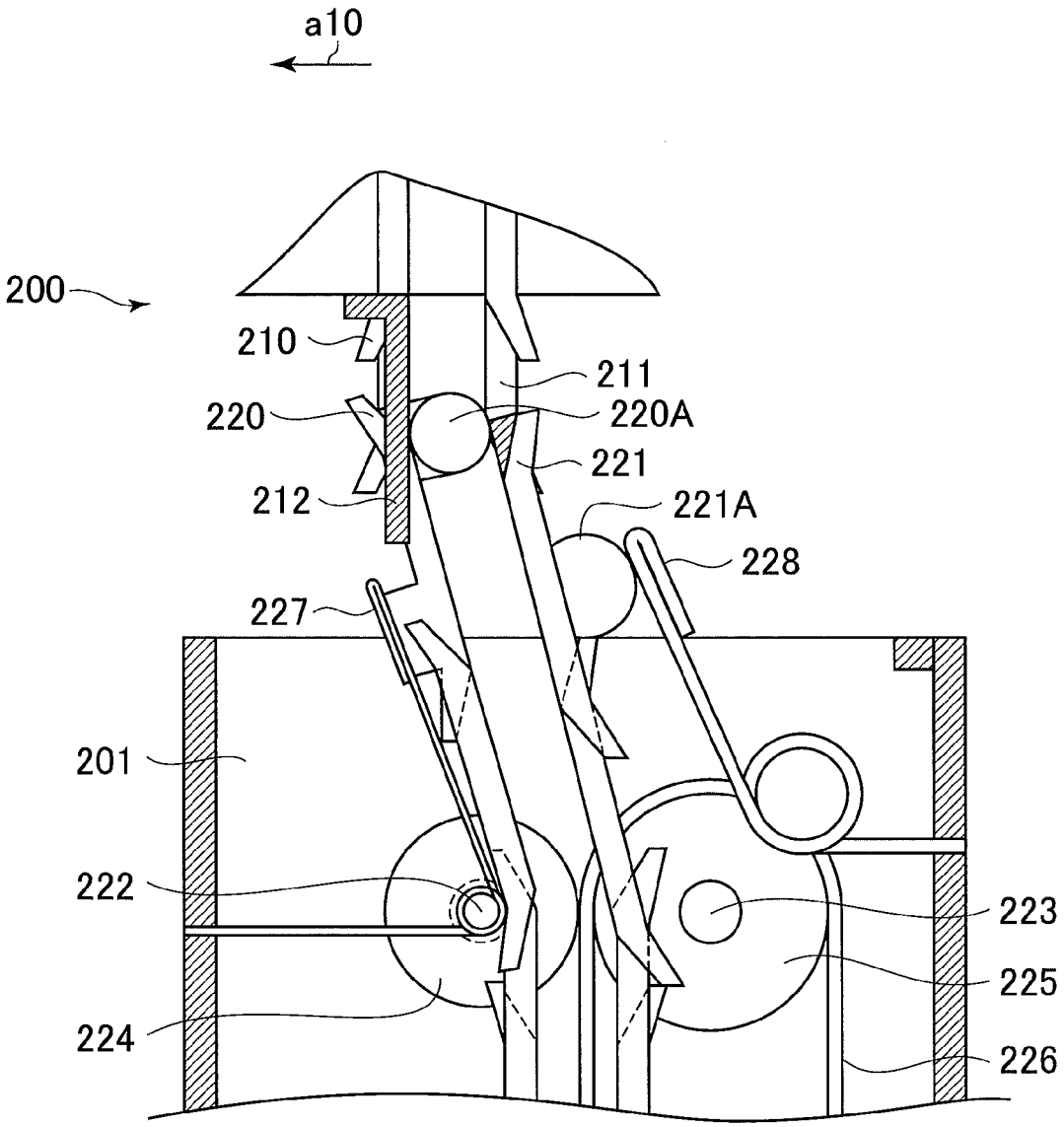
FIG. 22 PRIOR ART
FIGS. 22, 23 and 24 are schematic sectional views showing part of the structure shown in FIG. 22 and useful for understanding three connection states of the in-mechanism bill transport path and the bill delivery transport path.
Figure 23:
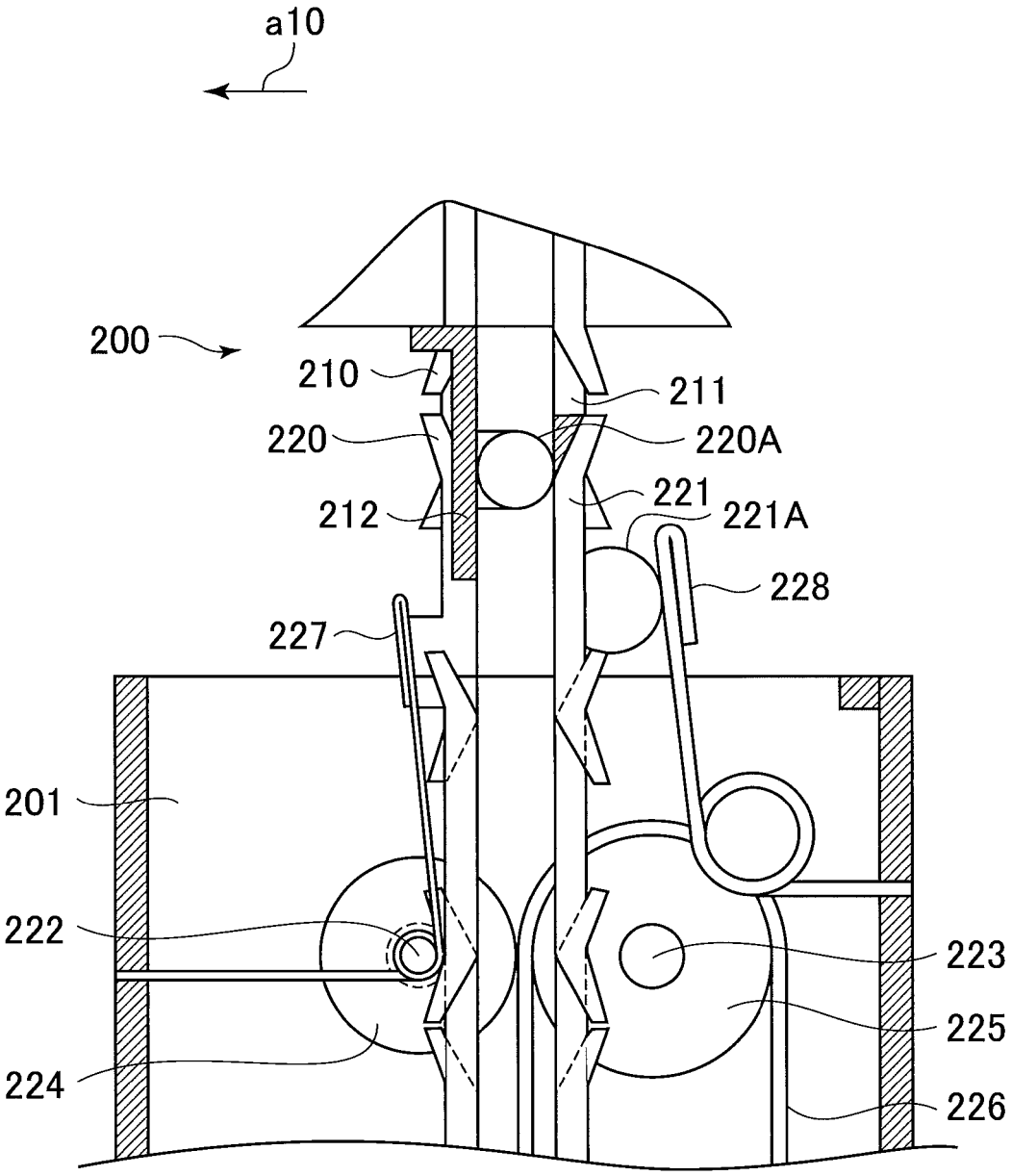
FIG. 23 PRIOR ART
Figure 24:
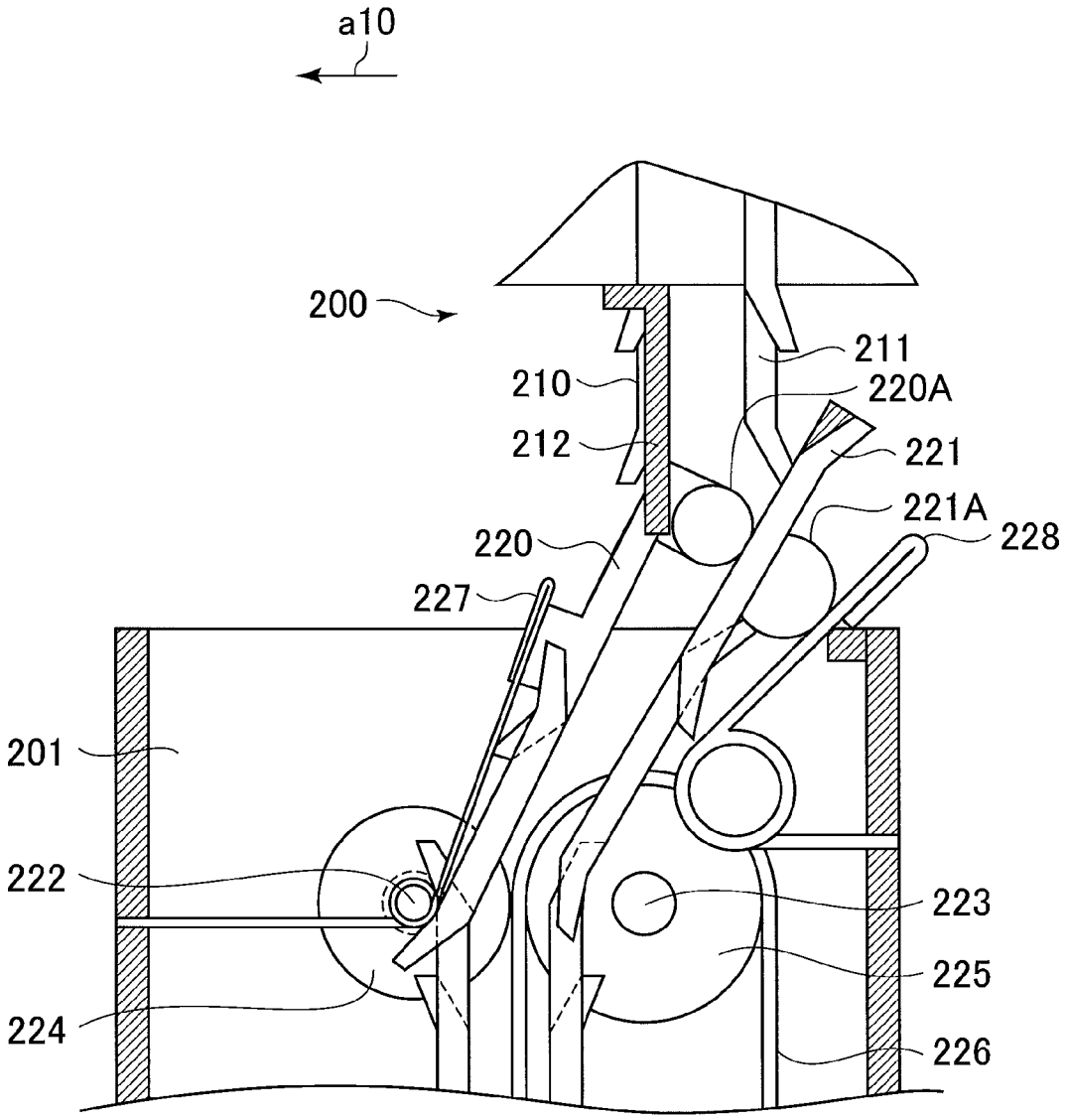
FIG. 24 PRIOR ART

However, the present invention may not be limited to that specific feature of the illustrative embodiment. For example, as shown in FIGS. 20A and 20B, one of a pair of transport guides 170 and 171 may be fixed to the other of the transport guides 170 and 171 with each one surface being substantially in parallel to each other, and the pair of transport guides 170 and 171 may be disposed rotatably about one rotational shaft. According to that configuration, the structure for rotating the pair of transport guides 170 and 171 can be simplified in the two-way delivery transport unit.

In the above-described illustrative embodiment, in order to position the transport paths for connection of the two-way delivery transport units 40 to 44 to the bill repositories 20 to 24, the left and right positioning pins 87 and 88 are employed.

However, the present invention may not be limited to that specific feature of the illustrative embodiment. In each of the two-way delivery transport units 40 to 44, a pair of transport guides like the front and rear movable guides 72 and 73 may be provided below the front and rear movable guides 72 and 73. According to the present invention, the positioning for connection of the two-way delivery transport units 40 to 44 to the bill repositories 20 to 24 may be achieved in the same manner as positioning for connection of the two-way delivery transport units 40 to 44 to the transport path connecting sections of the sorting and transport unit 28.

According to that configuration, the two-way bill transport paths 40A to 44A can be accurately positioned with respect to the stored-bill transport paths 20AX to 24AX, respectively, and connect to each other.

In the above-described illustrative embodiment, the two-way delivery transport units 40 to 44 are provided between the sorting and transport unit 28 and the bill repositories 20 to 24.

However, the present invention may not be limited to that specific feature of the illustrative embodiment. The two-way delivery transport units 40 to 44 may be configured as described immediately above, and further the upper housing 27 and the sorting and transport unit 28 may be adapted to be individually movable in the upper unit 13 so as to be pulled out from and installed into the teller machine housing 2, and then the two-way delivery transport unit may be provided between the upper housing 27 and the sorting and transport unit 28.

In the above-described illustrative embodiment, the front and rear connecting section guides 120 and 121 are in pair fixed to each of the transport path connecting sections of the sorting and transport unit 28, and the front and rear movable guides 72 and 73 are provided in each of the two-way delivery transport units 40 to 44.

However, the present invention may not be limited to that specific feature of the illustrative embodiment. The pair of transport guides may be rotatably provided in each of the transport path connecting sections of the sorting and transport unit 28, with each one surface being substantially in parallel to each other, and the pair of transport guides in place of the front and rear movable guides 72 and 73 may be fixed to the two-way delivery transport units 40 to 44.

Thus, according to the present invention, the configuration of the front and rear movable guides 72 and 73 may be applied not exclusively to the two-way delivery transport units 40 to 44. For example, the upper housing 27 and the sorting and transport unit 28 may be adapted to be individually moved to be pulled out from and installed into the teller machine housing 2, and the configuration of the front and rear movable guides 72 and 73 may be also applied to the transport path connecting sections of the front and rear transport units 32 and 33 to the sorting and transport unit 28, or the transport path connecting section of the sorting and transport unit 28 to the front and rear transport units 32 and 33.

In the above-described illustrative embodiment, the automatic teller machine 1 is adapted to transport bills with the one long side thereof being oriented in the transport direction.

However, the present invention may not be limited, but the automatic teller machine 1 may be adapted to transport bills with the one short side thereof being oriented in the transport direction, and the bill transport units such as the two-way delivery transport units 40 to 44 and the sorting and transport unit 28 may be configured accordingly to the bill transport position.

With the above-described illustrative embodiment, bill transport apparatus according to the present invention is provided in the automatic teller machine 1 described with reference to FIGS. 1 to 20, and may be applied to the linkage unit 35 having the two-way delivery transport units 40 to 44.

However, the present invention may not be limited to that specific feature of the illustrative embodiment, but can be widely applied to other kinds of sheet transport apparatuses with various configurations. For example, the invention may be applied to a sheet handling apparatus for use in transporting limited types of sheet-like objects such as tickets, copy paper sheets, postcards, stamps and securities, and also to a sheet handling apparatus for use in transporting various types of sheets.

The above-described illustrative embodiment is directed to the sheet handling apparatus according to the present invention applied to the automatic teller machine 1 with reference to FIGS. 1 to 20. However, the present invention may not be limited thereto, but can be broadly applied to other kinds of sheet handling apparatuses with various configurations for handling various kinds of sheet-kike objects such as bills and tickets. For example, they may be cash dispensers (CD), fare-adjustment machines, ticket vending machines for use in selling train tickets or theater/museum tickets, automatic vending machines, amusement machines such as pachinko machines and slot machines, copying machines, and postcard and stamp handling units.

In the above-described illustrative embodiment, the front and rear movable guides 72 and 73 shown in FIGS. 1 to 20, which are provided in each of the two-way delivery transport units 40 to 44 and have the generally J-like cross section, are used as a pair of transport guides substantially parallel to each other with the predetermined spacing remaining in between, the transport guides having a transport path formed in between, of which the one ends have a transport path to be connected, and are engageable, with the ends of a pair of connectable transport guides substantially parallel to each other with the spacing remaining in between.

However, the present invention may not be limited to that specific feature of the illustrative embodiment, but can be widely applied to other types of pair of transport guides having various shape and configuration. For example, they may be a pair of planer transport guides or a pair of transport guides rotatably provided in the bill transport unit for transporting bills in one direction.

In the above-described illustrative embodiment, the front and rear connecting section guides 120 and 121 of the sorting and transport unit 28 shown in FIGS. 1 to 20 are used as the pair of connectable transport guides that have the transport path to be connected formed in between and are substantially parallel to each other with the spacing remaining in between.

However, the present invention may not be limited to that specific feature of the illustrative embodiment, but can be applied to other kinds of pair of connectable transport guides having various shapes and configurations. For example, they may be a pair of transport guides such as provided in the front and rear transport units 32 and 33.

In the above-described illustrative embodiment, the transport unit frame 60, the front roller shaft 63 and the rear roller shaft 64 in each of the two-way delivery transport units 40 to 44 shown in FIGS. 1 to 20 are used as a supporting mechanism for use in rotatably supporting the pair of transport guides according to the position of the pair of connectable transport guides.

However, the present invention may not be limited to that specific feature of the illustrative embodiment, but can be broadly applied to other various types of supporting mechanism. For example, they may be a housing having a movable shaft dedicatedly provided to rotation of the transport guides separately from the roller shaft.

In the above-described illustrative embodiment, the rotation control lever 85 of each of the two-way delivery transport units 40 to 44 shown in FIGS. 1 to 20 is used as a rotation control lever adapted for rotating the pair of transport guides rotatably supported by the supporting section according to the position of the pair of connectable transport guides.

However, the present invention may not be limited to that specific feature of the illustrative embodiment, but can be generally applied to other kinds of rotation control levers having various configurations. For example, they may be a rotation control lever that is attached to the front movable guide 72 and is hung and pulled rearward in response to the movement of the sorting and transport unit 28.

In the above-described illustrative embodiment, the two-way delivery transport units 40 to 44 shown in FIGS. 1 to 20 are used as a plurality of bill transport units each including the pair of transport guides, the supporting section and the rotation control lever. However, the present invention may not be limited thereto, but can be widely applied to other kinds of sheet-like object transport units having various similar configurations similar in configuration to the two-way delivery transport units 40 to 44. For example, they may be a one-directional delivery transport unit for transporting bills only in one direction.

In the above-described illustrative embodiment, the cylindrical left and right positioning pins 87 and 88, each of which has its front end tapered, shown in FIGS. 1 to 20, are used as a plurality of positioning pins respectively provided in the plurality of bill transport units, the positioning pins being adapted to position a plurality of bill repositories sequentially disposed in the one direction with the respective bill transport units. However, the present invention may not be limited thereto, but other types of positioning pins of various shapes can be widely adopted.

In the above-described illustrative embodiment, the inserting and extracting member 125 shown in FIGS. 1 to 20 is used as an inserting and extracting member for inserting and extracting the positioning pins provided in the respective bill transport units into and from the respective pin-receiving holes formed in the bill transport units.

However, the present invention may not be limited to that specific feature of the illustrative embodiment, but can be widely applied to other types of inserting and extracting mechanism having various configurations. For example, they may be an inserting and extracting member for sequentially inserting the positioning pins provided in the respective sheet transport units into respective pin-receiving holes formed in the sheet transport units at different timings, and sequentially extracting the positioning pins from the pin-receiving holes also at different timings. Also applicable is an inserting and extracting member adapted for moving the movable arm 127 by the operation of the operator.

The present invention may be applied to a sheet-like object transport apparatus for transporting sheet-like objects such as bills, tickets, copy paper sheets, postcards, stamps, securities, as well as a sheet handling apparatus for handling such sheet-like objects to be transported by the sheet-like object transport apparatus dealing with sheet-like objects such as bills, tickets, copy paper sheets, postcards, stamps, securities.

The entire disclosure of Japanese patent application No. 2012-113610 filed on May 17, 2012, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A sheet handling apparatus comprising:

a first pair of transport guides that are substantially parallel to and spaced from each other to form a first transport path in between the first pair of transport guides to transport a sheet;

a second pair of transport guides substantially parallel to and spaced from each other to form a second transport path in between the second pair of transport guides to transport the sheet, said second pair of transport guides having one end shaped to be engageable with an end of said first pair of transport guides;

a supporting member rotatably supporting said second pair of transport guides in response to a position of said first pair of transport guides; and a coupling member for coupling of a first guide and a second guide of said second pair of transport guides with each other, said coupling member holding said first guide and said second guide in parallel to each other so that said first guide and said second guide are parallel to each other in every position of said first guide and said second guide.

2. A sheet transport apparatus comprising:

a first pair of transport guides that are substantially parallel to and spaced from each other to form a first transport path in between the first pair of transport guides to transport a sheet;

a second pair of transport guides substantially parallel to and spaced from each other to form a second transport path in between the second pair of transport guides to transport the sheet, said second pair of transport guides having one end shaped to be engageable with an end of said first pair of transport guides;

a supporting member rotatably supporting said second pair of transport guides in response to a position of said first pair of transport guides; and a coupling member for coupling of a first guide and a second guide of said second pair of transport guides with each other, said coupling member holding said first guide and said second guide in parallel to each other so that said first guide and said second guide are parallel to each other in every position of said first guide and said second guide.

3. The apparatus in accordance with claim 2, further comprising a rotation control lever rotating said second pair of transport guides in response to the position of said first pair of transport guides.

4. The apparatus in accordance with claim 3, wherein said first pair of transport guides includes a plurality of first pairs of transport guides, said second pair of transport guides includes a plurality of second pairs of transport guides, said supporting member includes a plurality of supporting members, and said coupling member includes a plurality of coupling members, the apparatus further comprising a plurality of sheet transport units, wherein said second pairs of transport guides, said plurality of supporting members and said rotation control levers are included in each of said plurality of transport units, said plurality of sheet transport units being movable in one direction and another direction opposite to the one direction, said plurality of first pairs of transport guides being sequentially disposed in the one direction and being associated with a plurality of sheet repositories for storing sheets in the plurality of sheet repositories, said rotation control levers being provided in the one direction across said plurality of sheet transport units, said rotation control levers having front ends thereof displaced from each other in an orthogonal direction substantially perpendicular to the one direction.

5. The apparatus in accordance with claim 4, wherein said plurality of sheet repositories are sequentially disposed in the one direction, further wherein each of said plurality of sheet transport units has a pin-receiving hole formed in said plurality of sheet transport units, said apparatus further comprising:

a plurality of positioning pins provided in respective ones of said plurality of sheet transport units to position said plurality of sheet repositories with respect to said respective plurality of sheet transport units; and an inserting and extracting member inserting and extracting said plurality of positioning pins into and from respective ones of the pin-receiving holes.

6. The apparatus in accordance with claim 5, further comprising a housing which has a door openably attached to a part of the housing, the housing having said plurality of sheet repositories detachably installed in the housing, wherein said inserting and extracting member is provided in said housing to be operative in response to opening and closing of the door to insert and extract said plurality of positioning pins into and from said pin-receiving holes of said respective plurality of sheet transport units.

7. The apparatus in accordance with claim 2, wherein said first pair of transport guides includes a plurality of first pairs of transport guides, said second pair of transport guides includes a plurality of second pairs of transport guides, said supporting member includes a plurality of supporting members, and said coupling member includes a plurality of coupling members, and wherein the sheet transport apparatus further comprises:

rotation control levers rotating said plurality of second pairs of transport guides in response to positions of said plurality of first pairs of transport guides;

a plurality of sheet transport units, said plurality of second pairs of transport guides, said plurality of supporting members, said rotation control levers and said plurality of coupling members being included in each of said plurality of sheet transport units, said plurality of first pairs of transport guides being disposed in another sheet transport apparatus in one direction relative to one another, the another sheet transport apparatus being movable in the one direction and in a reverse direction opposite to the one direction, said plurality of sheet transport units being disposed along said one direction to correspond to said plurality of first pairs of transport guides, said rotation control levers having front ends thereof displaced from each other in an orthogonal direction substantially perpendicular to the one direction;

a plurality of sheet repositories for storing sheets therein, said plurality of sheet repositories being disposed to correspond to said plurality of sheet transport units, each of said plurality of sheet repositories having a pin-receiving hole formed therein;

a plurality of positioning pins provided in respective ones of said plurality of sheet transport units to position said plurality of sheet repositories with respect to said respective plurality of sheet transport units; and an inserting and extracting member inserting and extracting said plurality of positioning pins into and from respective ones of the pin-receiving holes.

8. A sheet transport apparatus comprising:

first pairs of transport guides that are substantially parallel to and spaced from each other to form first transport paths in between the first pairs of transport guides to transport a sheet;

second pairs of transport guides substantially parallel to and spaced from each other to form second transport paths in between the second pairs of transport guides to transport the sheet, said second pairs of transport guides having ends shaped to be engageable with ends of said first pairs of transport guides;

supporting members rotatably supporting said second pairs of transport guides in response to positions of said first pairs of transport guides;

rotation control levers rotating said second pairs of transport guides in response to the positions of said first pairs of transport guides; and a plurality of sheet transport units, wherein said second pairs of transport guides, said supporting members and said rotation control levers are included in each of said plurality of transport units, said plurality of sheet transport units being movable in one direction and another direction opposite to the one direction, said first pairs of transport guides being sequentially disposed in the one direction and being associated with a plurality of sheet repositories for storing sheets in the plurality of sheet repositories, said rotation control levers being provided in the one direction across said plurality of sheet transport units, said rotation control levers having front ends thereof displaced from each other in an orthogonal direction that is substantially perpendicular to the one direction.

9. The apparatus in accordance with claim 8, wherein said plurality of sheet repositories are sequentially disposed in the one direction, further wherein each of said plurality of sheet transport units having a pin-receiving hole formed therein, said apparatus further comprising:

a plurality of positioning pins provided in respective ones of said plurality of sheet transport units to position said plurality of sheet repositories with respect to said respective plurality of sheet transport units; and an inserting and extracting member inserting and extracting said plurality of positioning pins into and from respective ones of the pin-receiving holes.

10. The apparatus in accordance with claim 9, further comprising a housing having a door openably attached to another part of the housing, the housing having said plurality of sheet repositories detachably installed in the housing, wherein said inserting and extracting member is provided in said housing to be operative in response to opening and closing of the door to insert and extract said plurality of positioning pins into and from said pin-receiving holes of said respective plurality of sheet transport units.

* * * * *